US006711469B2

(12) United States Patent
Sakamoto et al.

(10) Patent No.: US 6,711,469 B2
(45) Date of Patent: Mar. 23, 2004

(54) ROBOT SYSTEM, ROBOT APPARATUS AND COVER FOR ROBOT APPARATUS

(75) Inventors: Takayuki Sakamoto, Kanagawa (JP); Masahiro Fujita, Saitama (JP); Seiichi Takamura, Tokyo (JP); Yu Hirono, Tokyo (JP); Hironari Hoshino, Tokyo (JP); Nobuhiko Ohguchi, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/305,302

(22) Filed: Nov. 26, 2002

(65) Prior Publication Data

US 2003/0078696 A1 Apr. 24, 2003

Related U.S. Application Data

(63) Continuation of application No. 09/869,256, filed as application No. PCT/JP00/07592 on Oct. 27, 2000, now Pat. No. 6,505,098.

(30) Foreign Application Priority Data

| | | |
|---|---|---|
| Oct. 29, 1999 | (JP) | 11-310329 |
| Oct. 29, 1999 | (JP) | 11-310330 |
| Oct. 29, 1999 | (JP) | 11-310331 |
| Oct. 26, 2000 | (JP) | 2000-332141 |

(51) Int. Cl.[7] ..... G06F 19/00

(52) U.S. Cl. ..... 700/245; 446/175; 446/301; 446/457; 219/124.34; 219/125.1; 901/1; 901/10; 901/42; 29/711; 29/783; 29/784; 700/247; 700/248; 700/249; 700/258

(58) Field of Search ..... 700/245, 215, 700/247, 248, 249, 258; 427/239, 248, 287; 446/175, 301, 457; 704/201; 235/375; 29/711, 783, 784; 492/47, 56; 219/124.34, 125.1; 318/575; 901/1, 10, 42

(56) References Cited

U.S. PATENT DOCUMENTS

| | | | | |
|---|---|---|---|---|
| 4,010,346 A | | 3/1977 | Cecil et al. | 219/124.34 |
| 4,736,826 A | | 4/1988 | White et al. | 191/12.2 A |
| 6,074,271 A | * | 6/2000 | Derrah | 446/457 |

(List continued on next page.)

FOREIGN PATENT DOCUMENTS

| | | |
|---|---|---|
| CN | 1225304 A | 8/1999 |
| EP | 0 924 034 A2 | 6/1999 |
| JP | 5-147339 | 6/1993 |

(List continued on next page.)

OTHER PUBLICATIONS

Sony Corporation, Aibo wireless Ian card, 2000, Internet, 1–36.*

Sony, Entertainment Robot AIBO ERS–210, no date, Internet, pp. 1–2.

(List continued on next page.)

*Primary Examiner*—William A. Cuchlinski, Jr.
*Assistant Examiner*—McDieunel Marc
(74) *Attorney, Agent, or Firm*—Frommer Lawrence & Haug LLP; William S. Frommer; Gordon Kessler

(57) ABSTRACT

An authenticating pattern is disposed on a cover and an authenticating device is disposed in a robot apparatus for authenticating the cover on the basis of the authenticating pattern of the fitted cover. An information holding device for holding inherent information is disposed in the cover and a reading device for reading out the inherent information from the information holding device is disposed in the robot apparatus. A function of detecting an amount of influence due to the cover and changing manifesting patterns of motions as occasion demands on the basis of the detection result is disposed in the robot apparatus.

16 Claims, 45 Drawing Sheets

U.S. PATENT DOCUMENTS

| | | | | | |
|---|---|---|---|---|---|
| 6,118,889 | A | * | 9/2000 | Izuno et al. | 382/119 |
| 6,505,098 | B1 | * | 1/2003 | Sakamoto et al. | 700/245 |
| 6,514,117 | B1 | * | 2/2003 | Hampton et al. | 446/301 |

FOREIGN PATENT DOCUMENTS

| | | |
|---|---|---|
| JP | 8-257975 | 10/1996 |
| JP | 3047055 | 1/1998 |
| JP | 11-179060 | 7/1999 |
| JP | 11-188678 | 7/1999 |
| JP | WO 01 32366 A1 | 10/2000 |

OTHER PUBLICATIONS

O'Neal, Cyberdog shoot–out, Aug. 2000, Internet, pp. 1–2.

Miles, Sony updates Aibo, the robotic dog, 1999, Internet, pp. 1–2.

Gu et al., Towards learning and evolving of a team of Soly legged robots, no date, Internet, pp. 1–8.

* cited by examiner

141 PET ROBOT

| parameter | unit | initial range |
|---|---|---|
| body center x | mm. | 85-95 |
| body center z | mm. | -5-5 |
| body pitch | degrees | -5-5 |
| all legs y | mm. | 5-25 |
| front legs z | mm. | 24-40 |
| rear legs z | mm. | 15-29 |
| step length | n. a. | 80-220 |
| swing height | mm. | 15-29 |
| swing time | ms. | 200-400 |
| swing mult. | n. a. | 1.5-2.5 |
| switch time | ms. | 500-900 |
| ampl body x | mm. | -2-2 |
| ampl body y | mm. | 0-20 |
| ampl body z | mm. | -2-2 |
| ampl yaw | degrees | -2-2 |
| ampl pitch | degrees | -3-3 |
| ampl roll | degrees | -3-3 |
| min. gain | n. a. | 25-175 |
| shift | degrees | 60-120 |
| length | degrees | 90-150 |
| L-R | n. a. | 0.25-0.5 |
| F-H | n. a. | 0.5-0.75 |

FIG. 31

- TYPE OF SHEATH[M]
  - -SHEATH ID and/or Ver. INFORAMTION
- TYPE OF OBJECT BONE[M]
  - -BONE ID and/or Ver. INORMATION
- PORT INFORMATION[M]
  - -Support Port Type(1 and/or 2)[M]
  - -Input Port
    - INFORMATION ON THE PRESECE OR ABSENCE OF SENSOR DEVICES[M]
    - CHARACTERISTIC INFORMATION ON SENSOR DEVICES[O]
      - -(SW or??)
  - -Output Port
    - INFORMATION ON THE PRESECE OR ABSENCE OF SHOWING DEVICES[M]
    - CHARACTERISTIC INFORMATION ON SHOWING DEVICES[O]
      - -(LED or PLUNGER)

- CHARACTERISTIC INFORMATION[M]
  - -4 KINDS (2Bit) or 8 KINDS (3Bit)
  - -256 KINDS (1Byte)
- CANOPY CHARACTERISTICS[M, O]
  - -256 KINDS (1Byte)
    - OFFSET CORRECTION VALUE DEPENDENTLY ON COLORS
- SHEATH PHYSICAL INFORMATION[O]
  - -BARYCENTER
  - -MOTION INFORMATION
  - -MOVABLE RANGE

- [M]:Mandatory
- [O]:Optional(Extended)

FIG. 42

| | INPUT EVENT NAME | DATA NAME | RANGE FOR DATA | TRANSITION PROBABILITY TO OTHER NODES | | | | |
|---|---|---|---|---|---|---|---|---|
| node 100 | | | | A | B | C | D | n |
| DESTINATION NODE | | | | node 120 | node120 | node 1000 | | node 600 |
| OUTPUT ACTION | | | | ACTION 1 | ACTION 2 | ACTION 3 | | ACTION 4 |
| 1 | BALL | SIZE | 0, 1000 | 30% | | | | |
| 2 | PAT | | | | 40% | | | |
| 3 | HIT | | | | | 20% | | |
| 4 | SOUND | | | | | | | 50% |
| 5 | OBSTACLE | DISTANCE | 0, 100 | | | | | |
| 6 | | JOY | 50, 100 | | | | | |
| 7 | | SUPRISE | 50, 100 | | | | | |
| 8 | | SADNESS | 50, 100 | | | | | |
| | | | | | | | | |

244

FIG. 45

| DISTANCE (cm) | NOTHING | BLACK (0° ) | BLACK (5° ) | BLACK (10° ) | BLACK (15° ) | BLACK (20° ) | BLACK (25° ) | BLACK (30° ) |
|---|---|---|---|---|---|---|---|---|
| 5 | 2.18 | 2.11 | 2.06 | 2.06 | 2.09 | 2.04 | 2.11 | 2.11 |
| 6 | 2.4 | 2.39 | 2.39 | 2.39 | 2.39 | 2.39 | 2.4 | 2.4 |
| 10 | 1.813 | 1.837 | 1.837 | 1.837 | 1.837 | 1.837 | 1.825 | 1.825 |
| 20 | 0.986 | 1.066 | 1.022 | 1.022 | 1.01 | 0.984 | 0.984 | 0.997 |
| 30 | 0.667 | 0.896 | 0.793 | 0.78 | 0.741 | 0.678 | 0.69 | 0.703 |
| 40 | 0.51 | 0.896 | 0.754 | 0.716 | 0.651 | 0.534 | 0.547 | 0.586 |
| 50 | 0.418 | 0.985 | 0.78 | 0.742 | 0.638 | 0.47 | 0.482 | 0.534 |
| 60 | 0.353 | 1.078 | 0.854 | 0.792 | 0.66 | 0.424 | 0.456 | 0.521 |
| 70 | 0.313 | 1.155 | 0.934 | 0.871 | 0.742 | 0.4 | 0.44 | 0.53 |
| 80 | 0.28 | 1.265 | 1.022 | 0.959 | 0.783 | 0.39 | 0.44 | 0.55 |
| 90 | 0.253 | 1.375 | 1.098 | 1.048 | 0.9 | 0.38 | 0.44 | 0.58 |

FIG. 46

| DISTANCE (cm) | NOTHING | YELLOW | GREEN | BLUE | RED |
|---|---|---|---|---|---|
| 5 | 2.13 | 2.07 | 2.05 | 2.02 | 2.06 |
| 6 | 2.4 | 2.4 | 2.39 | 2.39 | 2.4 |
| 10 | 1.84 | 1.835 | 1.852 | 1.834 | 1.849 |
| 20 | 0.988 | 0.994 | 1 | 0.994 | 0.997 |
| 30 | 0.695 | 0.675 | 0.675 | 0.688 | 0.678 |
| 40 | 0.525 | 0.532 | 0.538 | 0.545 | 0.521 |
| 50 | 0.433 | 0.443 | 0.446 | 0.467 | 0.429 |
| 60 | 0.368 | 0.377 | 0.38 | 0.431 | 0.37 |
| 70 | 0.328 | 0.339 | 0.322 | 0.402 | 0.324 |
| 80 | 0.3 | 0.3 | 0.268 | 0.38 | 0.295 |
| 90 | 0.27 | 0.274 | 0.22 | 0.379 | 0.27 |

FIG. 48

ROBOT SYSTEM, ROBOT APPARATUS AND COVER FOR ROBOT APPARATUS

This is a continuation of application Ser. No. 09/869,256, filed Jun. 26, 2001 now U.S. Pat. No. 6,505,098, which is a 371 of PCT/JP00/07592, filed Oct. 27, 2000.

TECHNICAL FIELD

The present invention relates to a robot system, a robot apparatus and a cover for a robot apparatus, and is preferably applied, for example, to a pet robot.

BACKGROUND

There halve recently been developed and on sale quadruped-walking type pet robots which resemble dogs or cats which are to be kept as pets in general households.

Such a pet robot is equipped with software such as emotion models which are modeling of real animals' emotions to generate emotions such as "joy" and "anger" in response to user's spurring such as "patting" and "striking" as well as a surrounding condition, so that the pet robot can autonomously act on the basis of the emotions.

By the way, for a reason to find fun in individuality of such an entertainment robot, it has recently been desired to make an appearance of a robot freely changeable, for example, by fitting a cover such as clothes/costume on the robot.

However, it is fearful that motions of the robot may be hindered or vent holes formed in a main body surface of the robot may be covered when the robot is clothed in a cover which is made without taking external forms and movements of movable members into consideration. It causes a problem that a control member cannot control adequately under such circumstances, which causes a trouble.

In addition, even in such a pet robot with a cover which is made with taking external forms and movements of movable members into consideration, if control is not performed with taking a mass distribution and the like of the cover into consideration, the pet robot may not correctly and smoothly act, for example, it does not walk with good balance.

Furthermore, considering that a pet robot can wear a cover, not only its appearance can be changeable but also if it can perform different actions depending on the appearance, it is considered that such a pet robot will be capable of giving higher emotions of intimacy and satisfaction to users, which improve an amusement property in the pet robot.

DISCLOSURE OF THE INVENTION

This invention has been achieved in view of the above points and is to propose a robot system, a robot apparatus and cover for the robot apparatus which can get rid of irregular covers to prevent occurrence of trouble, and a robot system, a robot apparatus and a cover for the robot apparatus which can improve an amusement property.

In order to solve such a problem, in a robot system comprising a robot apparatus and a cover in this invention, a predetermined authenticating pattern is formed on a cover and the robot apparatus is provided with an authenticating means for authenticating the cover on the basis of the authenticating pattern on the fitted cover. As a result, the robot system is capable of detecting an irregular cover when such a cover is fitted over a robot, which can realize a robot system capable of getting rid of irregular covers and previously preventing troubles in the robot.

Furthermore, the present invention provides a robot apparatus equipped with an authenticating means for authenticating a fitted cover on the basis of a predetermined authenticating pattern formed on a cover which is detachably fitted. As a result, the robot apparatus is capable of detecting an irregular cover when such a cover is fitted, which can realize a robot apparatus capable of getting rid of irregular covers and previously preventing troubles in the robot.

Furthermore, the present invention provides a cover for a robot apparatus with a predetermined authenticating pattern. As a result, a fitting robot apparatus can detect an irregular cover on the basis of the authenticating pattern when such a cover is fitted, which can getting rid of irregular covers and can realize a cover for a robot apparatus capable of previously preventing troubles in the robot.

Further, a robot system in the present invention provides a cover with an information holding means for holding inherent information, and a robot apparatus with an information detecting means for detecting the inherent information held by the information holding means on the cover and a control means for changing motion manifesting patterns as occasion demands on the basis of the detected inherent information. As a result, the robot system is capable of reflecting the inherent information obtained from the cover on the motion manifesting patterns of the robot apparatus as occasion demands when the cover is fitted over the robot apparatus. Thus, the robot system can act with an individuality for each cover, thereby making it possible to realize a robot system which can remarkably improve an amusement property.

Furthermore, the present invention provides a cover to be detachably fitted over a robot apparatus with an information holding means for holding inherent information corresponding to the cover, which allows the robot apparatus to change motion manifesting patterns as occasion demands on the basis of the inherent information held by the information holding means when the cover is fitted over the robot apparatus. As a result, when the covers is fitted over the robot apparatus, the inherent information obtained from the above described cover can be reflected on the motion manifesting patterns of the robot apparatus as occasion demands. Thus, the robot apparatus can act with an individuality for each cover, thereby making it possible to realize a cover capable of remarkably improving an amusement property in a robot apparatus.

Furthermore, the present invention provides a robot apparatus with an information detecting means for detecting inherent information corresponding to the cover from the cover when the cover is detachably fitted, and a control means for changing motion manifesting patterns on the basis of the detected inherent information as occasion demands. As a result, the robot apparatus can reflect the inherent information obtained from the cover on the motion manifesting patterns for the robot apparatus as occasion demands. Thus, the robot apparatus can act with an individuality for each cover, thereby making it possible to realize a robot apparatus capable of remarkably improving an amusement property.

Furthermore, the present invention provides a robot apparatus which has movable members and performs predetermined actions by moving the movable members, a cover to be detachably fitted over the robot apparatus, and a control means which is installed in the robot apparatus for driving and controlling the movable members. The control means detects an amount of influence on motions due to the cover by driving the movable members when the cover is fitted over the robot apparatus, and the motion manifesting patterns are changed on the basis of the detection result as occasion demands. As a result, in the robot system, the robot apparatus can previously prevent trouble in its performances even there are covers of various shapes and structures and materials, because the motion manifesting patterns for the robot apparatus are changed by moving the movable members after the cover is fitted over the robot apparatus. Thus, the different kinds of covers can be fitted over the robot apparatus, thus making it possible to realize a robot system capable of remarkably improving an amusement property.

Furthermore, the present invention provides the robot apparatus which has movable members and performs predetermined motions by moving the movable members, with a control means for detecting an amount of influence on the motions due to the cover by moving the movable members when the cover is detachably fitted and for changing the motion manifesting patterns on the basis of the detection result as occasion demands. As a result, the robot apparatus can previously prevent trouble in its performances even there are covers of various shapes and structures and materials, because the motion manifesting patterns for the robot apparatus are changed by moving the movable members after the cover is fitted over the robot apparatus. Thus, the different kinds of covers can be fitted over the robot apparatus, thus making it possible to realize a robot system capable of remarkably improving an amusement property.

BRIEF DESCRIPTION OF THE DRAWINGS

FIG. 31 is a table showing 22 parameters for walking-control.

FIG. 42 is a schematic diagram descriptive of cover information.

FIG. 45 is a table descriptive of state transition diagram.

FIG. 46 is a table showing the relation between an angle of incline of a canopy with respect to an optical axis of a distance sensor and an output characteristic of the distance sensor.

FIG. 48 is a table showing the relation between colors of the canopy and output characteristics of the distance sensor.

BEST MODE FOR CARRYING OUT THE INVENTION

Embodiments of the present invention will be described in detail with reference to the accompanying drawings.

(1) First Embodiment (1-1) Configuration of a Robot System in this Embodiment

Figure 1:
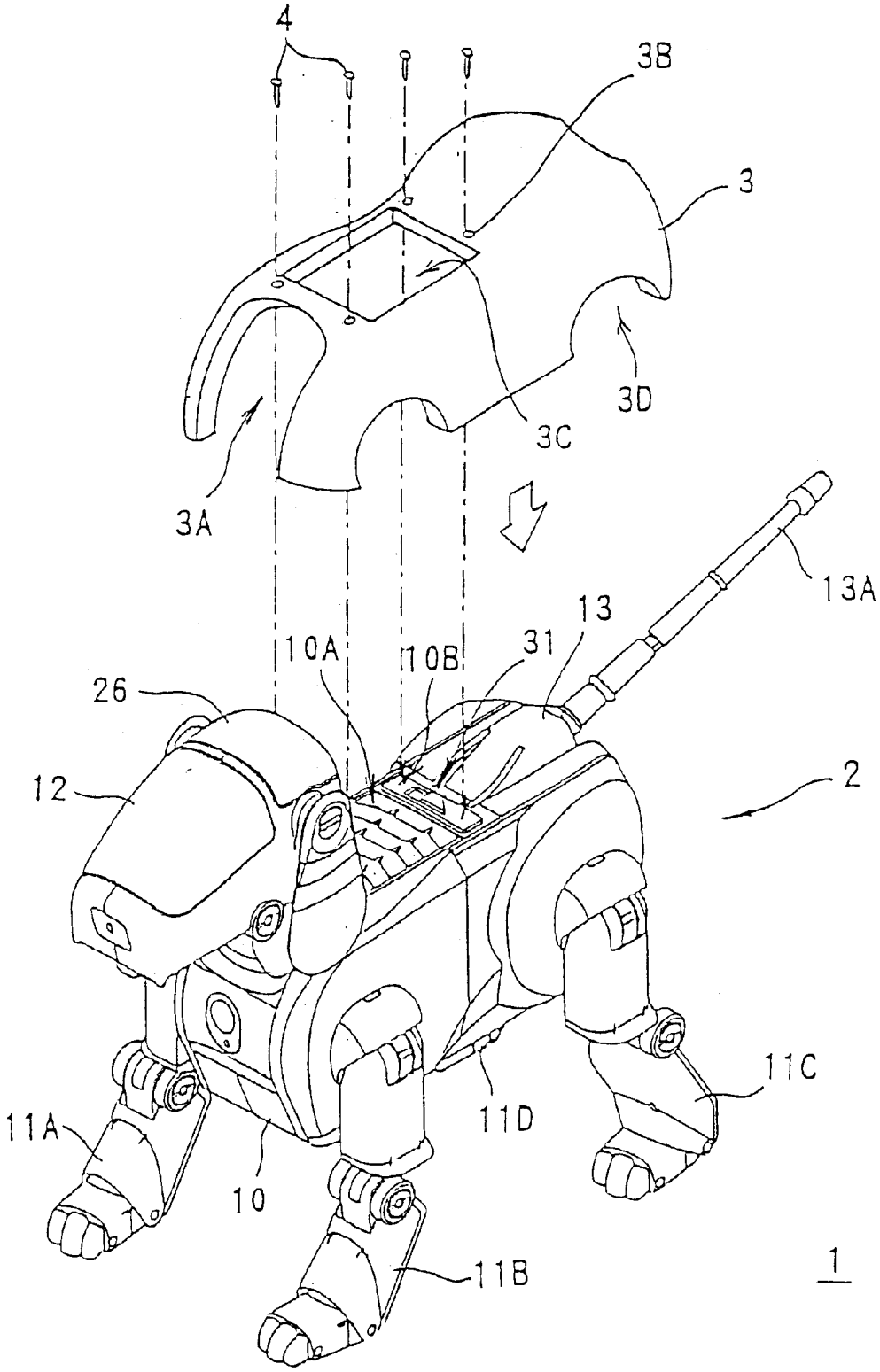
FIG. 1 is a perspective view showing a configuration of a robot system in a first embodiment.

In FIG. 1, reference numeral 1 denotes a robot system as a whole preferred as the embodiment, which comprises a pet robot 2 and a cover unit 3 to be fitted over the pet robot 2.

The pet robot 2 is formed by coupling leg member units 11A through 11D with front right, front left, rear right, and rear left portions of a body member unit 10 and connecting a head member unit 12 and a tail member unit 13 to a front end and a rear end of the body member unit 10, as apparent from FIG. 1.

Figure 2:
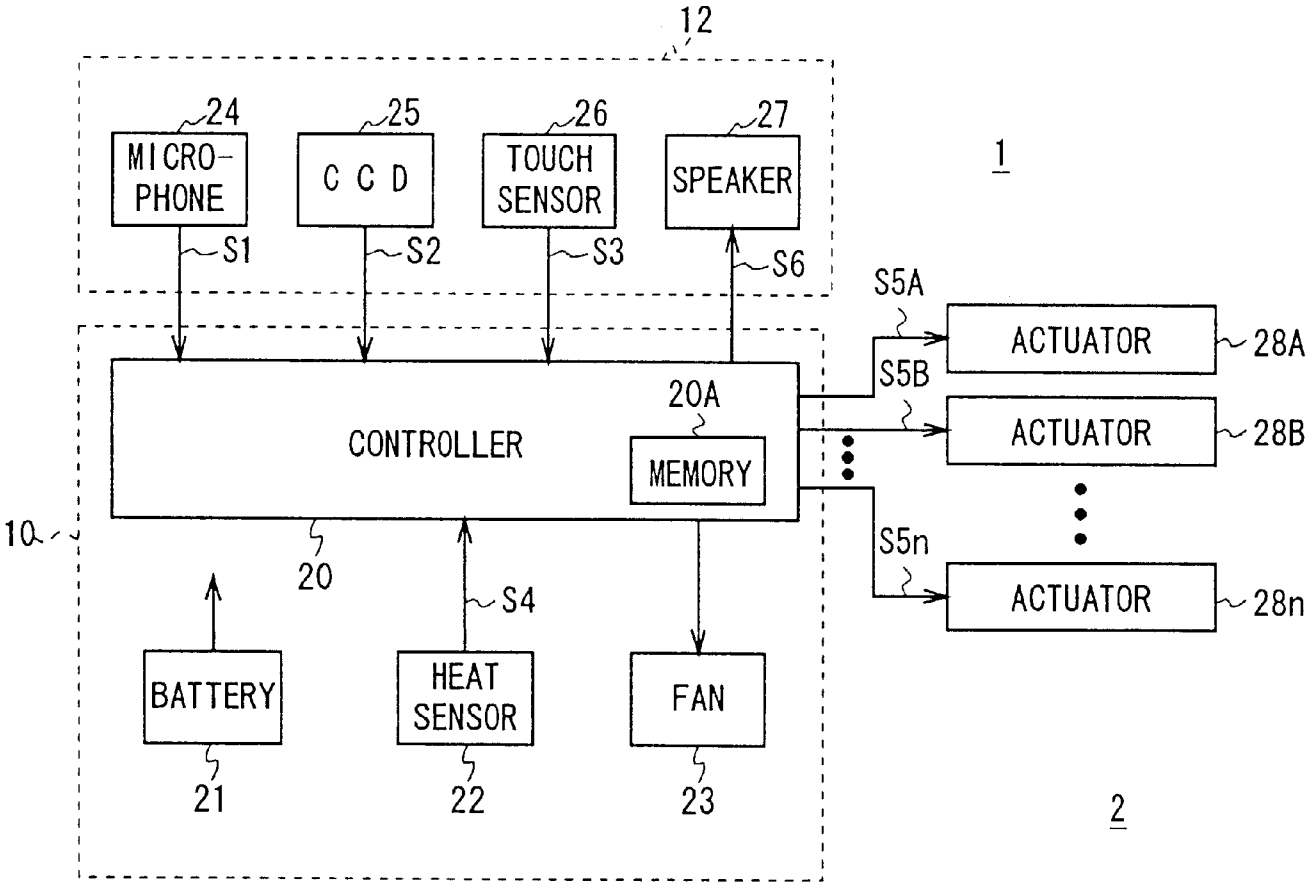
FIG. 2 is a block diagram showing an internal configuration of the pet robot in the first embodiment.

In this case, as shown in FIG. 2, the body member unit 10 contains a controller 20 which controls entire motions of the pet robot 2, a battery 21 which functions as a power source for the pet robot 2, a heat sensor 22, a cooling fan 23 which is disposed so as to be placed under a vent hole 10A (FIG. 1) formed in a top surface of the body member unit 10 and so on.

Further, disposed on the head member unit 10 at predetermined locations are a microphone 24 which is used as "ears" of the pet robot 2, a CCD (charge coupled device) camera 25 which is used as "eyes," a touch sensor 26, and a speaker 27 which is used as a "mouth" and so on.

Furthermore, actuators 28A through 28*n* which have degree og freedom are disposed in joints parts of the leg member units 11A through 11D, coupled parts of the leg member units 11A through 11D and the body member unit 10, a coupled part of head member unit 12 and the body member unit 10, a coupled part of the tail member unit 13 and the body member unit 10, and so on.

The microphone 24 on the head member unit 12 gathers order sounds such as "walk," "lie down" or "chase a ball" which are given in a form of musical scales from a user with a sound commander (not shown) and sends out the audio signal S1 thus obtained to the controller 20. Furthermore, the CCD camera 25 picks up a surrounding condition and sends out the image signal S2 thus obtained to the controller 20.

Furthermore, the touch sensor 26 which is disposed on a top of the head member unit 12 as apparent from FIG. 2 detects a pressure received from the user by a physical spurring such as "patting" or "striking" and sends out the detection result as a pressure detection signal S3 to the controller 20.

Furthermore, the heat sensor 22 on the body member unit 10 detects heat in the body member unit 10 and sends out a detection result as a heat detection signal S4 to the controller 20.

The controller 20 judges presence or absence of an order or physical spurring from the user, surrounding conditions and the like on the basis of the audio signal S1, the image signal S2, the pressure detection signal S3, the heat detection signal S4 and the like which are respectively given from the microphone 24, the CCD camera 25, the touch sensor 26, the heat sensor 22 and the like.

On the basis of the judgement result and a control program which is stored preliminarily in a memory 20A, the controller 20 determines a next action and sends out control signals S5A through S5*n* to required actuators 28A through 28*n* on the basis of the determination result to drive the actuators, thereby allowing the pet robot to take actions such as swinging of the head member unit 12 up, down, left and right, movement of a tail 13A of the tail member unit 13 and walking by driving the leg member units 11A through 11D.

At this time, the controller 20 gives a predetermined audio signal S6 to the speaker 27 as occasion demands to allow it to give sounds based on the above described audio signal S6 to outside, and turns on or off or flickers LEDs (light emitting diode) (not shown) disposed at locations of eyes of the pet robot 2.

Accordingly, the pet robot 2 is configured to be capable of autonomously acting dependently on presence or absence of an order and physical spurring from the user, and on the basis of the surrounding conditions, the control program and the like.

On the other hand, a cover unit 3 (FIG. 1) is made of material having predetermined hardness such as synthetic resin, and has internal form and size nearly the same as a form and a size of the top portion of the body member unit 10 of the pet robot 2.

Furthermore, formed in a front end of the cover unit 3 is a notch 3A so as to fit a neck at with which the body member unit 10 and the head member unit 12 of the pet robot 2 are coupled, and formed on the top of the cover unit 3 are a plurality of screw holes 3B so as to be placed at the same positions as a plurality of tapped holes 10B formed at predetermined locations of the body member unit 10 of the pet robot 2.

Accordingly, the robot system 1 is configured to allow the cover unit 3 to be fitted over the pet robot 2 in a fixed condition by fitting the cover unit 3 over the body member unit 10 of the pet robot 2 and tightening screws 4 into the tapped holes 10B of the body member unit 10 of the pet robot 10 through the screw holes 3B of the cover unit 3.

Furthermore, formed on the top of the cover unit 3 is a vent aperture 3C so as not to cover the vent hole 10A of the body member unit 10 of the pet robot 2 and formed around a lower end of the cover unit 3 are notches 3D so as to fit the joint portions of the leg member units 11A through 11D and of the tail 13A of the tail member unit 13 of the pet robot 2.

Accordingly, the robot system 1 is configured to be capable of allowing heat which is exhausted through the vent hole 10A of the body member unit 10 of the pet robot 2 to be exhausted outside through the vent aperture 3C of the cover unit 3 and preventing the cover unit 3 from interfering with the leg member units 11A through 11D and the tail 13A when the pet robot 2 moves the leg member units 11A through 11D and the tail 13A.

Figure 3:
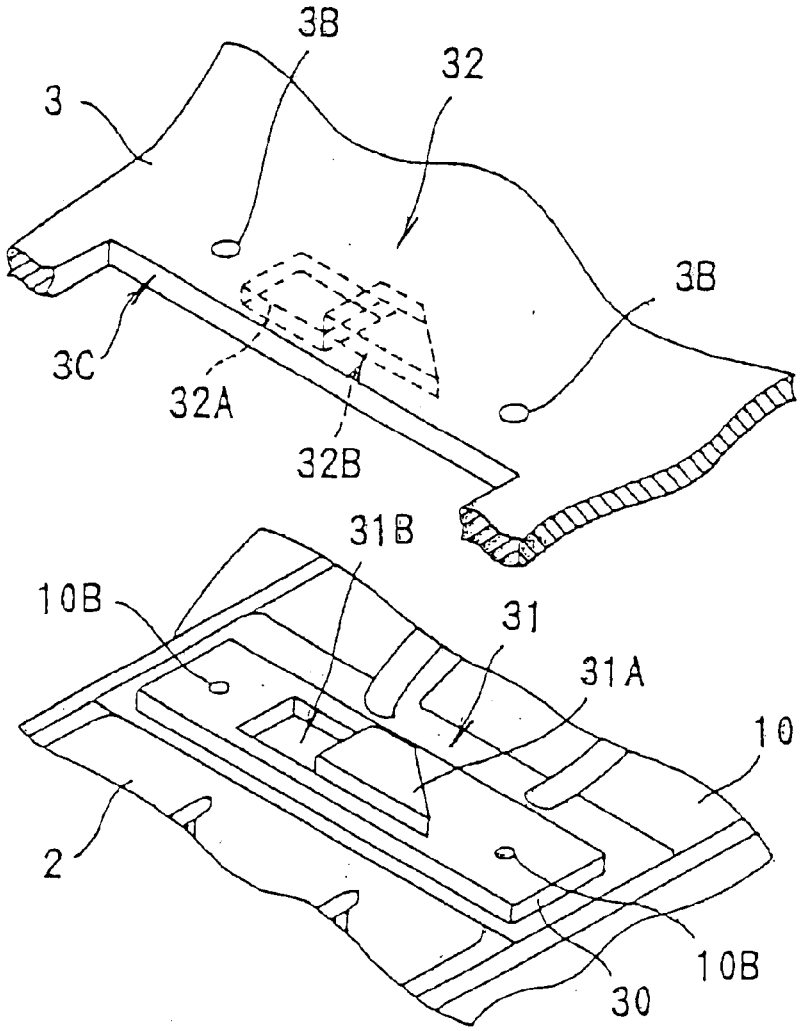
FIG. 3 is a schematic perspective view showing configurations of a robot side concavo-convex pattern and a cover side concavo-convex pattern.
Figure 4:
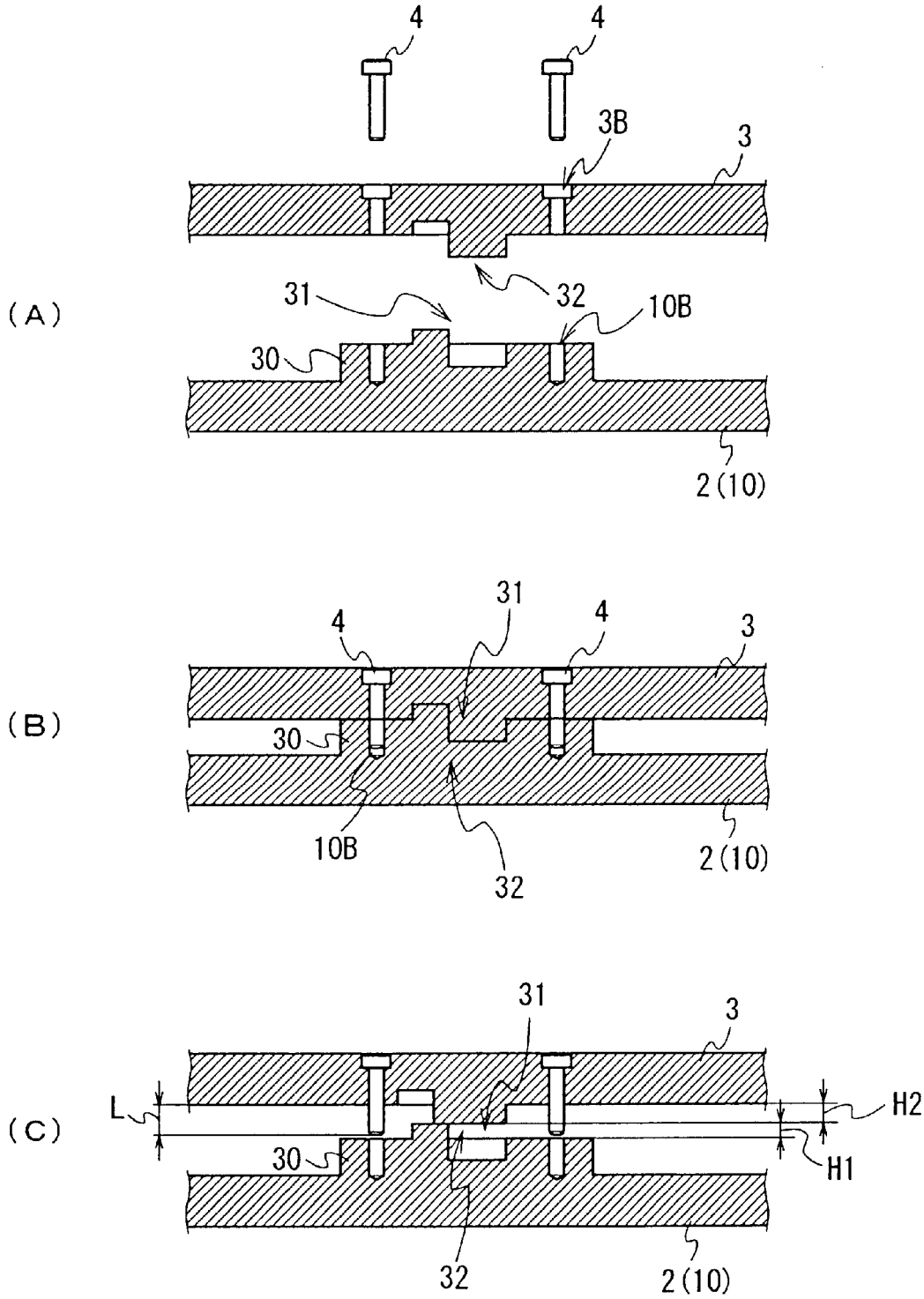
FIG. 4 is a sectional view descriptive of fitting between the robot side concavo-convex pattern and the cover side concavo-convex pattern.

In addition to the configuration described above, in this robot system 1, a concavo-convex pattern (hereinafter referred to as a robot side concavo-convex pattern) 31 having a predetermined form is formed on a base member 30 having a predetermined height at a predetermined location of the body member unit 10 of the pet robot 2, as shown in FIGS. 1, 3 and 4(A).

Furthermore, a concavo-convex pattern (hereinafter referred to as a cover side concavo-convex pattern) 32 which has an inverted form of the concavo-convex form of the robot side concavo-convex pattern 31 and consists of a concave portion 32B and a convex portion 32A to fit with a convex portion 31A and a concave portion 31B respectively of the robot side concavo-convex pattern 31 is formed on the cover unit 3 so as to fit the robot side concavo-convex pattern 31.

In case of this embodiment, the concavo-convex form of the cover side concavo-convex pattern 32 has been registered as an industrial design so that people without the license cannot utilize the concavo-convex form of the cover side concavo-convex pattern 32.

Accordingly, the robot system 1 is configured to fit the robot side concavo-convex pattern 31 with the cover side concavo-convex pattern 32 as shown in FIG. 4(B) and allows the cover unit 3 to be fitted correctly over the pet robot 2 at a stage to fit the cover unit 3 over the pet robot 2 when the cover unit 3 is a regular cover unit, and on the contrary, when the cover unit 3 is an irregular cover unit, the robot side concavo-convex pattern 31 is not fit with the cover side concavo-convex pattern 32, unlike FIG. 4(B) and as a result, the cover unit 3 can not correctly be fitted over the pet robot 2.

In case of this embodiment, the robot side concavo-convex pattern 31 is disposed at both sides of the vent hole 10A of the body member unit 10 of the pet robot 2 as shown in FIG. 1. In the body member unit 10 of the pet robot 2, the above described tapped holes 10B are formed in the vicinities of the robot side concavo-convex pattern 31 as pairs consisting of two tapped holes each laterally sandwiching the corresponding robot side concavo-convex pattern 31 as shown in FIG. 4(A).

Furthermore, the screws 4 which are used to fix the cover unit 3 to the pet robot 2 are selected so that a length L of a portion which is to be screwed into the body member unit 10 of the pet robot 2 is shorter than a sum of a height H1 of the convex portion 31A of the robot side concavo-convex pattern 31 and a height H2 of the convex portion 32A of the cover side concavo-convex pattern 32, as shown in FIG. 4(C).

Accordingly, the robot system 1 does not allow the screws 4 to be screwed into the tapped holes 10B of the pet robot 2 through the screw holes 3B of the cover unit 3 as shown in FIG. 4(C) when the cover unit 3 is an irregular cover unit, thereby making it impossible to fix the irregular cover unit 3 to the pet robot 2.

(1-2) Operation and Effect in this Embodiment

In the robot system 1 which has the above described configuration, the robot side concavo-convex pattern 31 is fitted with the cover side concavo-convex pattern 32 at a stage to fit the cover unit 3 over the pet robot 2 when the cover unit 3 is a regular cover unit, so that the above described cover unit 3 can be fitted correctly. On the contrary, when the cover unit 3 is an irregular cover unit, the robot side concavo-convex pattern 31 does not fit the cover side concavo-convex pattern 32, so that the above described cover unit 3 can not be fitted correctly.

Accordingly, the robot system 1 is capable of excluding irregular cover units 3 and providing a result to effectively prevent the pet robot 2 from being troubled due to the use of the irregular cover unit 3 when only those who manufacture the cover unit 3 in compliance with a standard for the pet robot 2 are permitted to use the cover side concavo-convex pattern 32.

The above described configuration is adapted to form the cover side concavo-convex pattern 32 having the predetermined form of the registered design on the cover unit 3 and the robot side concavo-convex pattern 31 having the inverted form of the concavo-convex form of the above described cover side concavo-convex pattern 32 on the pet robot 2 so as to fit the cover side concavo-convex pattern 32, thereby making it possible to realize a robot system which is capable of preventing the irregular cover unit 3 from being fitted over the pet robot 2 effectively and preventing the robot from being troubled by excluding irregular covers.

(1-3) Other Embodiments

Note that, in the aforementioned embodiment, the present invention is applied to the quadruped walking type pet robot 2 configured as shown in FIG. 1. The present invention, however, is not limited to this and applicable widely to other various kinds of robots such as toys and dolls (hereinafter, it is the same in the following second to sixth embodiments).

Figure 5:
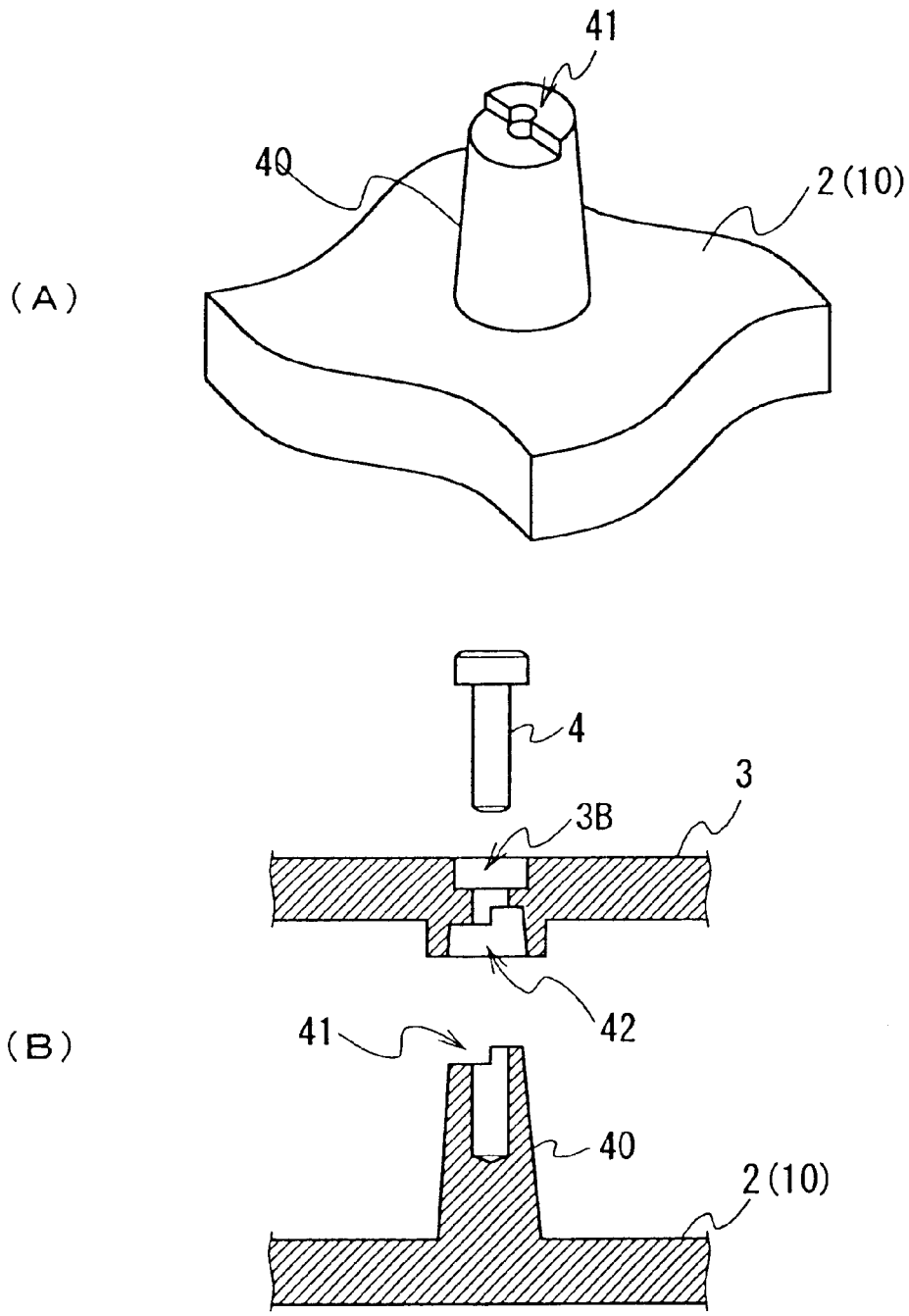
FIG. 5 is a perspective view and a sectional view showing another embodiment.

Further, though the robot side concavo-convex pattern 31 is formed in the base member 30 in the above described embodiment, the present invention is not limited to this and it is possible, for example, to dispose a boss 40 for fixing the cover unit 3 to the pet robot 2, to form a concavo-convex pattern 41 having a predetermined form on a top end surface of the boss 40 and to form a corresponding concavo-convex pattern 42 on the cover unit 3 so as to fit the concavo-convex pattern 41 as shown in FIGS. 5(A) and 5(B).

Further, though cubic patterns (the cover side concavo-convex pattern 32 and the robot side concavo-convex pattern 31) are formed as the authenticating pattern on the cover unit 3 and the authenticating means on the pet robot 2 in the above described embodiment, the present invention is not limited to this and it is possible, for example, to form a planar pattern (a pattern of a color or reflectance) on the cover unit 3 as an authenticating pattern and to dispose a CCD camera or the like on the pet robot 2 as the authenticating means so that the controller 20 (FIG. 2) of the pet robot 2 judges whether or not the cover unit 3 is irregular on the basis of the authenticating pattern of the cover unit 3 photographed by the CCD camera and makes the pet robot 2 inoperative when the cover unit 3 is irregular.

Furthermore, it is possible to form the authenticating pattern on the cover unit 3 using an electrically conductive material such as an electrically conductive paint and form an electrode on the pet robot 2 as the authenticating means so that the authenticating pattern on the cover unit 3 is detected electrically.

Figure 6:
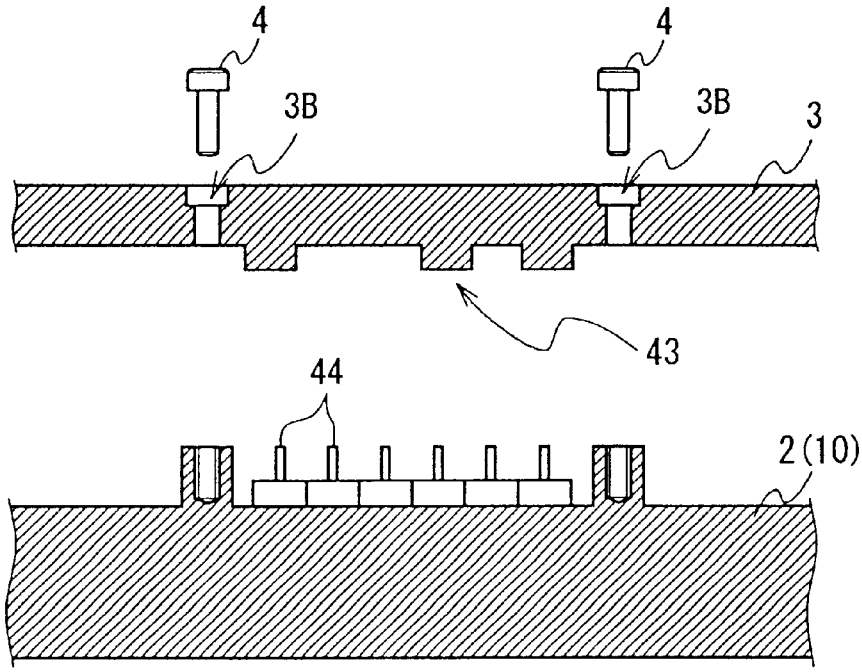
FIG. 6 is a sectional view showing another embodiment.

Furthermore, it is possible, for example, to form a predetermined concavo-convex pattern (ether linearly or two-dimensionally) 43 on the cover unit 3 as an authenticating pattern and arrange a plurality of touch sensors 44 (ether linearly or two-dimensionally) at corresponding locations of the pet robot 2 as shown in FIG. 6 so that the controller 20 of the pet robot 2 judges whether or not the cover unit 3 is irregular on the basis of which touch sensors 44 in the authenticating pattern (concavo-convex pattern 44) on the cover unit 3 are pressed and makes the pet robot 2 inoperative when the cover unit 3 is irregular.

Though the concavo-convex pattern having the form of the registered design (cover side concavo-convex pattern 32) is used as the authenticating pattern on the cover unit 3 in the above described embodiment, the present invention is not limited to this and forms other than the registered form can be used widely as the cover side concavo-convex pattern 32 so far as the forms can technically or legally restrict use of the concavo-convex pattern of the cover unit 3 only to specific persons.

Figure 7:
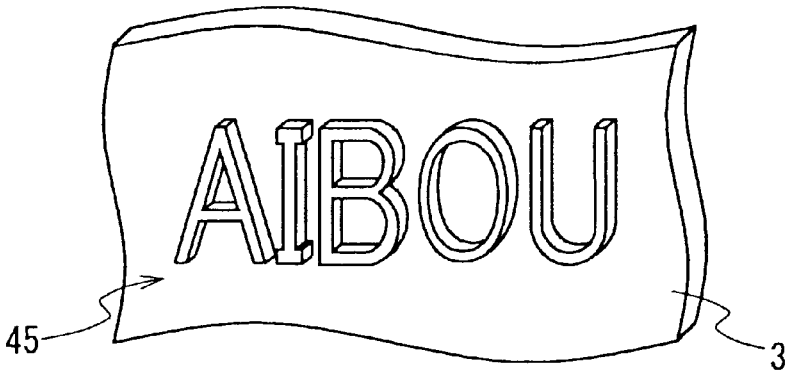
FIG. 7 is a perspective view showing another embodiment.

In this case, it is possible to use a concavo-convex pattern 45 which is formed by embossing characters of a registered trademark or the like as the authenticating pattern on the cover unit 3, for example, as shown in FIG. 7.

Furthermore, through the present invention uses the cover unit 3 which is made of synthetic resin having predetermined hardness and is formed as shown in FIG. 1, and the present invention is not limited to this and can use other kinds of materials as a material of the cover and also other different shapes for the cover can be applied so that impressions of the pet robot 2 can be changed preferably.

Figure 8:
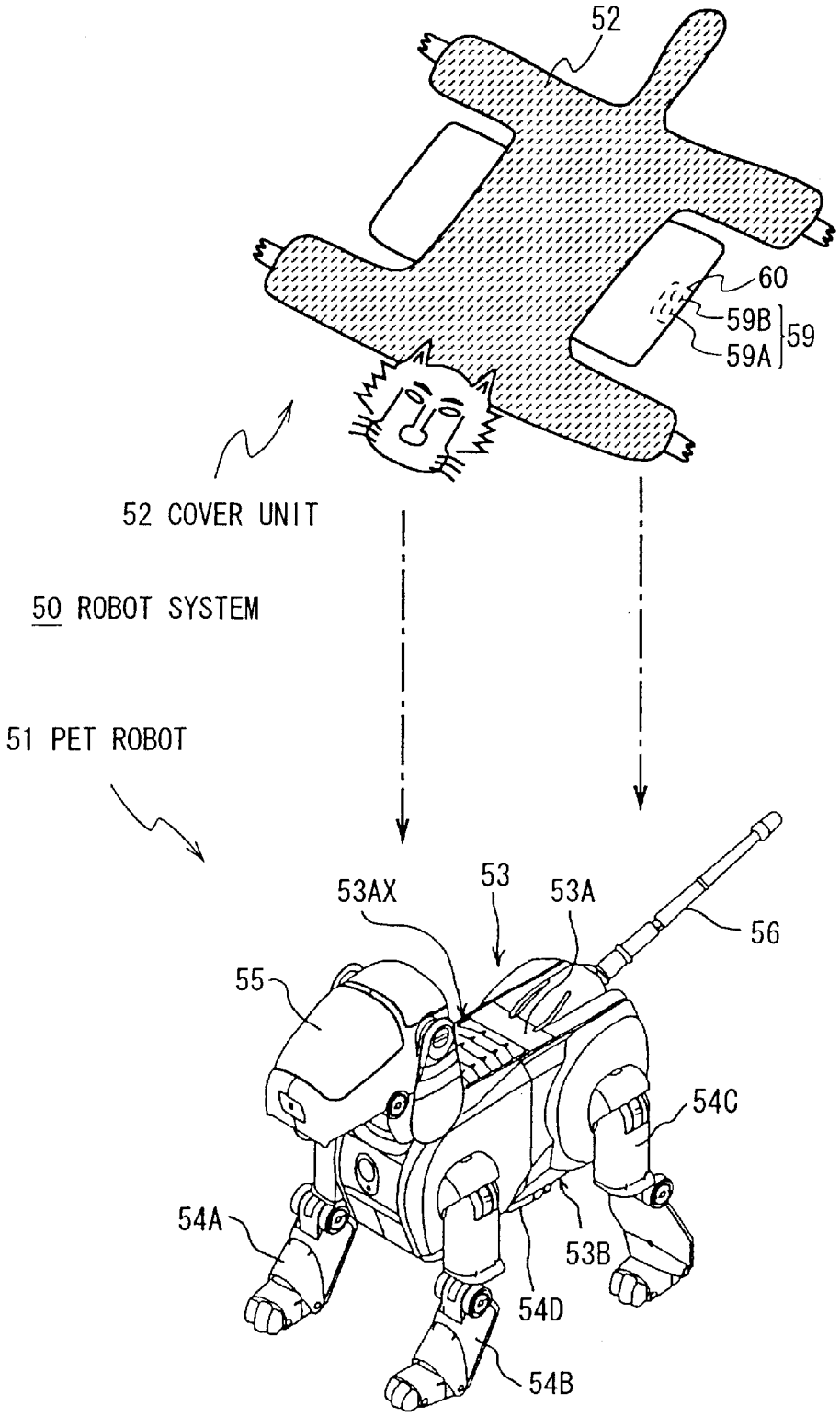
FIG. 8 is a schematic diagram showing a configuration of a pet robot system in a second embodiment.

(2) Second Embodiment (2-1) Configuration of Robot System 50 in this Embodiment FIG. 8 shows a robot system 50 according to a second embodiment, and a predetermined cover part (hereinafter, referred to as a cover unit) 52 can cover a whole surface of a pet robot 51 by detachably being fit over the pet robot 51.

The pet robot 51 is actually composed by coupling leg member units 54A through 54D with front right, front left, rear right, rear left portions of a body member unit 53, and connecting a head member unit 55 and a tail member unit 56 to a front end and a rear end of the body member unit 53 respectively.

A cooling fan (not shown) is disposed in the body member unit 53, and an air exhaust port 53AX and an air suction port 53BX (FIG. 9) are formed on a top surface 53A and a bottom surface 53B for the cooling fan. Accordingly, the pet robot 51 is configured to be capable of lowering an internal temperature of the body member unit 53 by exhausting air, which has been sucked with the air suction port 53BX, through the body member unit 53 from the air exhaust port 53AX to outside while the cooling fan is driven.

Figure 9:
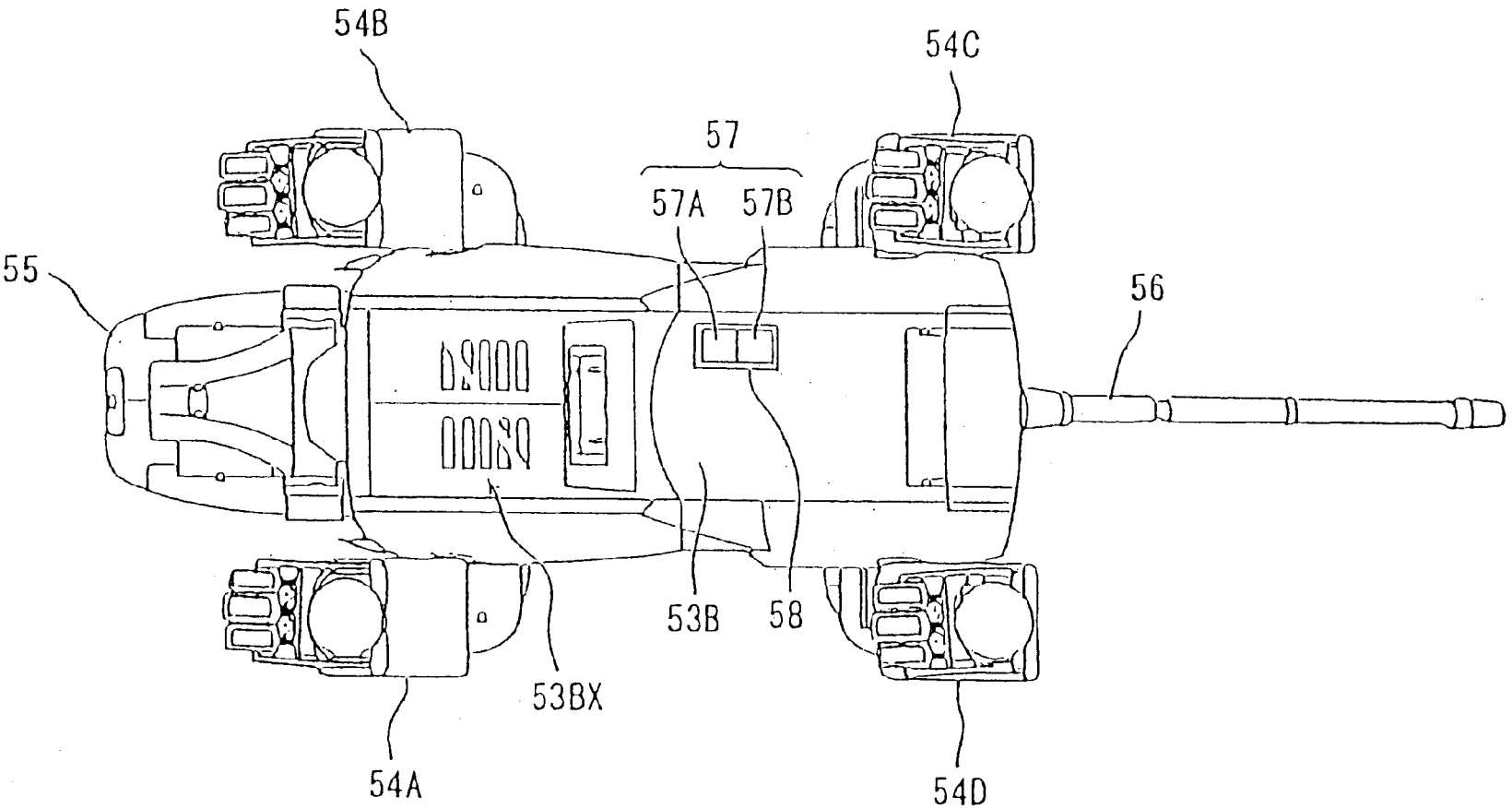
FIG. 9 is a schematic diagram showing a configuration of the pet robot shown in FIG. 8.

Furthermore, disposed on a bottom surface 53B of the body member unit 53 is an interface member (hereinafter referred to as a main body side interface member) 58 on which a connector part 57 is composed of a connector half 57A and an engaging mechanism part 57B as shown in FIG. 9.

On the other hand, as shown in FIG. 8, the cover unit 52 is formed by a cover main body 52A which has the same shape as a real dog and is made of synthetic fibers. And disposed at a predetermined location on the back surface of the cover main body 52A is an interface member (hereinafter referred to as a cover side interface member) 60 on which a connector part 59 is composed of a connector half 59A and an engaging mechanism part 59B which are to be connected to the connector half 57A and the engaging mechanism part 57B of the main body side interface member 58 disposed on the body member unit 53.

To fit the cover unit 52 actually over the pet robot 2, the cover main body 52A of the cover unit 52 is fitted so as to cover a whole surface of the pet robot 2, and then by connecting the connector part 59 of the cover side interface member 50 to the connector part 57 of the main body side interface member 58, the connector halves 57A and 59A are electrically connected to each other and the engaging mechanism parts 57B and 59B are connected mechanically.

(2-2) Internal Configuration of Pet Robot System

Figure 10:
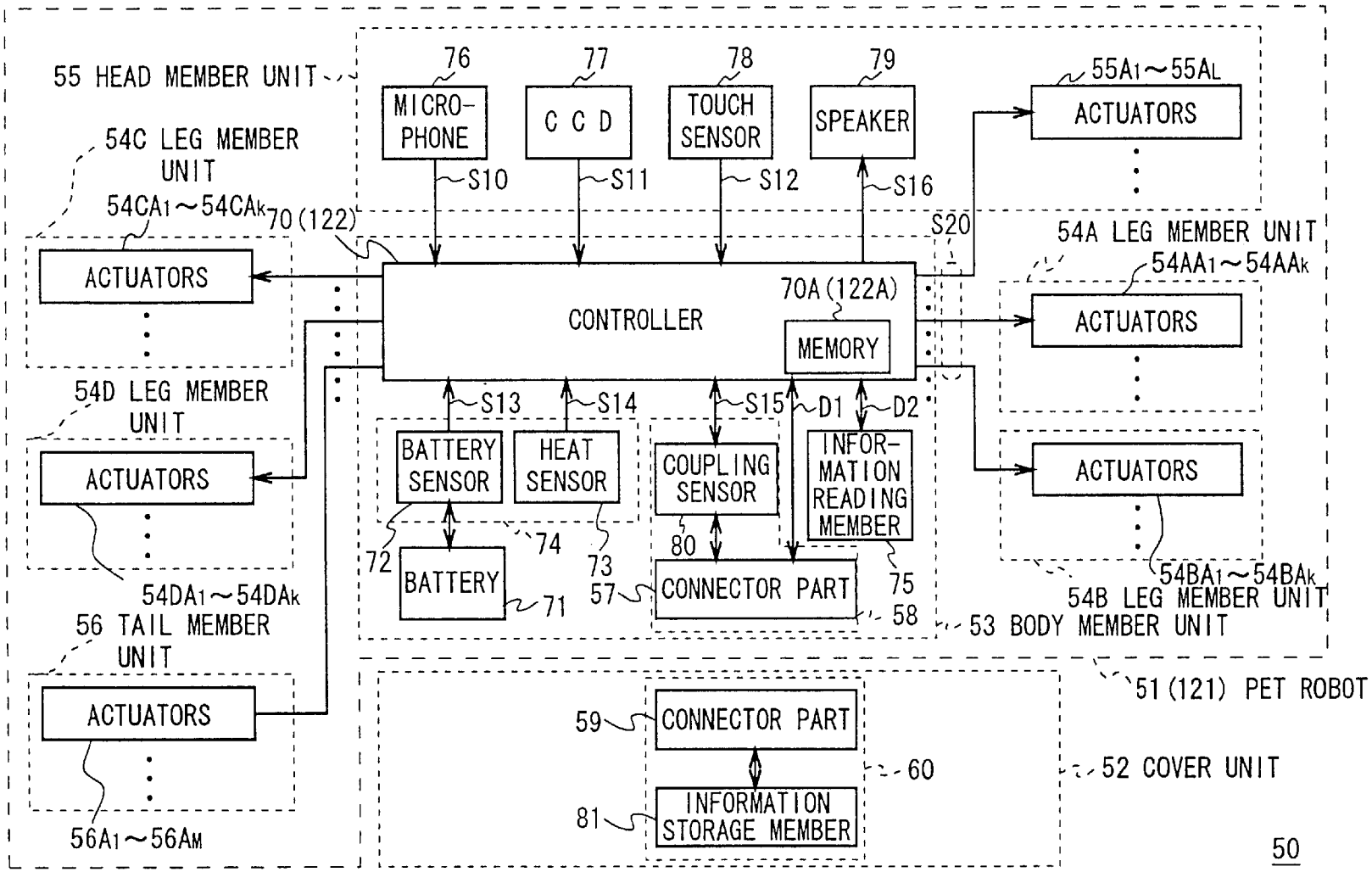
FIG. 10 is a block diagram showing an internal configuration of the pet robot.

In the robot system 50 shown in FIG. 10, accommodated in the body member unit 53 of the pet robot 51 are a controller 70 which controls entire motions of the pet robot 51, a battery 71 which functions as a driving power source of the pet robot 51, an internal sensor member 74 which consists of a battery sensor 72 and a heat sensor 73, the main body side interface member 58 which consists of a coupling sensor 80 and the connector part 57, and an information reading member 75 which reads out a control program stored in a recording medium (not shown) which is inserted from outside.

Disposed at predetermined locations in a head member unit 55 are a microphone 76 which is used as "ears", a CCD (charge coupled device) camera 77 which is used as "eyes", a touch sensor 78, a speaker 79 which is used as a "mouth" and so on.

Furthermore, actuators 54$AA_1$ to 54$AA_K$, 54$BA_1$ to 54$BA_K$, 54$CA_1$ to 54$CA_K$, 54$DA_1$ to 54$DA_K$, 55$A_1$ to 55$A_L$ and 56$A_1$ to 56$A_M$ are disposed in joint parts of leg member units 54A to 54D, coupling parts of the leg member units 54A to 54D and the body member unit 53, a coupling part of the head member unit 55 and the body member unit 53, a coupling part of a tail member unit 56 and the body member unit 53, etc.

The microphone 76 of the head member unit 55 gathers order sounds such as "walk," "lie down" and "chase a ball" which are given in form of musical scales from a user with a sound commander (a commander which gives sounds in form of musical scales different dependently on operation contents) which is not shown and sends out an obtained audio signal S10 to the controller 70. The CCD camera 77 picks up an image of surrounding conditions and sends out an obtained image signal S11 to the controller 70.

Furthermore, the touch sensor 78 is disposed on the top of the head member unit 55 as apparent from FIG. 8, and detects pressures applied from the user by physical spurring such as "patting" and "striking," and sends out a detection result as a pressure detection signal S12 to the controller 70.

Furthermore, the battery sensor 72 of the body member unit 53 detects a residual amount of the battery 71 at a plurality of steps and sends out a detection result at each step as a battery residual amount detection signal S13 consecutively to the controller 70.

Furthermore, the heat sensor 73 of the body member unit 53 detects an internal temperature of the pet robot 51 and sends out a detection result as a heat detection signal S14 to the controller 70.

Furthermore, the main body side interface member 58 of the body member unit 53 is composed of the coupling sensor 80 and the above described connector part 57 which is composed of the connector half 57A and the engaging mechanism part 57B. The coupling sensor 80 detects coupling conditions of the cover unit 52 with the cover side interface member 60 and sends out a detection result as a cover detection signal S15 to the controller 70.

On the basis of the audio signal S10, the image signal S11, the pressure detection signal S12, the battery residual amount detection signal S13, the heat detection signal S14 and the cover detection signal S15 and the like which are given from the microphone 76, the CCD camera 77, the touch sensor 78, the battery sensor 72, the heat sensor 73 and the coupling sensor 80, the controller 70 judges surrounding conditions and whether or not the user made an order, spurring and the like.

On the basis of a judgment result and the control program which has been input, the controller 70 determines a next action, and allows the pet robot to take actions such as swinging the head member unit 55 up, down, left and right, moving the tail member unit 56, walking with the leg member units 54A through 54D by driving actuators 54$AA_1$ to 54$AA_K$, 54$BA_1$ to 54$BA_K$, 54$CA_1$ to $^{54CA}{}_K$, 54$DA_1$ to 54$DA_K$, 55$A_1$ to 55$A_L$ and 56$A_1$ to 56$A_M$ which are required from the determination result.

At this time, the controller 70 gives a predetermined audio signal S16 to the speaker 79 as occasion demands, thereby allowing the speaker to output sounds to outside on the basis of the above described audio signal S16, and turns on or off or flickers LEDs (light emitting diode) which are not shown and disposed at locations of "eyes" of the pet robot 51.

The pet robot 51 is capable of acting autonomously on the basis of surrounding conditions and the control programs, as described above.

In the cover unit 52, on the other hand, the cover side interface member 60 which is built in a cover main body 52A comprises an information storage member 81 and the above described connector part 59, and the above mentioned connector part 59 is composed of the connector half 59A and the engaging mechanism part 59B. The engaging mechanism part 59B in the cover side interface member 60 is configured so as to be fitted detachably to the engaging mechanism part 57B in the main body side interface member 58.

The information storage member 81 in the cover side interface member 60 comprises, for example, a non-volatile memory such as a ROM (random access memory) which preliminarily stores information representing a manufacturer ID, information representing a manufacturing license such as a product ID, a lot number and the like determined by the manufacturer, and enciphered information for authenticating a cover unit and so on (hereinafter referred to as cover setting information D1), for each cover number allocated to a type of the cover unit 52.

Furthermore, preliminarily stored in the recording medium to be inserted into the information reading member 75 disposed in the body member unit 53 is program information (hereinafter referred to as performance information) D2 for determining performances of the pet robot 51 according to the contents of the cover setting information D1 for the above described each cover number.

When the cover side interface member 60 is coupled with the main body side interface member 58, the connector half 59A and the engaging mechanism part 59B disposed on the connector part 59 of the above described cover side interface member 60 are connected electrically and mechanically to the corresponding connector half 57A and engaging mechanism part 57B disposed on the connector part 57 of the main body side interface member 58.

Figure 11:
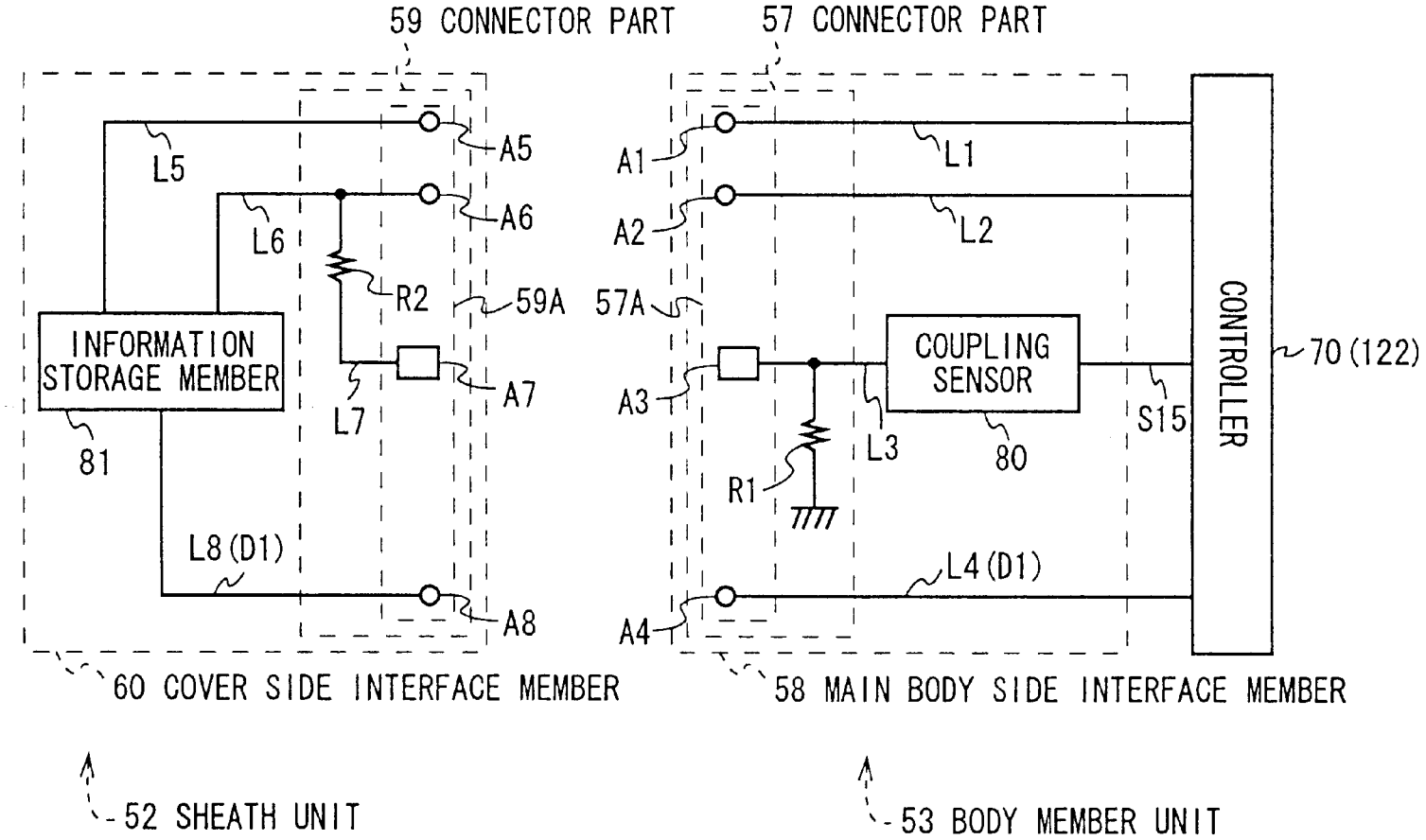
FIG. 11 is a block diagram showing internal configurations of a main body side interface member and a cover side interface member.

Concretely speaking, the main body side interface member 58 and the cover side interface member 60 are configured as shown in FIG. 11.

In the main body side interface member 58, connecting terminals A1 to A4 for a grounding line L1, a power source line L2, a measurement line L3 and a signal line L4 are exposed on the connector half 57A of the connector part 57, and an end of a load resistor R1 which has the other end connected to ground is connected between the connecting terminal A3 and the coupling sensor 80 on the measurement line L3.

In the cover side interface member 60, connecting terminals A5 to A8 for a ground line L5, a power source line L6, a measurement line L7 and a signal line L8 are exposed on the connector part 59, a load resistor R2 is disposed on the measurement line L7 which is drawn from the power source line L6, and ends of the above described load resistor R2 are connected to the information storage member 81 and the connecting terminal A7.

When the connector half 59A disposed on the connector part 59 of the cover side interface member 60 is actually connected to the connector half 57A disposed on the connector part 57 of the main body side interface member 58, the connecting terminals A1 to A4 for the ground line L1, the power source line L2, the measurement line L3 and the signal line L4 on the connector half 57A are brought into contact with and conductive to the corresponding connecting terminals A5 to A8 for the lines L5 to L8 on the connector half 59A.

At this time, the coupling sensor 80 in the main body side interface member 58 detects a voltage value of the load resistor R2 on the measurement line L7 connected to the power source line L6 in a condition where the connector halves 59A and 57A conductive to each other, between the cover side interface member 60 and the main body side interface member 58, thereby judging a coupling condition of the main body side interface member 58 with the cover side interface member 60 (an "H" level in a coupling condition or an "L" level in a separated condition).

As a result, the controller 70 reads out the cover setting information D1 stored in the information storage member 81 in the cover side interface member 60 only when the coupling sensor 80 obtains an affirmative result, reads out the performance information D2 from the recording medium inserted into the information reading member 75 in the body member unit 53 on the basis of the above described cover setting information D1 and determines an action of the pet robot 51 on the basis of the performance information D2, thereby driving the actuators 54$AA_1$ to 56$A_M$ which are required for the determined action and allowing the speaker 79 to output sounds as occasion demands.

When the cover unit 52 is fitted, the pet robot 51 is capable of autonomously changing actions with the individuality according to the cover setting information D1 stored in the information storage member 81 in the cover side interface member 60 of the above described cover unit 52 and the performance information D2 read out from the recording medium inserted into the information reading member 75 in the body member unit 53 on the basis of the above described cover setting information D1.

(2-3) Manifestation of Actions Dependent on Emotions and Instincts of Pet Robot 51

The pet robot 51 is configured not only to autonomously act in accordance with the surrounding conditions, the control program and the like, but also to change actions as if it were a real animal which has natural "emotions and instincts."

That is, the pet robot 51 has three "emotion expressions" of "joy," "sadness" and "anger" as well as three "instinct expressions" of "appetite," "curiosity" and "desire for movement." Preliminarily stored in a memory of the controller 70 are action and motion models consisting of various kinds of control parameters and control programs as bases of actions and motions related to four items of "walking condition," "motion," "action" and "sound" for each "emotion expression" and each "instinct expression."

Now, description will be made of processing performed by the controller 70 to generate the actions of the pet robot 51.

Figure 12:
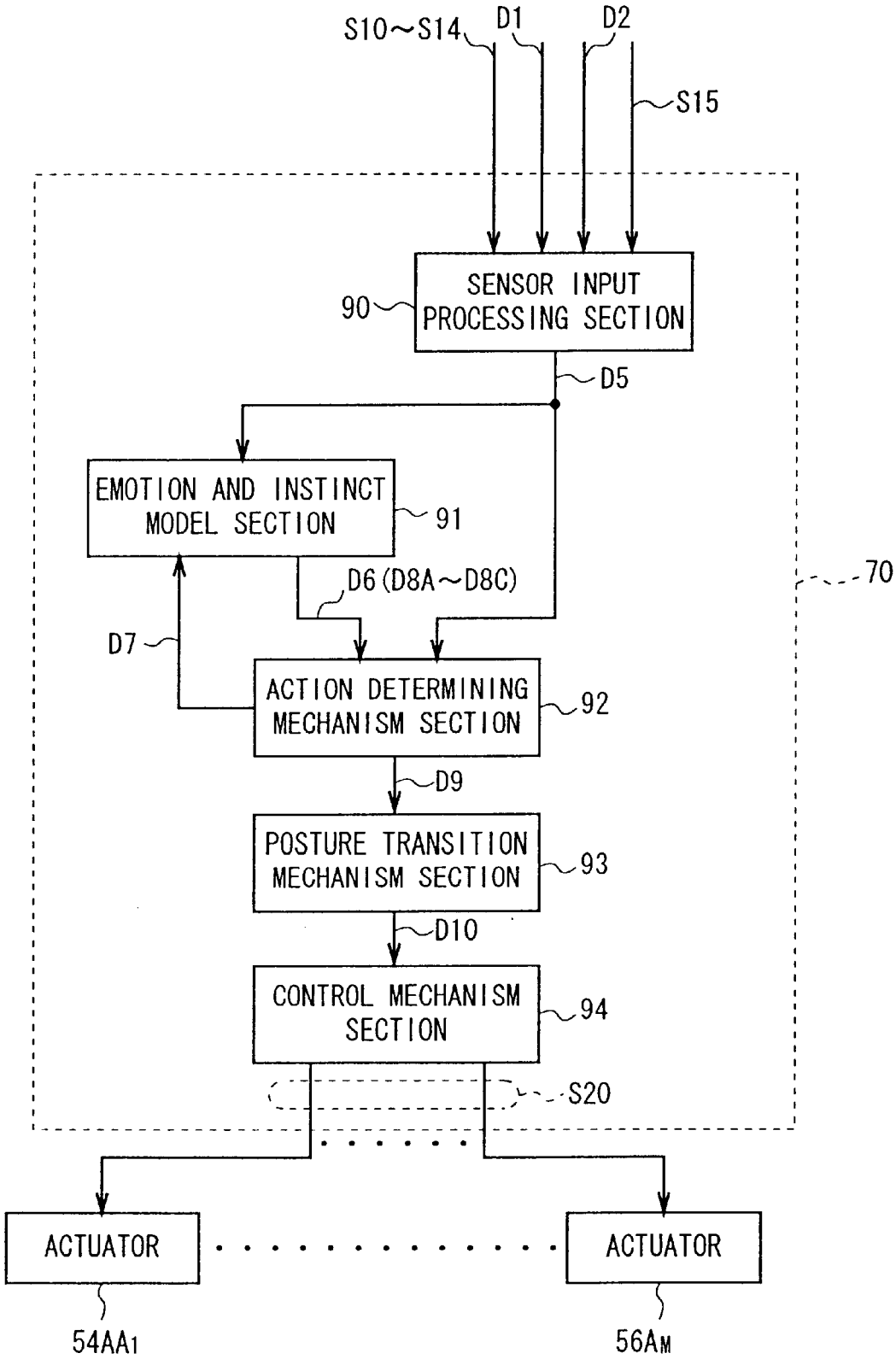
FIG. 12 is a schematic diagram descriptive of processing by a controller in the second embodiment.

As shown in FIG. 12, functions of the controller 70 for processing to generate actions of the pet robot 51 can be classified into a sensor input processing section 90 which recognizes a specific external condition, a emotion and instinct model section 91 which expresses conditions of the emotions and instincts by accumulating recognition results of the above described sensor input processing section 90, an action determining mechanism section 92 which determines a succeeding action on the basis of the recognition results of the above described sensor input processing section 90, a posture transition mechanism section 93 which allows the pet robot 51 to actually manifest actions on the basis of the determination result of the above described action determining mechanism section 92 and an expression result of the emotion and instinct model section 91, and a control mechanism section 94 which drives and controls the actuators 54$AA_1$ to 56$A_M$.

In this case, the sensor input processing section 90 recognizes the specific conditions on the-basis of the audio signal S10, the image signal S11, the pressure detection signal S12, the battery residual amount detection signal S13, and the heat detection signal S14 which are respectively supplied from the microphone 76, the CDD camera 77, the touch sensor 78, the battery sensor 72, and the heat sensor 73, and sends out the recognition result as a condition recognition information D5 to the emotion and instinct model section 91 and the action determining mechanism section 92.

Concretely, the sensor input processing section 90 always checks the audio signal S10 which is given from the microphone 76, and when detecting spectrums of which musical scales are the same as an order sounds which are output as spectrums of the audio signal S10 from the sound commander in accordance with an order such as "walk," "lie down," and "chase a ball", it recognizes that the order was given informs the emotion and instinct model section 91 and action determining mechanism section 92 of the recognition result as the condition recognition information D5.

Further, the sensor input processing section 90 always checks image signals S11 which are given from the CCD camera 77, and when detecting from an image based on the image signal S11, for example, "something red" or "a flat surface which is vertical to the ground and is higher than a predetermined height", it recognizes that "there is a ball" or "there is a wall" and informs the emotion and instinct model section 91 and the action determining mechanism section 92 of the recognition result as the condition recognition information D5.

In addition, the sensor input processing section 90 always checks pressure detection signals S12 which are given from the touch sensor, and when detecting on the basis of the pressure detection signal S12, pressure which has a threshold not lower than a predetermined value and is given for a short time (for example, less than two seconds), recognizes that it was struck (scolded), and on the contrary when detecting pressure which has a threshold not higher than a predetermined value and is given for a long time (for example, more than two seconds), recognizes that it was patted (praised) Then, the sensor input processing section 90 informs the emotion and instinct model section 91 and the action determining mechanism section 92 of the recognition result as the condition recognition information D5.

Furthermore, the sensor input processing section 90 always checks the battery residual amount detection signals S13 which are given from the battery sensor 72, and when recognizing that the amount of energy in the battery 11 is getting low, it informs the emotion and instinct model section 91 and the action determining mechanism section 92 of the recognition result as the condition recognition information D5.

Furthermore, the sensor input processing section 90 always checks the heat detection signals S14 which are given from the heat sensor 73, and when recognizing that the temperature inside the pet robot 51 is higher than a predetermined temperature, it informs the emotion and instinct model section 91 and the action determining mechanism section 92 of the recognition result as the condition recognition information D5.

Furthermore, the sensor input processing section 90 recognizes the presence or absence of the cover unit 52 and the various setting information set in the cover unit 52 on the basis of the cover detection signal S15 which is given from the coupling sensor 80 in the main body side interface member 58, the cover setting information D1 read out from the information storage member 81 in the cover side interface member 60, and the performance information D2 read out with the information reading member 75 in the body member unit 53, and informs the emotion and instinct model section 91 and the action determining mechanism section 92 of the recognition result as the condition recognition information D5.

Figure 13:
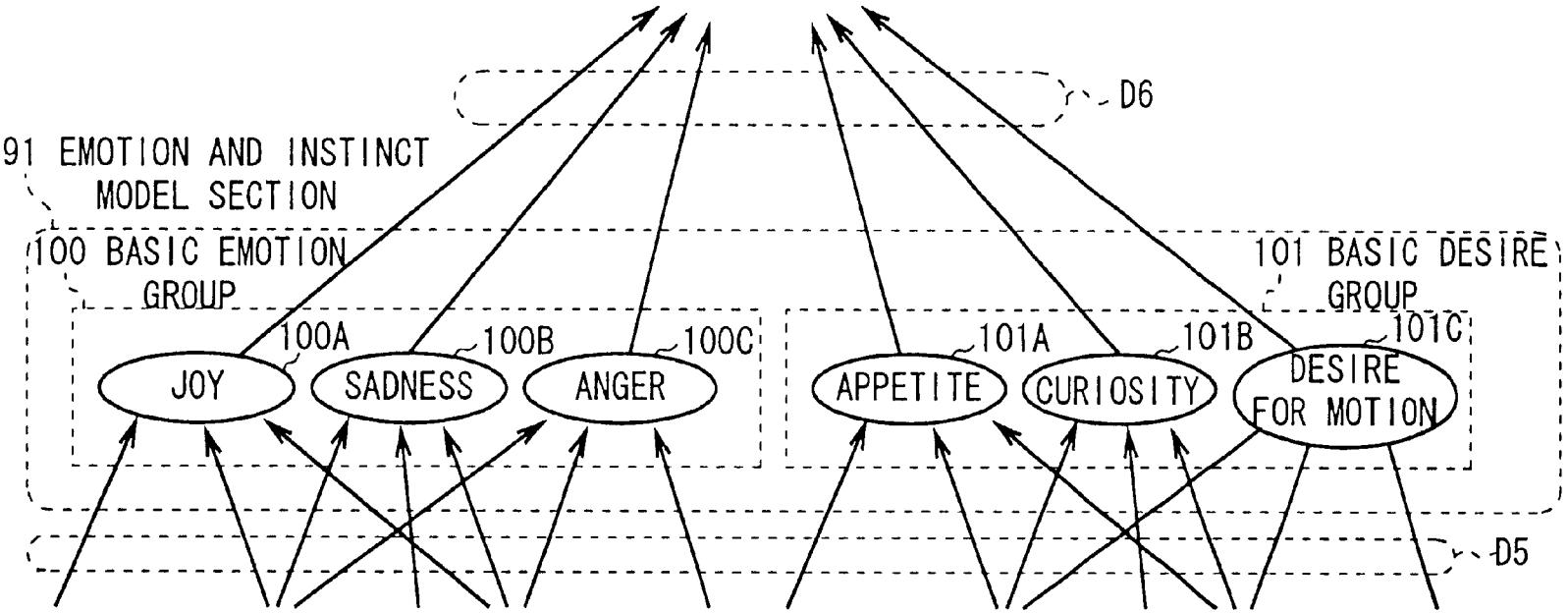
FIG. 13 is a schematic diagram descriptive of data processing by a emotion and instinct model section.

The emotion and instinct model section 91 has control parameters for a basic emotion group 100 consisting of emotion units 100A to 100C adopted as a plurality of independent emotion models and a basic desire group 51 consisting of desire units 101A to 101C adopted as a plurality of independent desire models in the memory 70A of the controller 70 as shown in FIG. 13. In the basic emotion group 100, the emotion unit 100A expresses an emotion of "joy," the emotion unit 100B expresses an emotion of "sadness" and the emotion unit 100C expresses an emotion of "anger."

The emotion units 100A to 100C represent intensities of the emotions, for example, by 0 to 100 levels and change the intensities of the emotions from time to time on the basis of the condition recognition information D5 which is supplied. Accordingly, the emotion and instinct model section 91 expresses the emotions of the pet robot 51 by combining the intensities of the emotion units 100A to 100C which are changed from time to time, thereby modeling changes of the emotions with time.

In the basic desire group 101, the desire unit 101A expresses a desire of "appetite," the desire unit 101B expresses a desire of "curiosity" and the desire unit 101C expresses a desire of "desire for motion."

Similar to the emotion units 100A to 100C, the desire units 101A to 51D represents the intensities of the desires, for example, by 0 to 100 levels and change the intensities of the desires from time to time on the basis of the condition recognition information D5 which is supplied. Accordingly, the emotion and instinct model section 91 expresses conditions of the instincts of the pet robot 51 by combining the intensities of the desire units 101A to 101C which are changed from time to time, thereby modeling changes of the instincts with time.

In this way, the emotion and instinct model section 91 changes the intensities of the emotion units 100A to 100C and the desire units 101A to 101C respectively on the basis of the condition recognition information D5. The emotion and instinct model section 91 determines the emotions by accumulatively combining the changed intensities of the emotion units 100A to 100C, determines conditions of the instincts by accumulatively combining the changed intensities of the desire units 101A to 101C, and sends out the determined conditions of the emotions and the instincts to the action determining section 92 as the emotion and instinct condition information D6.

By the way, when the emotion units 100A to 100C desired out of the basic emotion group 100 are combined so as to restrain or stimulate each other and an intensity of one of the combined emotion units 100A to 100C is changed, an intensity of the other emotion unit is changed correspondingly, whereby the emotion and instinct model section 91 realizes a pet robot with natural emotions and instincts.

Figure 14:
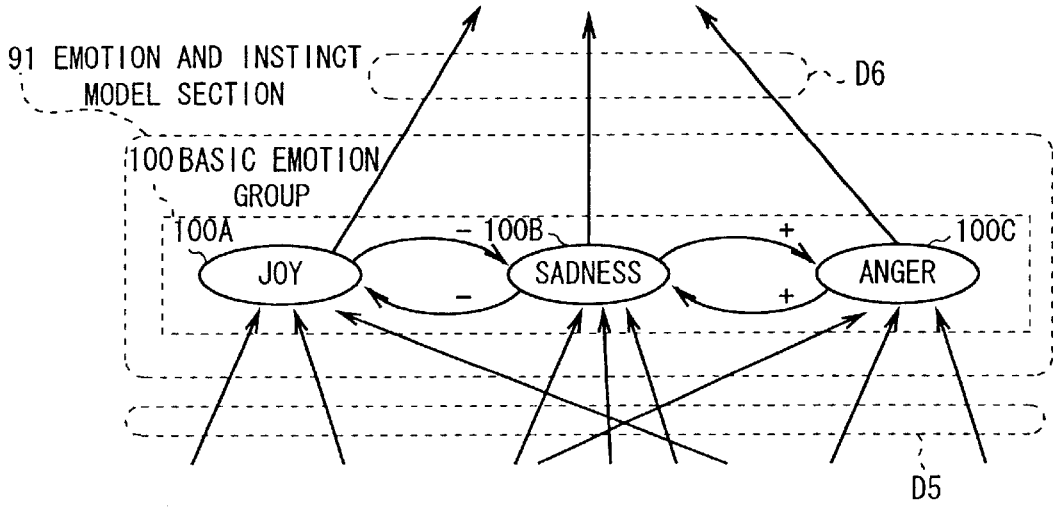
FIG. 14 is a schematic diagram descriptive of data processing by the emotion and instinct model section.

When the "joy" emotion unit 101A is combined with the "anger" emotion unit 100B so as to restrain each other as shown in FIG. 14, the emotion and instinct model section 91 enhances an intensity of the "joy" emotion unit 100A when the pet robot is praised by the user and naturally lowers an intensity of the "anger" emotion unit 100B as the intensity of the "joy" emotion unit 100A is enhanced even when the condition recognition information D5 which changes the intensity of the "anger" emotion unit 100B is not supplied. Similarly, when an intensity of the "anger" emotion unit 100B is enhanced, the emotion and instinct model section 91 lowers an intensity of the "joy" emotion unit 100A naturally as the intensity of the "anger" emotion unit 100B is enhanced.

By combining the "sadness" emotion unit 100B with the "anger" emotion unit 100C so as to stimulate each other, the emotion instinct model section 91 enhances an intensity of the "anger" emotion unit 100C when the pet robot is struck by the user and naturally enhances an intensity of the "sadness" emotion unit 100B as the intensity of the "anger" emotion unit 100C is enhanced even when the condition recognition information D5 which changes the intensity of the "sadness" emotion unit 100B is not supplied. Similarly, when an intensity of the "sadness" emotion unit 100B is enhanced, the emotion and instinct model section 91 enhances an intensity of the "anger" emotion unit 31C naturally as the intensity of the "sadness" emotion unit 100B is enhanced.

When the desire units 101A to 101C desired out of the basic desire units 101 are combined so as to restrain or stimulate each other as in the case-where the emotion units 100A to 100C are combined and an intensity of one of the combined desire units 101A to 101C is changed, an intensity of the other desire unit is also changed correspondingly, whereby the emotion and instinct model section 91 realizes the pet robot 51 with natural instincts.

Figure 15:
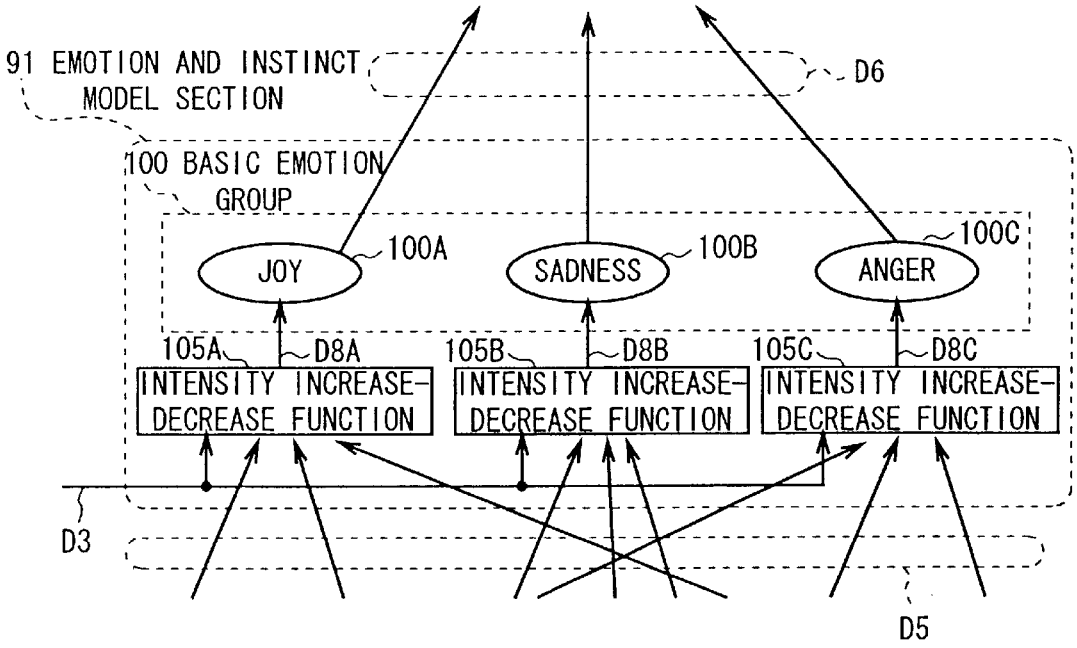
FIG. 15 is a schematic diagram descriptive of data processing by the emotion and instinct model section.

In FIG. 15, action information D7 having contents of a current action or a past action of the pet robot 51 itself, for example, "having walked for a long time" is supplied to the emotion and instinct model section 91 from an action determining mechanism member 92 disposed at a later stage, and even when an identical condition recognition information D5 is given, the emotion and instinct model section 91 generates the different emotion and instinct condition information D6 in accordance with the action of the pet robot 51 represented by the above described action information D7.

Concretely speaking, as shown in FIG. 15, intensity increase-decrease functions 105A to 105C which generate intensity information D8A to D8C for enhancing and lowering intensities of the emotion units 100A to 100C on the basis of the action information D7 representing actions of the pet robot 51 and the condition recognition information D5 are disposed at stages preceding to the emotion units 100A to 100C so that the emotion and instinct model section 91 enhances and lowers the intensities of the emotion units 101A to 100C dependently on the intensity information D8A to D8C which is output from the intensity increase-decrease functions 105A to 105C.

The emotion and instinct model section 91 enhances an intensity of the "joy" emotion unit 10A, for example, when the pet robot salutes the user and is patted, that is, when the action information D7 representing salutation to the user and the condition recognition information D5 representing the patting on the head are given to the intensity increase-decrease function 105A, whereas the emotion and instinct model section 91 does not change an intensity of the "joy" emotion unit 100A even when the pet robot is patted during doing a task, that is, even when the action information D7 representing the middle of the task and the condition recognition information D5 representing the patting are given to the intensity increase-decrease function 105.

As described above, the emotion and instinct model section 91 determines intensities of the emotion units 100A to 100C while referring not only to the condition recognition information D5 but also to the action information D7 representing the current or past action of the pet robot 51, thereby being capable of avoiding arising of an unnatural instinct, for example, the enhancing of an intensity of the "joy" emotion unit 100A, for example, when the pet robot is patted on the head simply for fun during doing a task.

By the way, as to the desire units 101A to 101C, the emotion and instinct model section 91 also enhances and lowers intensities of the desire units 101A to 101C on the basis of the condition recognition information D5 and the action information D7 which are supplied.

As described above, the intensity increase-decrease functions 105A to 105C are functions which generate and output the intensity information D8A to D8C in accordance with the parameters set in advance when the condition recognition information D5 and the action information D7 are input, thereby being capable of letting the pet robots 51 have individualities, for example, a pet robot 51 liable to be angry and a pet robot 51 having a joyful character by setting the above mentioned parameters at different values for the individual pet robots 51.

In FIG. 12, the action determining mechanism section 92 determines a next motion on the basis of the condition recognition information D5 and the emotion and instinct condition information D6, and sends out the contents of a determined motion to the posture transition mechanism section 93 as action command information D9.

Figure 16:
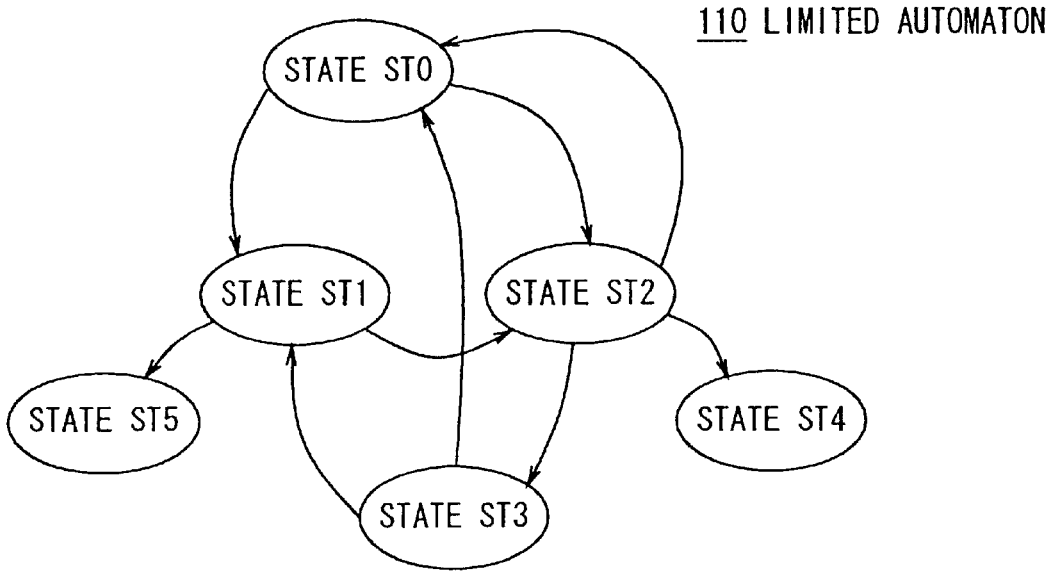
FIG. 16 is a state transition diagram of a limited automaton in an action determining mechanism section.

Concretely speaking, as shown in FIG. 16, the action determining mechanism section 92 uses an algorithm referred to as a limited automaton 110 having a limited number of states which expresses a history of the condition recognition information D5 supplied in the past as a motion state (hereinafter referred to as a state) and determines the next action by transition of the above described state into another state on the basis of the condition recognition information D5 currently supplied and a state at this time. The action determining mechanism section 92 determines a motion referring not only to the current condition recognition information D5 but also to the past condition recognition information D5 by shifting a state each time when the condition recognition information D5 is supplied and determining a motion dependently on the shifted state.

Accordingly, a state ST1 of "chasing a ball" is shifted to a state ST5 of "standing," for example, when the condition recognition information D5 of "lost sight of a ball" is supplied, whereas a state ST2 of "lie down" is shifted to a state ST4 of "standing" when the condition recognition information D5 of "get up" is supplied. It will be understood that a motion is identical but states are different between these states ST4 and ST5 due to different histories of the past condition recognition information D5.

Actually, the action determining mechanism section 92 shifts a current state to a next state when detecting a predetermined trigger. Concrete examples of the trigger is that a motion at a current state has been performed for a fixed period of time and that an intensity of a desired unit out of intensities of the emotion units 100A to 100C and the desire units 101A to 101C represented by the specific condition recognition information D5 and the emotion and instinct condition information D6 supplied from the emotion and instinct model section 91 has exceeded a predetermined threshold value.

At this time, the action determining mechanism section 92 selects a state as a transition destination on the basis of whether or not the predetermined threshold value is exceeded by an intensity of a unit desired out of the emotion units 100A to 100C and the desire units 101A to 101C represented by the emotion and instinct condition information D6 supplied from the emotion and instinct model 91. Accordingly, the action determining mechanism section 92 is configured to make transition to a different state dependently on intensities of the emotion units 100A to 100C and the desire units 101A to 101C even when an identical condition recognition information D5 is input.

Accordingly, the action determining mechanism section 92 generates action command information D9 for allowing the pet robot to take a motion of "hand lending" in response to a palm stretched toward the eyes and sends out the information D9 to the posture transition mechanism section 93, when the action determining mechanism section 92 detects a palm stretched out toward the eye, on the basis of the supplied condition recognition information D5, detects an intensity of the "anger" emotion unit 100C which is not higher than a predetermined threshold value on the basis of the emotion and instinct condition information D6 and detects the battery voltage which is not lower than a predetermined threshold value (that is, "the pet robot is not hungry) on the basis of the condition recognition information D5.

Furthermore, the action determining mechanism section 92 generates the action command information D9 to allow the pet robot to take a motion of "licking a palm" and sends out the information to the posture transition mechanism section 93, when the action determining mechanism section 93 detects a palm stretched out toward the eyes, detects an intensity of the "anger" emotion unit 100C which is not higher than the predetermined threshold value and detects "the pet robot is hungry," that is, the battery voltage which is lower than the predetermined threshold value.

Furthermore, the action determining mechanism section 92 generates the action command information D9 to allow the pet robot to take a motion of "looking aside in a huff" and sends out the information to the posture transition mechanism section 93, when the action determining mechanism section 92 detects a palm stretched out toward the eyes and an intensity of the "anger" emotion unit 100C which is not lower than the predetermined threshold value. It does not matter whether or not "the pet robot is not hungry," that is, whether or not the battery voltage is not lower than the predetermined threshold value.

On the basis of intensities of units desired out of the emotion units 100A to 100C and the desire units 101A to 101C represented by the emotion and instinct condition information D6 supplied from the emotion and instinct model section 91, the action determining mechanism section 92 determines parameters for actions to be taken at a state of a transition destination, for example, walking speed, speeds and magnitudes to move hands and feet, a pitch and a volume of a sound to be given and so on, generates the action command information D9 corresponding to the above described parameters for the actions and sends out the information to the posture transition mechanism section 93.

Since the information recognition information D5 which is given from the sensor input processing section 90 has contents which are different depending on timings of inputs into the emotion and instinct model section 91 and the action determining mechanism section 92, the condition recognition information D5 is input into both the emotion and instinct model section 91 and the action determining mechanism section 92.

The controller 70 generates the emotion and instinct condition information D6 of "joy" with the emotion and instinct model section 91 and supplies the emotion and instinct condition information D6 to the action determining mechanism section 92, for example, when the information recognition information D5 representing "being patted on the head" is supplied. However, when the information recognition information D5 representing "there is a hand in front of the eyes" is supplied in this condition, the controller 70 generates the action command information D9 of "willing to lend a hand" in the action determining mechanism section 42 on the basis of the above described emotion and instinct condition information D6 of "joy" and the information recognition information D5 of "there is a hand in front of the eyes," and sends out the action command information D9 to the posture transition mechanism section 43.

In FIG. 12, the posture transition mechanism section 93 generates posture transition information D10 for transition of a current posture to a next posture on the basis of the action command information D9 supplied from the action determining mechanism section 92 and sends out the posture transition information D10 to the control mechanism section 94. In this case, a posture to which a current posture can be shifted is determined dependently, for example, on physical forms of the pet robot 51 such as forms and weights of a body, hands and feet, coupling conditions of parts and mechanisms of the actuators 54$AA_1$ to 56$A_M$ such as bending directions and angles of joints.

The postures to which the current posture can be shifted are classified into those to which the current posture can be shifted directly and others to which the current posture cannot be shifted directly. For example, the pet robot 51 with four feet can shift from a posture where it is lying with hands and feet largely thrown out to a lie-down posture, but not to a standing posture. This transition requires two steps of motions of taking a lie-down posture once with the hands and feet drawn near the body and then a motion of standing up. Furthermore, there is a posture which cannot be taken safely. For example, the four-footed pet robot easily falls down when it tries to raise both forefeet in a standing posture.

Therefore, the posture transition mechanism section 93 in which postures to which transition is possible are preliminarily registered sends out the above described action command information D9 supplied from the action determining mechanism section 92 to the control mechanism section 94 as the posture transition information D10 with no modification when the action command information D9 represents a posture to which direct transition is possible. However, in the case of a direct transition is impossible, the posture transition mechanism section 93 generates the posture transition information D10 which represents transitions to another possible posture and then to a target posture, and sends out the information to the posture transition mechanism section 94. Accordingly, the pet robot 51 is capable of avoiding an unreasonable attempt to take a posture to which transition is impossible or an event of falling down.

Concretely speaking, the posture transition mechanism section 93 is configured to preliminarily register postures which the pet robot 51 is capable of taking and possible transition between two postures.

Figure 17:
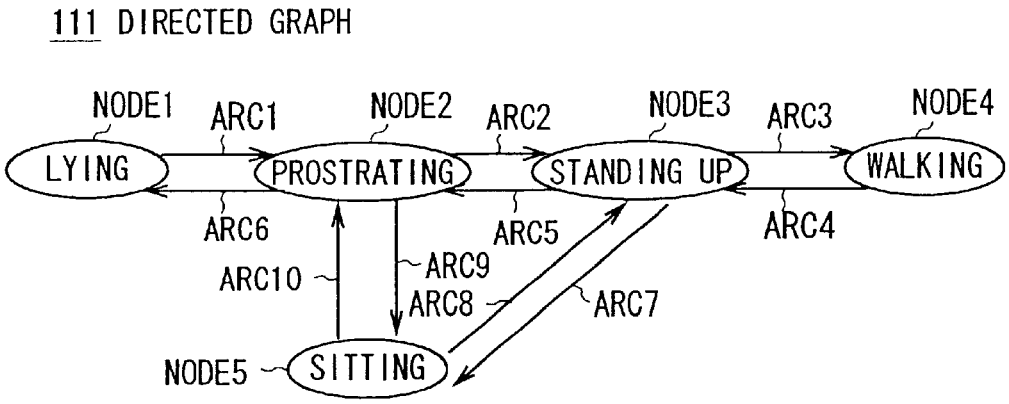
FIG. 17 is a posture transition diagram in a posture transition mechanism section.

The posture transition mechanism section 93 uses an algorithm referred to as a directed graph 111 which expresses postures which the pet robot 51 is capable of taking with nodes $NODE_1$ to $NODE_5$, in which the two postures between which transition is possible, that is, the nodes $NODE_1$ to $NODE_5$ are connected to each other with the directed arcs $ARC_1$ to $ARC_{10}$ for example, as shown in FIG. 17.

When the action command information D9 is supplied from the action determining mechanism section 92, the posture transition mechanism section 93 searches for a path from a current node $NODE_1$ to $NODE_5$ to a next node $NODE_1$ to $NODE_5$ following a direction of the directed arc $ARC_1$ to $ARC_{10}$ by connecting a node $NODE_1$ to $NODE_5$ corresponding to a current posture to a node $NODE_1$ to $NODE_5$ corresponding to a posture to be taken next indicated by the action command information D9 and consecutively records nodes $NODE_1$ to $NODE_5$ existing on the searched path, thereby planning posture transition. Accordingly, the pet robot 51 is capable of taking a motion directed by the action determining mechanism section 92 while avoiding an unreasonable attempt to take posture to which transition is impossible and an event of falling down.

When the action command information D9 of "sit down" is supplied at the node $NODE_2$ which represents the current posture of "lie down," for example, the posture transition mechanism section 93 gives posture transition information D10 of "sit down" to the posture control mechanism section 94 utilizing a fact that direct transition is possible from the node $NODE_2$ representing a posture of "lie down" to the node $NODE_5$ representing a posture of "sit down."

On the contrary, when the action command information D9 of "walk" is supplied, the posture transition mechanism section 93 plans posture transition by searching for a path from the node $NODE_2$ of "lie down" to the node $NODE_4$ of "walk," generates as a result the posture transition information D10 which makes an order of "stand up" and then an order of "walk," and sends out the information to the control mechanism section 94.

In FIG. 12, the control mechanism section 94 generates a control signal S20 for driving the actuators $54AA_1$ to $56A_M$ on the basis of the posture transition information D10, sends out the control signal S10 to the actuators $54AA_1$ to $56A_M$ for driving the above described actuators $54AA_1$ to $56A_M$, thereby allowing the pet robot 51 to take a desired action.

(2-4) Cover Fitting Processing Procedure RT1

When the cover unit 52 is actually fitted, the controller 70 in the pet robot 51 enters a cover fitting processing procedure RT1 shown in FIG. 11 from step SP0, and while monitoring a detected condition of the coupling sensor 80 in the main body side interface member 58 on the body member unit 53 at step SP1, the controller 70 proceeds to step SP2 where the controller 70 judges whether or not the cover side interface member 60 in the cover unit 52 has been connected electrically and mechanically on the basis of a detection result of the above described coupling sensor 80.

At the step SP2, the controller 70 waits for an affirmative result, proceeds to step SP3 where the controller 70 reads out the cover setting information D1 from the information storage member 81 in the cover side interface member 80 on the cover unit 52 and decodes an enciphered information included in the above described cover setting information D1 at step SP4.

Successively, the controller 70 extracts a cover number included in the cover setting information D1 at step SP5 and proceeds to step SP6 where the controller 70 reads out the performance information D2 corresponding to the above described cover number with the information reading member 75 in the body member unit 53.

The controller 70 then proceeds to step SP7 where the controller 70 decodes enciphered information included in the performance information D2, which is read out with the information reading member 75 and at step SP8, judges whether or not the cover unit 52 fitted over the pet robot 51 is a regular cover on the basis of decoded results at the steps SP4 and SP7.

When an affirmative result is obtained at the step SP8 which represents that the cover unit 52 has been authenticated as a regular cover to be fitted over the pet robot 51, the controller 70 proceeds to step SP9 where the controller 70 monitors an on/off condition of the touch sensor 78 on the basis of spurring by the user and proceeds to step SP10 only when detecting spurring such as "patting" and "striking".

At the step SP10, the controller 70 determines a current emotion condition by accumulatively combining intensities of emotions such as "being patted" and "being struck" (the emotion units 100A to 100C described above in FIG. 13).

The controller 70 thereafter proceeds to step SP11 where the controller 70 determines next action contents and sound contents dependently on the current emotion condition, selects action contents and sound contents suitable for the determined action contents and sound contents, out of the performance information D2 corresponding to a type of the cover unit 52 (that is, the cover number) at step SP12, and then proceeds to step SP13.

On the contrary, when a negative result is obtained at the step S8 which indicates that the cover unit 52 has not been authenticated as a regular cover to be fitted over the pet robot 51, the controller 70 proceeds to step SP14 where the controller 70 reads out an audio signal indicating an irregular cover, outputs sounds based on the audio signal from the speaker 79, and proceeds to the step SP13.

While monitoring a detection condition of the coupling sensor 80 in the main body side interface member 58 at the step SP13, the controller 70 proceeds to step SP15 where the controller 70 judges whether or not the cover side interface member 60 in the cover unit 52 has been connected electrically and mechanically on the basis of the detection result of the coupling sensor 80.

When an affirmative result is obtained at the step SP14, the controller 70 proceeds to step SP16 to terminate the above described cover fitting processing procedure RT1 while moving the pet robot 51 autonomously in accordance with the above described action contents having an individuality and the sound contents corresponding to the cover unit 52, which are determined at the step SP12.

When a negative result is obtained at step SP15 which indicates that the cover unit 52 has been detached from the pet robot 51 by the user or the cover side interface member 60 of the cover unit 53 has been, disconnected from the main body side interface member 58 of the pet robot 51 due to some external cause regardless of a user's intention, in contrast, the controller 70 returns once again to the step SP1 to repeat the processings as described above.

(2-5) Operations and Effects in this Embodiment

When the user fits a desired cover unit 52 over the pet robot 51 in the robot system 50, the user first electrically and mechanically connects the cover side interface member 60 of the cover unit 52 to the main body side interface member 58 of the body member unit 53.

Successively, it is judged whether or not the cover unit 52 is a regular cover on the basis of the cover setting information D1 stored by the information storage member 81 in the cover unit 52 and when an affirmative result is obtained, the performance information D2 corresponding to the above described cover setting information D1 is read out from the information reading member 75 in the body member unit 53.

As a result, the pet robot 51 is capable of changing conditions of a emotion and/or an instinct in an individual style in a predetermined changing state determined on the basis of the performance information D2 when user's spurring or an external stimulus is given while the pet robot 51 is taking an autonomous action.

An intensity of the "anger" emotion is enhanced at a rate higher than usual, for example, when the cover unit 52 has an aggressive appearance like a fierce animal or a reptile, whereas an intensity of "joy" emotion is enhanced at a rate higher than usual when the cover unit 52 has a lovely appearance like a cherished stuffed toy.

As a result, the pet robot 51 is capable of recognizing the patting on the head by the user as a "disagreeable thing" and manifesting a emotion corresponding to the disagreeable thing when the cover unit 52 has the aggressive appearance, whereas the pet robot 51 is capable of recognizing the patting on the head by the user as a "joyful thing" and manifesting a emotion corresponding to the joyful thing when the cover unit 52 has the lovely appearance.

Furthermore, an intensity of the desire of "appetite" desire is enhanced at a rate higher than usual and/or an intensity of the desire of "desire for motion" is enhanced at a rate lower than usual when the cover unit 52 is a relatively heavy. When the cover unit 52 has a relatively light, on the other hand, an intensity of the desire of "appetite" is enhanced at a rate lower than usual and/or an intensity of the desire of "desire for motion" is enhanced at a rate higher than usual.

As a result, the pet robot 51 having the cover unit 52 which is a relatively heavy is capable of executing actions to appeal a desire for charging the battery 71 taking residual amount change of the battery 71 quicker than usual into consideration, thus showing to the user the appetite emotion like a real animal. Together with and/or instead of this action, the pet robot 51 is capable of taking a motion with less amount of motion as a residual amount of the battery 71 is reduced by reducing the amount of motion as the residual amount of the battery 71 gets low.

Furthermore, the pet robot 51 is capable of securing a crime preventive property by preventing use of a cover unit 52 prepared illegally by a third party since the enciphered information is included in the cover setting information D1 which is stored in the information storage member 81 of the cover unit 52 so that the pet robot 51 judges whether or not the cover unit 52 attached to the pet robot 51 is the regular cover unit, on the basis of the above described enciphered information.

The configuration described above makes it possible to realize the robot system 50 having a remarkably enhanced amusement property since the information storage member 81 which stores the cover setting information D1 relating to the cover unit 52 is disposed in the cover unit 52, the performance information D2 matched with the above described cover setting information D1 is selectively read out of the performance information D2 set for kinds of the cover unit 52 and stored in the information storage member 75 in the body member unit 53 when the cover unit 52 is fitted over the pet robot 51, and emotions and instincts of the pet robot 51 are changed in accordance with predetermined changing conditions determined on the basis of the performance information D2 so that performance information D2 is reflected on making actual motions and actions of the pet robot 51 in individual styles.

(2-6) Other Embodiments

Note that, though the present invention is applied to the robot system 50 having a basic configuration of the quadruped walking type pet robot 51 configured as shown in FIG. 8 in the embodiments described above, the present invention is not limited by the embodiments and the present invention is applicable widely to robot apparatuses having other various configurations so far as the robot apparatus manifests predetermined motions (walking, light emission, sounding and so on).

Further, though the cover unit 52 which is composed of the cover main body 52A made of synthetic fibers having a shape like a surface skin of a real dog is used as a cover to be detachably fitted over the robot apparatus as shown in FIG. 8 in the above described embodiments, the present invention is not limited by the embodiments and shapes like surface skins of other animals (cat, raccoon dog, horse, monkey, human or the like) may be made of other various kinds of materials (fur, textile, ceramic, synthetic resin, metal and so on).

Figure 26:
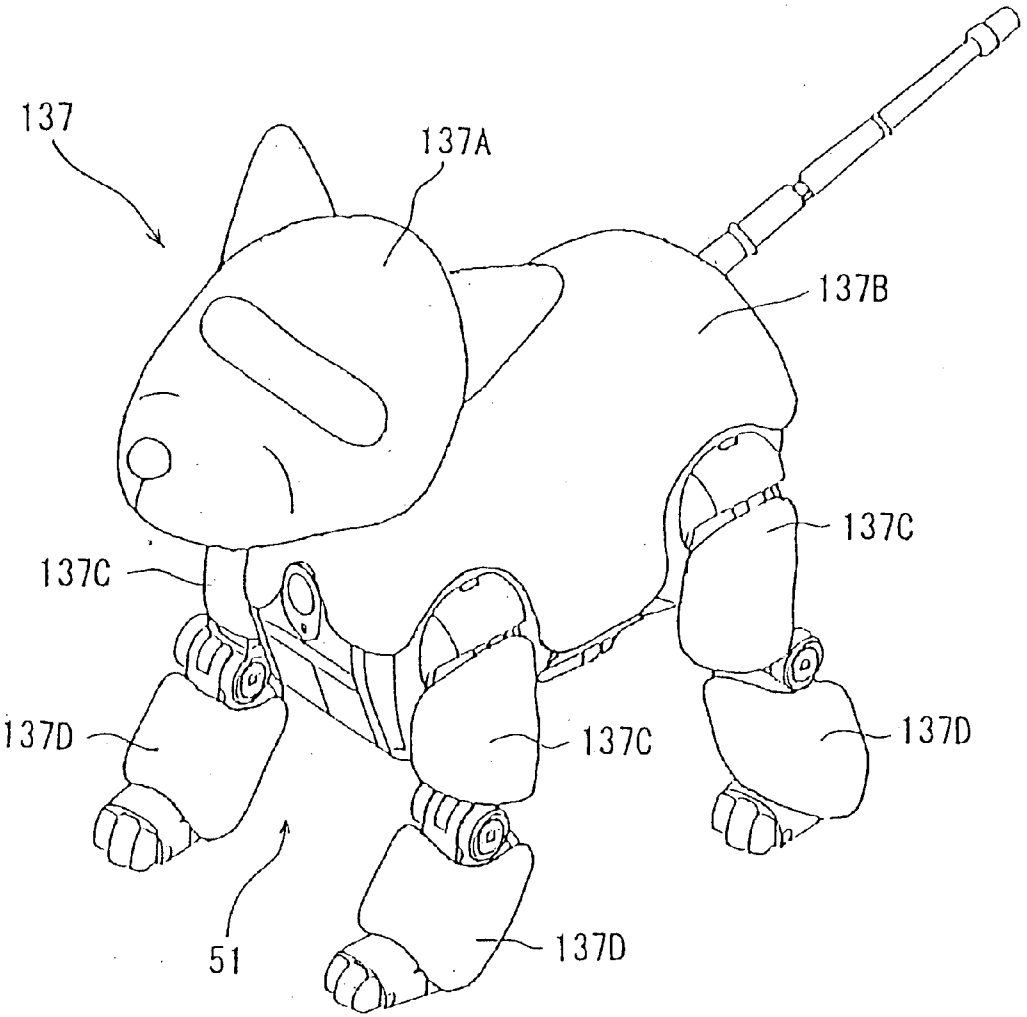
FIG. 26 is a schematic diagram showing a configuration of a pet robot system according to another embodiment.

Further, though the cover main body 52A which is made of a monolithic molding of synthetic fiber having a form like a surface skin of an animal is used as the cover main body 52A to form the cover unit 52, the present invention is not limited to this and a plurality of cover parts 137 which are made of metal corresponding to parts of the pet robot 51 may be used separately as shown in FIG. 26. In this case, the plurality of cover parts 137 consist of a head part 1370A, a body part 1370B, leg parts 137C and shank parts 137D, and the above described cover side interface member 60 is disposed in the body part 137B. In addition, various kinds of material (synthetic fibers, fur, textile, ceramic, synthetic resin, and so on) other than metal are widely usable to form the cover parts 137.

Further, though the controller 70 used as a control means in the body member unit 53 of the pet robot 51 is configured to determine the performance information D2 corresponding to the cover number in the above described cover setting information D1 on the basis of the cover setting information (inherent information) D1 allocated to the above described cover unit 52 when the cover unit 52 is fitted over the pet robot 51 in the above described embodiments, the present invention is not limited to this and control means having various configurations may be used so far as the control means is capable of changing motion manifesting patterns on the basis of the cover setting information D1 as occasion demands.

Further, though the cover setting information D1 includes information about the cover number and the manufacturing license, the cover setting information may include information related to a type, a form, a material, a mass distribution, hardness and a heat conductivity of the cover unit as well as information related to an individuality, motions and actions of the cover unit. In this case, the controller 70 disposed as control means in the body member unit 53 of the pet robot 51 may be configured to determine actions of the pet robot 51 on the basis of only the cover setting information D1 read out with the information reading member (information reading means) 75 and drive the actuators 54$AA_1$ through 56$A_M$ which are required in relation to determined actions and allow the speaker 79 to give sounds as occasion demands.

Further, though an individuality is imparted by storing the cover number as the inherent information in the above described embodiments, the present invention is not limited by the embodiments and numbers and parameters defining a walking pattern, an action pattern and contents of motions suitable for a kind of animal represented by a cover (for example, hopping in case of a kangaroo or slow walking in case of a bear) may be stored as the inherent information dependently on the shapes of covers (for example, a kangaroo, a bear or a rabbit).

Further, though the cover side interface member 60 disposed in the cover unit 52 and the main body side interface member 58 disposed in the pet robot 51 are used as means for connecting the cover electrically and mechanically to the robot apparatus when the cover is fitted over the robot apparatus in the above described embodiments, the present invention is not limited by the embodiments and other means having various configurations may be used so far as the means can impart an individuality to each shape of cover unit 52 and detachably connect the cover to the robot apparatus.

Further, though the information storage member 81 is disposed in the cover unit 52 as the information storing means (memory) and the inherent information corresponding to the cover unit 3 is stored in the above described information storage member 81 in the above described embodiments, the present invention is not limited by the embodiments and a characteristic item corresponding to the inherent information (a mark, a bar code, a predetermined concavo-convex pattern, a protruding end having a special form or the like) may be disposed at a location to connect the pet robot 51 without disposing the information storage member 81 in the cover unit 52 so that the inherent information can be recognized by reading the characteristic item at the location to connect the pet robot 51. Furthermore, as storing means, in addition to a non-volatile memory which stores the inherent information, a passive element such as a resistor, and magnetism may store inherent information, and a light emitting pattern of a light emitting diode (LED) may be used as inherent information.

Further, though the connector halves 57A and 59A and engaging mechanism parts 57B and 59B are connected between the connector part 59 of the cover side interface member 60 and the connector part 57 of the main body side interface member 58 so that the coupling sensor 80 in the connector part 57 of the main body side interface member 58 detects a connected condition between the cover unit 52 and the pet robot 51 on the basis of a voltage value obtained by way of the load resistor R2 in the connector part 59 of the cover side interface member 60 and the connector part 57 of the main body side interface member 58 in the above described embodiments, the present invention is not limited by the embodiments and other various methods may be used to detect the connected condition between the cover unit 52 and the pet robot 51.

It is possible, for example, to dispose a distance detecting member (not shown) in either the connector part 57 of the main body side interface member 58 or the connector part 59 of the cover side interface member 60 so that the controller 70 detects a connected condition between the connector parts 57 and 59 on the basis of changes of distance information obtained as a detection result of the above described distance detecting member, or to dispose a light amount detecting member (not shown) in the connector part 57 of the main body side interface member 58 so that the controller 70 detects the connected condition between the connector parts 57 and 59 on the basis of a light amount change obtained as a detection result of the above described light amount detecting member.

Further, though the controller 70 disposed as information detecting means in the body member unit 53 of the pet robot 51 determines the performance information D2 corresponding to a type of the above described cover unit 52 on the basis of the cover setting information D1 (inherent information) given from the cover unit 52 and determines actions of the pet robot 51 on the basis of the above described performance information D2 in the above described embodiments, the present invention is not limited by the embodiments and form information included in the cover setting information D1 may be judged so that parts of the pet robot 51 move free from interference due to the cover unit, or a mass distribution in the cover setting information D1 is judged so that the pet robot 51 moves with good balance.

Figure 18:
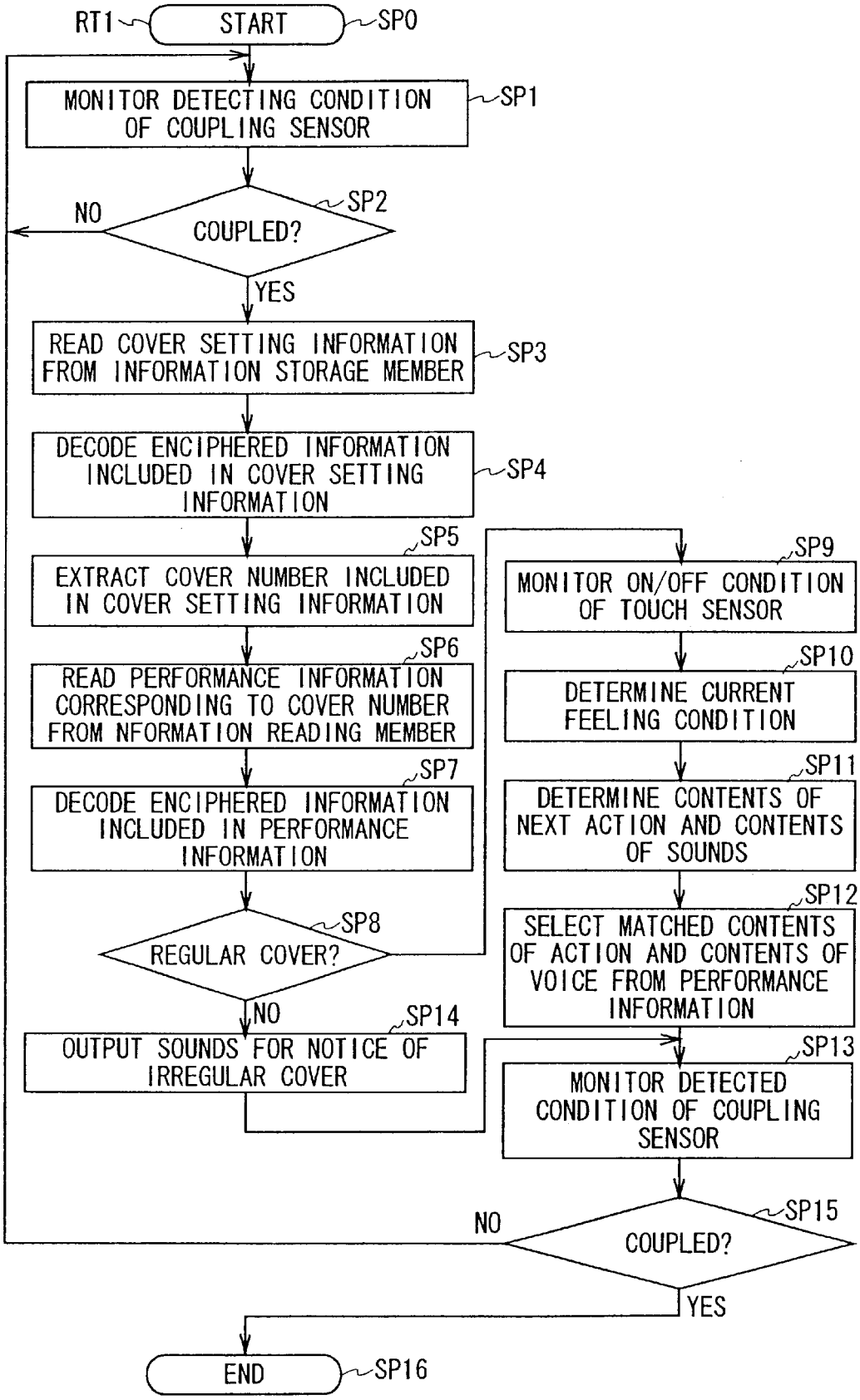
FIG. 18 is a flow chart descriptive of a cover fitting processing procedure.

Further, though contents of the cover setting information D1 allocated to each cover unit 52 are not reflected on the performance information D2 when the cover side interface member 60 of the cover unit 52 is not connected to the main body side interface member 58 in the body member unit 53 of the pet robot 51 in the cover fitting processing procedure RT1 shown in FIG. 18 in the above described embodiments, the present invention is not limited by the embodiments and some or all of actions and motions of the pet robot 51 may be restrained when the cover side interface member 60 of the cover unit 52 is not connected to the main body side interface member 58 in the body member unit 53 of the pet robot 51.

Furthermore, though the information reading member 75 disposed as information reading means reads out the performance information D2 from a recording medium (not shown) inserted from outside and sends out the information to the controller 70 in the body member unit 53 of the pet robot 51 in the above described embodiments, the present invention is not limited by the embodiments and a receiving device may be used as the information reading means to receive and download the performance information D2 transmitted from outside.

Figure 19:
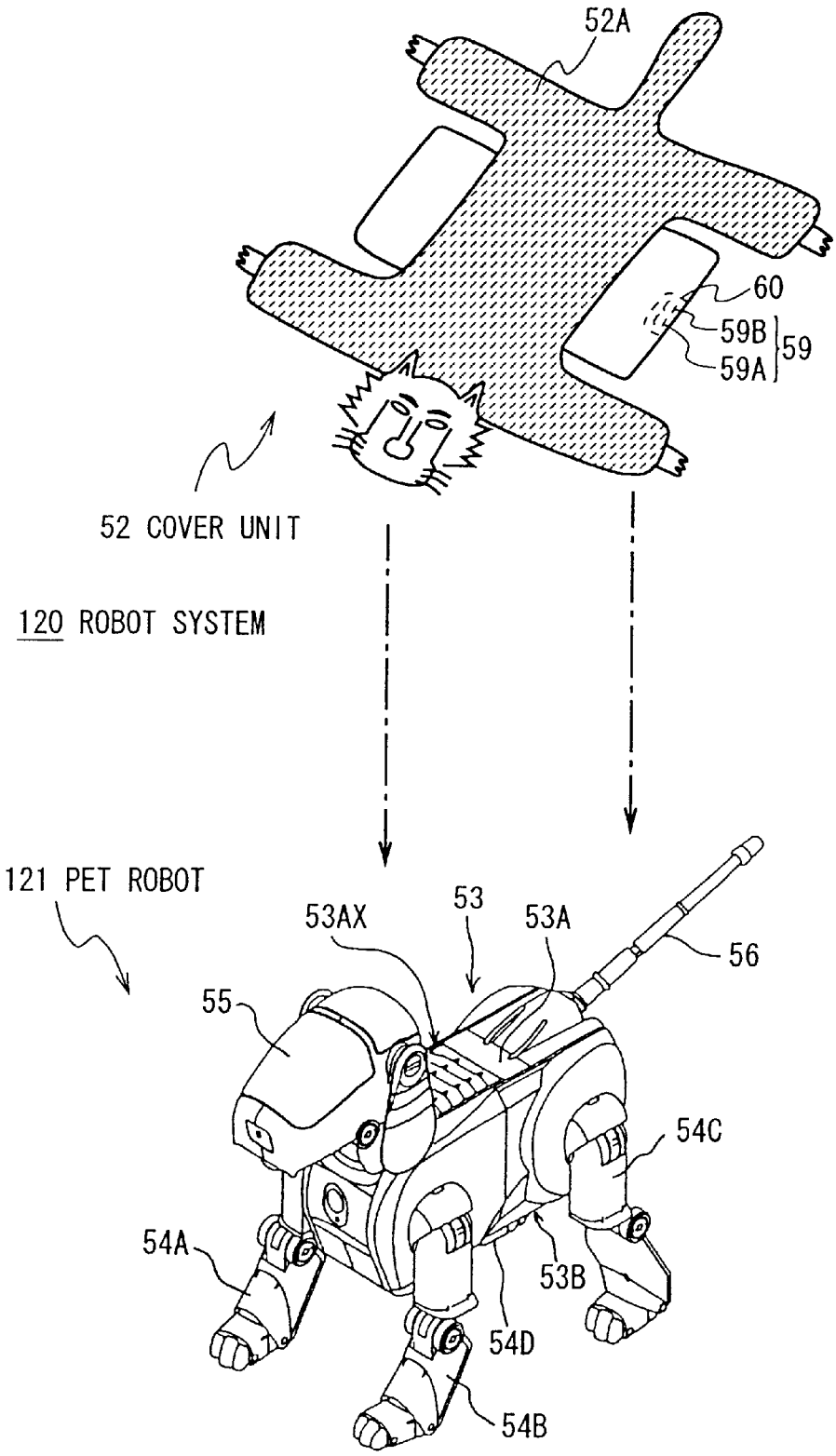
FIG. 19 is a schematic diagram showing a configuration of a pet robot system in a third embodiment.

(3) Third Embodiment (3-1) Configuration of Robot System 120 according to this Embodiment FIG. 19 where the same reference numerals are applied to parts corresponding to parts in FIG. 8 shows a pet robot system 120 according to a third embodiment. The pet robot system 120 has the same configuration as the pet robot system 50 (FIG. 8) except that a pet robot 121 has a function of changing motions and actions as if the real animal "grew", in accordance with a history of operation inputs such as spurring and orders given with a sound commander from a user and histories of own actions and motions.

Concretely speaking, prepared for the pet robot 121 in this pet robot system 120 are four "growth steps" of "baby period," "child period," "young period" and "adult period." Preliminarily stored in a memory 122A (FIG. 19) of a controller 122 (FIG. 10) are action and motion models consisting of various kinds of control parameters and control programs to be used as bases of actions and motions related to four items of "walking condition," "motion," "action" and "sound" for each "growth step."

At an initial stage, the controller 122 controls actuators $\mathbf{54}AA_1$ to $\mathbf{56}A_M$ and a sound output according to action and motion models for "baby period" so that "walking condition" is made "tottering walk" by narrowing steps, "motion" is made "simple" motions like "walk," "stand up" and "lie down," "action" is made a monotonous action consisting of an identical action which is repeated and "sound" is made a "low and short" sounds by lowering an amplification ratio of an audio signal S16.

At this time, the controller 122 always monitors and counts generation of a plurality of predetermined factors related to "growth" (hereinafter referred to as growth factors) such as strengthening learning consisting of order inputs using a sound commander, sensor inputs by way of a touch sensor 78 such as "patting" and "striking," and the number of successes in predetermined actions and motions, sensor inputs by way of the touch sensor 78 other than "patting" and "striking," and predetermined actions and motions such as "playing with a ball."

When a total value of accumulative frequencies of the growth factors (hereinafter referred to as a total experience value of the growth factors) exceeds a predetermined threshold value, the controller 122 modifies the action and motion models for "baby period" into action and motion models for "child period" at a higher growth level (at which actions and motions are harder and more complicated) on the basis of the accumulative frequencies of the growth factors.

Thereafter, the controller 122 controls the actuators $\mathbf{54}AA_1$ to $\mathbf{56}A_M$ and a sound output from the speaker 79 according to the action and motion models for "child period" so that "walking condition" is made walking "with a little firm steps" by enhancing rotating speeds of the actuators

54$AA_1$ to 56$A_M$, "motion" is made "a little upgraded and complicated" motions by increasing the number of motions, "action" is made a motion "with a little purpose" by determining a next action by referring to a preceding action and "sound" is made "a little long and loud" sounds by prolonging the audio signal S16 and enhancing an amplification ratio of the signal.

Each time the total experience value of the growth factors exceeds each of a threshold value predetermined for each "young period" and "adult period," the controller 122 similarly modifies the action and motion models into action and motion models for "young period" or "adult period" at a higher growth level, gradually enhances the rotating speeds of the actuators 54$AA_1$ to 56$A_M$, prolongs the audio signal S16 according to above described action and motion models, enhances the amplification ratio of the audio signal S16 to be given to the speaker 79 and changes rotating amounts of the actuators 54$AA_1$ to 56$P_M$ for a single motion.

As a result, the pet robot 121 changes stepwise "walking condition" from "tottering walk" to "firm walking," changes "motion" from "simple" to "upgraded and complicated," changes "action" from "monotonous" to "action with a purpose" and changes "sound" from "low and short" to "long and loud" as the pet robot 121 has ascended "growth step" (that is, "growth step" changes from "baby period" to "child period," from "child period" to "young period" and from "young period" to "adult period").

The pet robot 122 is configured to "grow" at the four steps of "baby period," "child period," "young period" and "adult period" dependently on external inputs as well as histories of actions and motions of the pet robot itself as described above.

Figure 20:
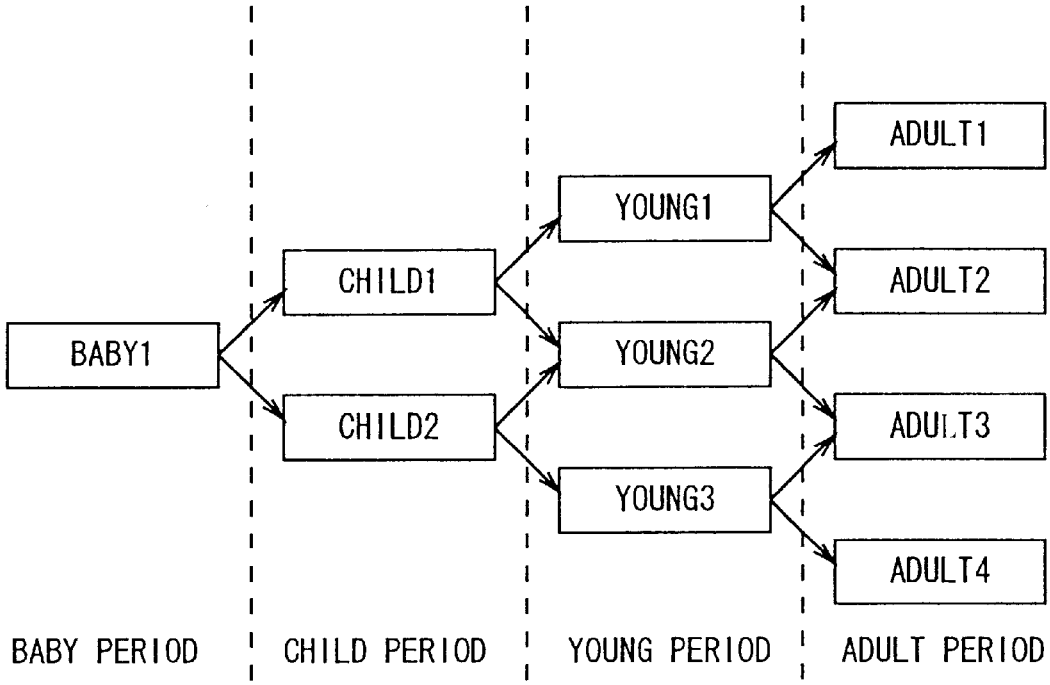
FIG. 20 is a schematic diagram descriptive of a growth model in the third embodiment.

In case of this embodiment, a plurality of action and motion models are prepared for "growth steps" of "child period," "young period" and "adult period" as shown in FIG. 20.

Actually prepared as the action and motion models for "child period" are action and motion models (Child 1) which provide a "rude" character manifesting quick and rough actions and motions, and action and motion models (Child 2) which provide a "gentle" character manifesting smooth and slow actions and motions.

Furthermore, prepared as action and motion models for "young period" are action and motion models (Young 1) which provide an "irritated" character manifesting actions and motions which are quicker and rougher than those of the "rough" character in "child period," action and motion models (Young 2) which provide an "ordinary" character manifesting actions and motions slower and smoother than those of the "irritated" character, and action and motion models (Young 3) which provide a "gentle" character manifesting actions and motions slower and smaller in amounts than those of the "ordinary" character.

Furthermore, prepared as action and motion models for "adult period" are action and motion models (Adult 1) which provide an "aggressive" character manifesting motions quicker and rougher than those of the "irritated" character of "young period" and hardly movable in accordance with user's orders, action and motion models (Adult 2) which provides a "little rough" character liable to manifest smoother and slower actions and motions in accordance with user's orders, action and motion models (Adult 3) which provide a "little gentle" character manifesting smoother and slower actions and motions in smaller amounts and always moving in accordance with user's orders, and action and motion models (Adult 4) which provide a "gentle" character manifesting much slower actions and motions in smaller amounts and always moving in accordance with user's orders.

When upgrading "growth step," the controller 122 selects a action model and/or a motion model out of action and motion models for a next "growth step" on the basis of the accumulative frequency of each growth factor, and modifies the used action and motion models with the selected action and motion models.

On and after "child period," action and motion models at a current "growth step" can be shifted only to specific action and motion models connected by the arrows in FIG. 20 at a next "growth step." When the action and motion models (Child 1) manifesting the "rough" actions and motions has been selected at "child period," for example, the model cannot be shifted to the action and motion model (Young 3) which manifests "gentle" actions and motions at "young period."

The pet robot 121 is configured to change also "character" along with "growth" dependently on a history of inputs such as spurring and orders from the user, and a history of actions of the pet robot itself as if the pet robot was a real animal which grows and has its character dependently on breeding manner of an owner.

(3-2) Processing by Controller 122

Now description will be made of processing which is performed by the controller 122 for generating actions of the pet robot 121.

Figure 21:
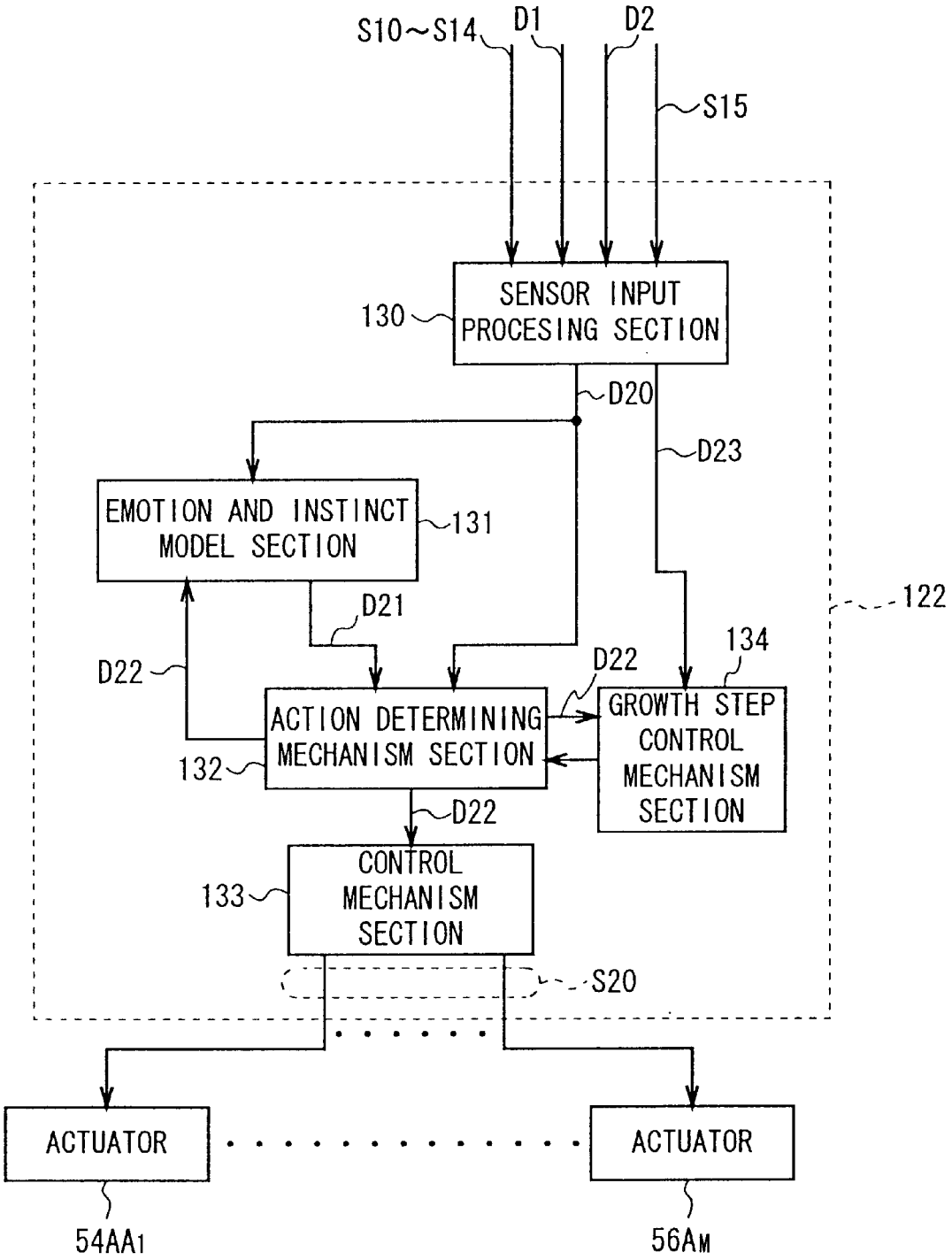
FIG. 21 is a schematic diagram descriptive of processing by a controller in the second embodiment.

As shown in FIG. 21 where the same reference numerals are applied to parts corresponding to those of FIG. 12, functions of the controller 122 which performs processing for generating actions of the pet robot 121 can be classified into a sensor input processing section 130 which recognizes specific conditions, a emotion and instinct model section 131 which expresses the emotion and instinct conditions on the basis of the recognition result by the sensor input processing section 130, an action determining mechanism section 132 which determines a successive action on the basis of a result recognized by the sensor input processing section 130, an action generating mechanism section 133 which allows the pet robot 121 to actually manifest actions on the basis of a result determined by the action determining mechanism section 132 and a growth step control mechanism section 133 which controls the "growth steps" of the pet robot 121.

In this case, the sensor input processing section detects and recognizes surrounding and own conditions, and the presence and absence of spurring and orders from a user, on the basis of the audio signal S10, the image signal S11, the pressure detection signal S12, the battery residual amount detection signal S13 and the heat detection signal S14 which are given from the microphone 76, the CDD camera 77, the touch sensor 78, the battery sensor 72, and the heat sensor, and also recognizes the presence and absence of the cover unit 52 and various setting information set for the cover unit 52, on the basis of the cover detection signal S15 which is supplied from the coupling sensor 80 in the main body side interface member 58, the cover setting information D1 read out from the information storage member 81 in the cover side interface member 60, and the performance information D2 read out with the information reading member 75 in the body member unit 53. Then, the sensor input processing section informs the emotion and instinct model section 131 and the action determining mechanism section 132 of the recognition result as the condition recognition information D20.

Then, the emotion and instinct model section 131 decides emotions and instincts of the pet robot 121 of this time and sends out the decided emotion and instinct conditions as emotion and instinct condition information D21 to the action determining mechanism section 132, as in the case of the emotion and instinct model section 91 described in the second embodiment in FIG. 12.

When the condition recognition information D20 is given from the condition recognizing mechanism section 130 or when the current action has been performed for a fixed period of time, the action determining mechanism section 132 determines a next action such as "stand up" "lie down" or "walk" on the basis of the emotion and instinct condition information D21 which is given from-the emotion and instinct model section 131 and a control parameter for an "action" of action and motion models which is preliminarily designated by the growth step control mechanism section 134 out of the control parameters for "action" of the action and motion models which are stored in the memory 122A.

Figure 22:
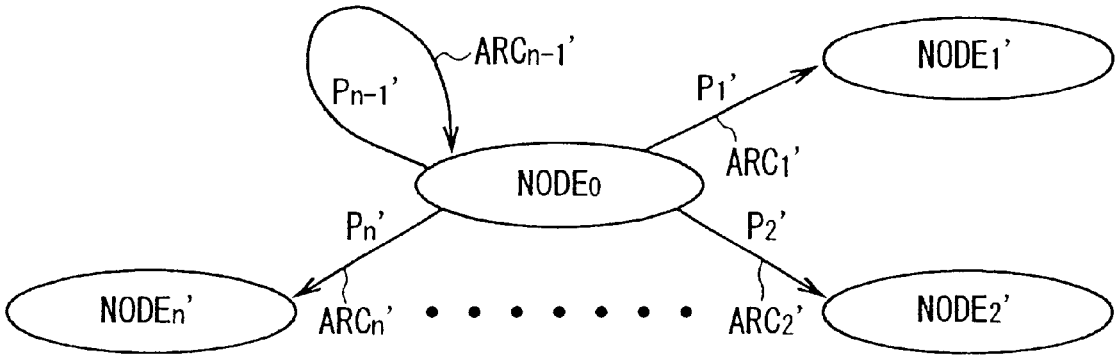
FIG. 22 is a schematic diagram showing a probability automaton.

Concretely speaking, the action determining mechanism section 132 uses, as means for determining a next action, an algorithm referred to as a probability automaton which expresses conditions using nodes $NODE_0$ to $NODE_n$ and determines transition to be made from the node $NODE_0$ to any of the nodes $NODE_1$ through $NODE_n$ with a probability on the basis of transition probabilities $P_1$ through $P_n$ which are set for arcs $ARC_1$ through $ARC_n$ with which the nodes $NODE_0$ through $NODE_n$ are connected to each other, as shown in FIG. 22.

The transition probabilities $P_1$ through $P_n$ for the arcs $ARC_1$ through $ARC_n$ are preliminarily set as control parameters related to "actions" and stored in the memory 122A for each action and motion model at each "growth step."

When the condition recognition information D20 is given from the condition recognizing mechanism section 130 or when the pet robot has been in the current condition (node $NODE_0$) for a fixed period of, for example, the action determining mechanism section 132 determines a next condition (nodes $NODE_1$ through $NODE_n$) with the probability automaton on the basis of the transition probabilities $P_1$ through $P_n$ for the arcs $ARC_1$ through $ARC_n$ which are control parameters related to "actions" of the action and motion models selected at that time and informs the emotion and instinct model section 131, the action generating mechanism section 133 and the growth step control mechanism section 134 of actions for transition to the above described condition as action determining information D22.

The action generating mechanism section 133 has, in the memory 122A of the controller 122, various kinds of control parameters and necessary control programs for "walking condition," "motion" and "sound" of each action and motion model correspondingly to each action and motion model at each "growth step" described above.

When the action determination information D22 is given from the action determining mechanism section 132, the action generating mechanism section 133 makes a concrete action plan for executing actions determined by the action determining mechanism section 132 on the basis a various kinds of control parameters and necessary control programs for the action and motion models preliminarily designated by the growth step control mechanism section 134, out of the various kinds of control parameters and necessary control programs for "walking condition," "motion" and "sound" of the action and motion models which are stored in the memory 122A. The action plan is calculated actually as numerical values representing the number of rotations of the actuators 54$AA_1$ through 56$A_M$ which are required to execute the action.

The action generating mechanism section 133 generates a control signal S20 for the required actuators 54$AA_1$ through 56$A_M$ on the basis of this driving plan, and drives and controls corresponding actuators 54$AA_1$ through 56$A_M$ on the basis of the control signal S20, thereby allowing the pet robot 121 to execute the actions determined by the action determining mechanism section 131.

When the condition recognizing mechanism section 130 recognizes some condition on the basis of the audio signal S10, the image signal S11, the pressure detection signal S12, the battery residual amount detection signal S13 and the heat detection signal S14 which are given from the microphone 76, the CCD camera 77, the touch sensor 28, the battery sensor 72 and the heat sensor 73, the condition recognizing mechanism section 130 informs the growth step control mechanism section 134 of the condition as condition recognition information D23.

The condition given from the condition recognizing mechanism section 130 to the growth step control mechanism section 134 is not only the specific conditions which are supplied to the action determining mechanism section 132 as described above but also inputs using the touch sensor 78 which do not correspond to "patting" or "striking."

Figure 23:
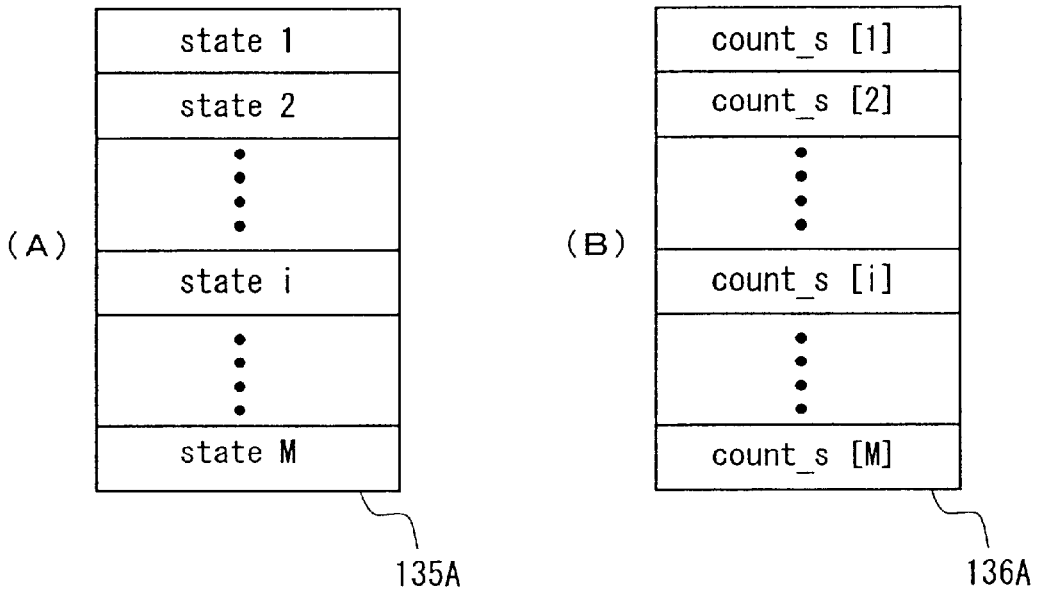
FIG. 23 is a conceptional diagram showing a first growth factor list and a first growth factor counter table.

Further, the growth step control mechanism section 134 has, in the memory 122A, a list (hereinafter referred to as a first growth factor list) 135A of the above described growth factors which are to be used as reference factors for enhancing "growth step" out of various kinds of conditions based on the condition recognition information D23 given from the condition recognizing mechanism section 131 as shown in FIG. 23(A) and a countertable (hereinafter referred to as a first growth factor countertable) 136A such as that shown in FIG. 23(B) for counting accumulative frequencies of the growth factors.

When the condition recognition information D23 is given from the condition recognizing mechanism section 130, the growth step control mechanism section 134 judges on the basis of the first growth factor list 135A whether or not a condition obtained on the basis of the condition recognition information D23 is a growth factor, and when the above described condition is a growth factor, the growth step control mechanism section 134 increases a corresponding count value (experience value) by one in the first growth factor countertable 136A.

Figure 24:
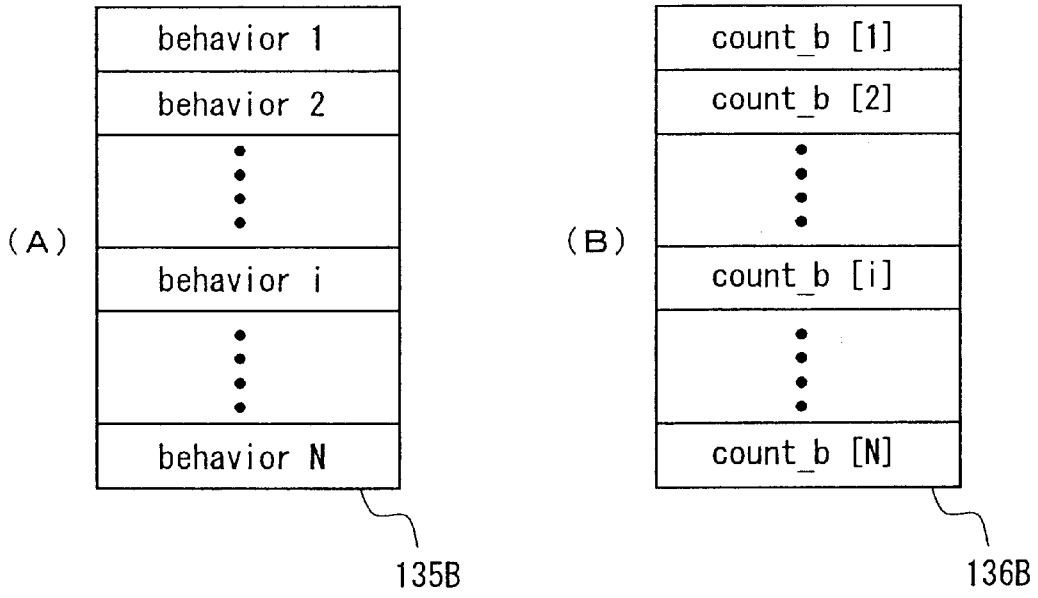
FIG. 24 is a conceptional diagram showing a second growth factor list and a second growth factor counter table.

Further, the growth step control mechanism section 134 has, in the memory 122A, a list (hereinafter referred to as a second growth factor list) 135B of the above described growth factors which are to be used as reference factors for enhancing "growth step" as to actions obtained on the basis of the action determination information D22 given from the action determining mechanism section 132 as described above as shown in FIG. 24(A) and a countertable (hereinafter referred to as a second growth factor countertable) 136B such as that shown in FIG. 24(B) for counting accumulative frequencies of these growth factors.

When the action determination information D22 is given from the action determining mechanism section 132, the growth step control mechanism section 134 judges on the basis of the second growth factor list 135B whether or not the actions obtained on the basis of the above described condition recognition information D20 is a growth factor, and when the above described action is a growth factor, the growth step control mechanism section 134 increases a corresponding count value (experience value) by one in the second growth factor countertable 136B.

When the count value is increased in the first or second growth factor countertable 136A or 136B as described above, the growth step control mechanism section 134 increases a count value by one in a counter (hereinafter referred to as a total experience value counter) provided separately from the first and second growth factor countertables 136A and 136B for judging whether or not "growth step" is to be enhanced and then judges whether or not a count value of the total experience value counter has reached a count value preliminarily set as a condition to terminate a current "growth step."

When the count value of the total experience value counter has reached the count value preliminarily set as the condition to terminate the current "growth step," the growth step control mechanism section 134 determines action and motion models at a next "growth step" to which transition is to be made from the current action and motion models on the basis of count values in the first and second growth factor countertables 136A and 136B, and informs the action determining mechanism section 132 and the action generating mechanism section 133 of the determination result. At an initial condition, the growth step control mechanism section 134 informs the action determining mechanism section 132 and the action generating mechanism section 133 of orders so as to select the action and motion models for "baby period."

As a result, the action determining mechanism section 132 selects a control parameter for "action" of the designated action and motion model on the basis of information from the growth step control mechanism section 134, thereafter determining actions next to the current actions of the pet robot 121 using this control parameter as described above.

Further, the action generating mechanism section 132 selects various kinds of control parameters and necessary control programs for "walking condition," "motion" and "sound" of the designated action and motion models on the basis of information from the growth step control mechanism section 134, thereafter driving and controlling the actuators 54$AA_1$ through 56$A_M$ and the sound output using the various kinds of control parameters and the necessary control programs.

The controller 122 generates actions of the pet robot 121 so as to be capable of acting autonomously while enhancing "growth step" as occasion demands as described above.

(3-3) Growth Step Control Processing Procedure RT2

Figure 25:
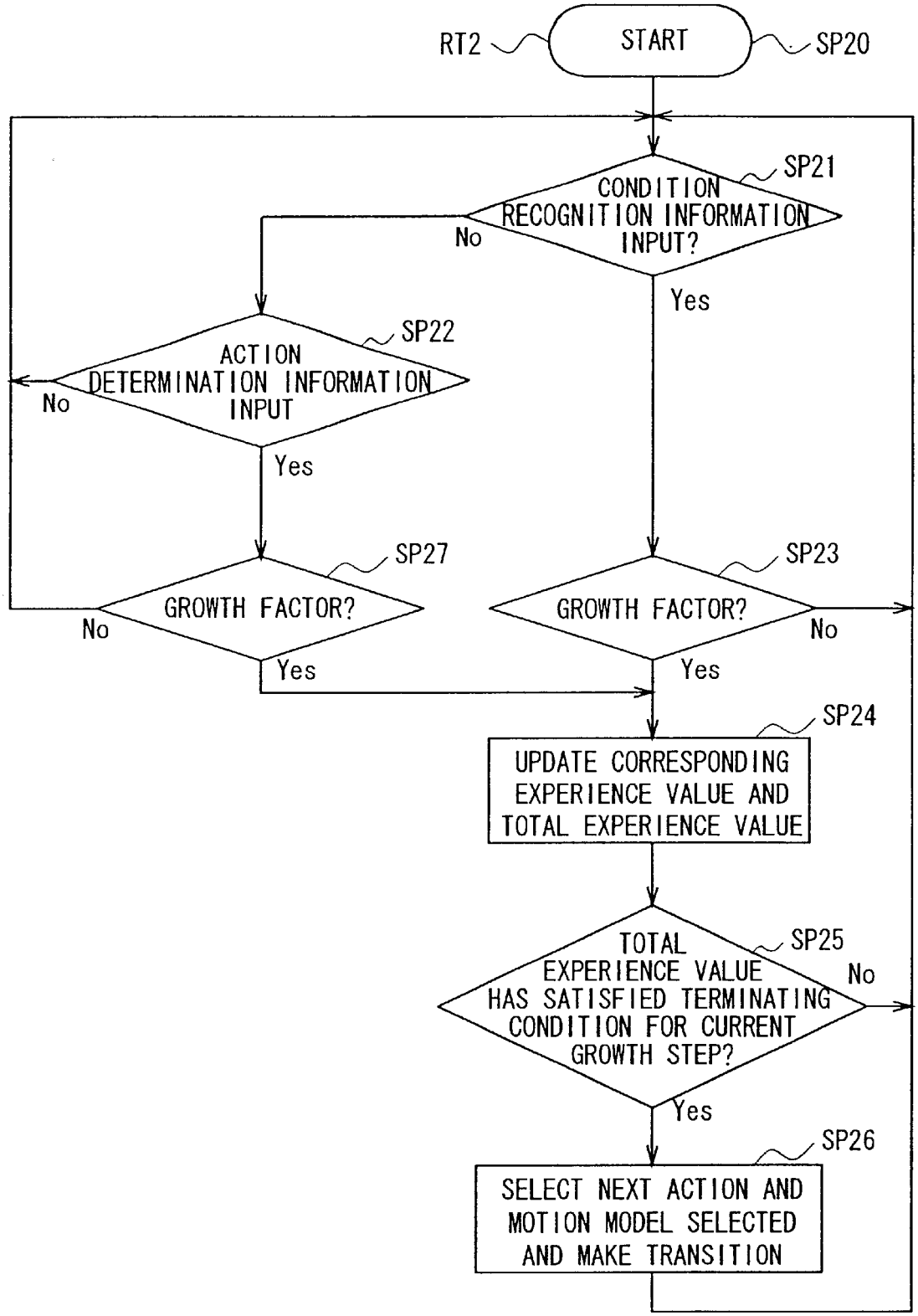
FIG. 25 is a flow chart descriptive of a growth step control processing procedure.

The growth step control mechanism section 134 controls "growth step" of the pet robot 121 in accordance with a growth step control processing procedure RT2 shown in FIG. 25.

After power is turned on, the growth step control processing mechanism section 134 starts the growth step control procedure RT2 at step SP20 and judges whether or not the condition recognition information D23 has been given from the condition recognizing mechanism section 130 at succeeding step SP21.

When a negative result is obtained at the step SP21, the growth step control mechanism section 134 proceeds to step S22 and judges whether or not the action determination information D22 has been given from the action determining mechanism section 132. When a negative result is obtained at the step SP22, the growth step control mechanism section 134 returns to the step SP21 and repeats a loop of steps SP21-SP22-SP21 until an affirmative result is obtained at the step SP 21 or SP22.

When the affirmative result is obtained at the step SP21, the growth step control mechanism section 134 proceeds to step SP23 and judges whether or not a condition obtained on the basis of the condition recognition information D23 given from the condition recognizing mechanism section 130 is a growth factor.

The growth step control mechanism section 134 returns to the step SP21 when a negative result is obtained at the step SP23, whereas the growth step control mechanism section 134 proceeds to step SP24 when an affirmative result is obtained, and increases a corresponding count value in the first growth factor list 135A and a count value in the total experience value counter, by one respectively.

Successively, the growth step control mechanism section 134 proceeds to step SP25 and judges whether or the count value in the total experience count value has reached a count value which is preliminarily set as a terminating condition of a current "growth step."

The growth step control mechanism section 134 returns to the step SP21 when a negative result is obtained at the step SP25, whereas the growth step mechanism section 134 proceeds to step SP26 when an affirmative result is obtained, determines action and motion models at a next "growth step" to which the action and motion models are shifted, informs the action determining mechanism section 132 and the action generating mechanism section 133 of the determination result, and returns to the step SP21.

When an affirmative result is obtained at the step SP22, the growth step control mechanism section 134 proceeds to step SP27 and judges whether or not the actions obtained on the basis of the action determining information D22, given from the action determining mechanism section 132 is a growth factor.

The growth step control mechanism section 134 returns to the step SP21 when a negative result is obtained at the step SP27, whereas the growth step control mechanism section 134 proceeds to step SP24 when an affirmative result is obtained, increases a corresponding count value in the second growth factor list 135B and a count value in the total experience value counter, by one respectively, proceeds to the step SP25 and executes processings similar to those which have been described above.

(3-4) Operations and Effects of Third Embodiment

To fit a desired cover unit 52 over the pet robot 121 in the robot system 120 which has the above described configuration, the user connects the cover side interface member 60 of the cover unit 52 electrically and mechanically to the main body side interface member 58 of the body member unit 53. Then, it is judged on the basis of the cover setting information D1 read out of the information storage member 81 in the above described cover unit 52 whether or not the cover unit 52 is a regular cover unit, and the performance information D2 corresponding to the above described cover setting information D1 is read out from the information reading member 75 in the body member unit 53 when an affirmative result is obtained.

As a result, the pet robot 121 is capable of changing transition rates of action and motion models at "growth step" of the pet robot 121 in an individual style in a predetermined changing condition determined on the basis of the performance information D2 when user's spurring or an external stimulus is given while the pet robot 121 is acting autonomously.

The transition rate of the action and motion model at "growth step" is lower than usual when the cover unit 52 has a childish appearance like that of an animation character or a cherished stuffed toy, whereas the transition rate of the action and motion models at "growth step" is higher than usual when the cover unit 52 has an intelligent appearance like that of a police dog.

As a result, the pet robot 121 can act and move as if it were a real animal which stays in "baby period" and "child period" for rather a long time in case of a cover unit 52 manifesting a childish appearance, whereas the pet robot 121 is capable of acting and moving as if it were a real animal which is at a process of "young period" or "adult period" soon reached in case of a cover unit 52 manifesting an intelligent appearance.

The configuration described above makes it possible to realize the robot system having a remarkably enhanced amusement property, because the information storage member 81 which stores the cover setting information D1 related to the above described cover unit 52 is disposed in the cover unit 52, the performance information D2 suitable for the above described cover setting information D1 is selectively read out of the performance information D2 set for a type of the cover unit 53 with the information reading member 75 in the body member unit 53 when the above described cover unit 52 is fitted over the pet robot 121, and an upgrading rate of a growth step of the pet robot 121 is changed in a predetermined changing condition determined on the basis of the above described performance information D2 so that the performance information D2 is reflected on making actual motions and actions of the pet robot 121 in individual styles.

(3-5) Other Embodiments

Note that, in the aforementioned embodiment, through the present invention is applied to the robot system 120 which comprises the pet robot 121 using the growth models as shown in FIG. 20, the present invention is not limited thereto and may be applied to other kinds of robot system which comprises a robot apparatus using other type of growth models.

Further, in the aforementioned embodiment, though the growing speed is changed in accordance with the appearance of the cover unit 53, the present invention is not limited thereto and growth models may be changed dependently on the appearance of the cover unit 53.

(4) Fourth Embodiment (4-1) Configuration of Robot System in this Embodiment

Figure 27:
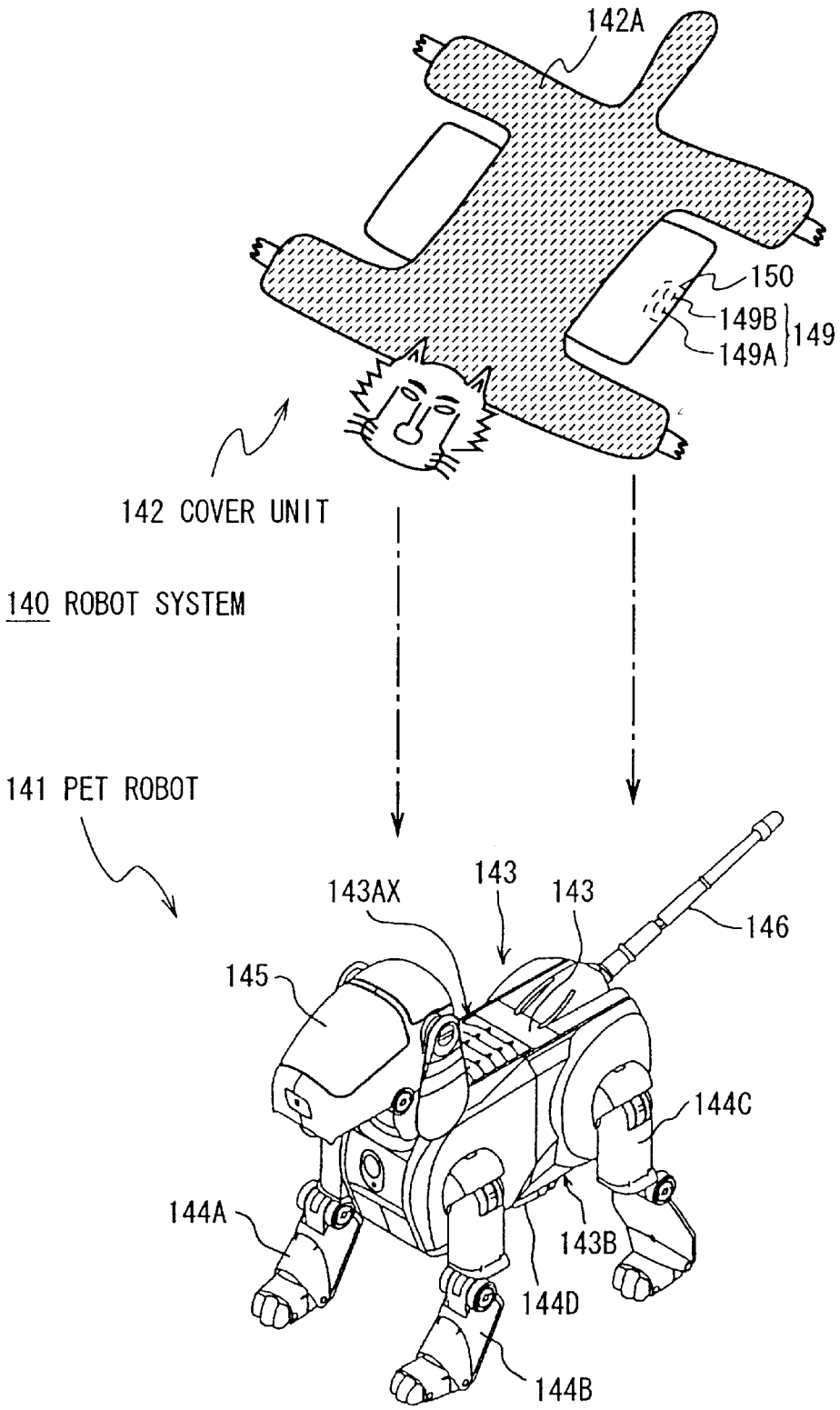
FIG. 27 is a schematic diagram showing a configuration of a pet robot system in a fourth embodiment.

In FIG. 27, reference numeral 140 represents a pet robot system as a whole in this embodiment which is configured to cover a whole surface of a pet robot 141 with a predetermined cover part (hereinafter referred to as a cover unit) 142 by detachably fitting the cover unit 142 over the above described pet robot 141.

The pet robot 141 is actually composed by coupling leg member units 144A through 144D with front right, front left, rear right, rear left portions of a body member unit 143, and connecting a head member unit 145 and a tail member unit 146 to a front end and a rear end of the body member unit 143.

A cooling fan (not shown) is disposed in the body member unit 143, and an air exhaust port 143AX and an air suction port 143BX (FIG. 2) are formed in a top surface 143A and a bottom surface 143B so as to be placed under and above the cooling fan. Accordingly, the pet robot 141 is configured to be capable of lowering an internal temperature of the above described body member unit 143 by exhausting air sucked from the air suction port 143BX, through the body member unit 143 from the air exhaust port 143AX to outside as the cooling fan is driven.

Figure 28:
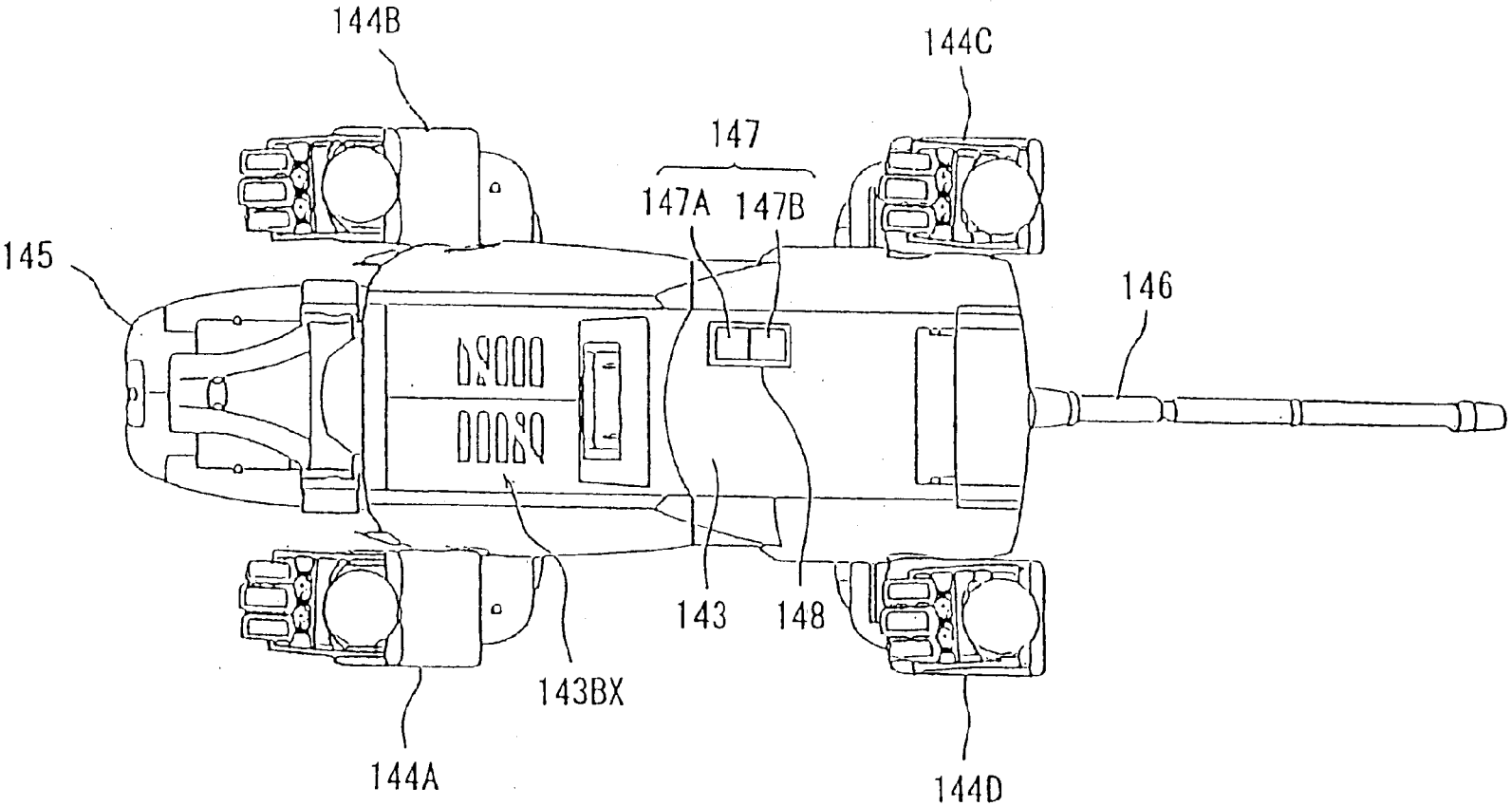
FIG. 28 is a schematic diagram showing a configuration of pet robot shown in FIG. 27.

Furthermore, disposed on a bottom surface 143B of the body member unit 143 is an interface member (hereinafter referred to as a main body side interface member) 148 on which a connector part 147 is composed of a connector half 147A and an engaging mechanism part 147B as shown in FIG. 28.

On the other hand, as shown in FIG. 27, the cover unit 142 is formed by a cover main body 142A made of synthetic fibers resembling a surface skin of a real dog, and disposed at a predetermined location on the back surface of the above described cover main body 142A is an interface member (hereinafter referred to as a cover side interface member) 150 on which a connector part 149 is composed of a connector half 149A and an engaging mechanism part 149B so as to fit the connector half 147A and the engaging mechanism part 147B of the main body side interface member 148 disposed on the body member unit 143.

To fit the cover unit 142 actually over the pet robot 141, the cover main body 142A of the cover unit 142 is fitted so as to cover a whole surface of the pet robot 141, the connector halves 147A and 149A are electrically connected to each other and the engaging mechanism parts 147B and 149B are connected mechanically by connecting the connector part 149 of the cover side interface member 150 to the connector part 147 of the main body side interface member 148.

(4-2) Concrete Configurations of Pet Robot 141 and Cover Unit 142

Figure 29:
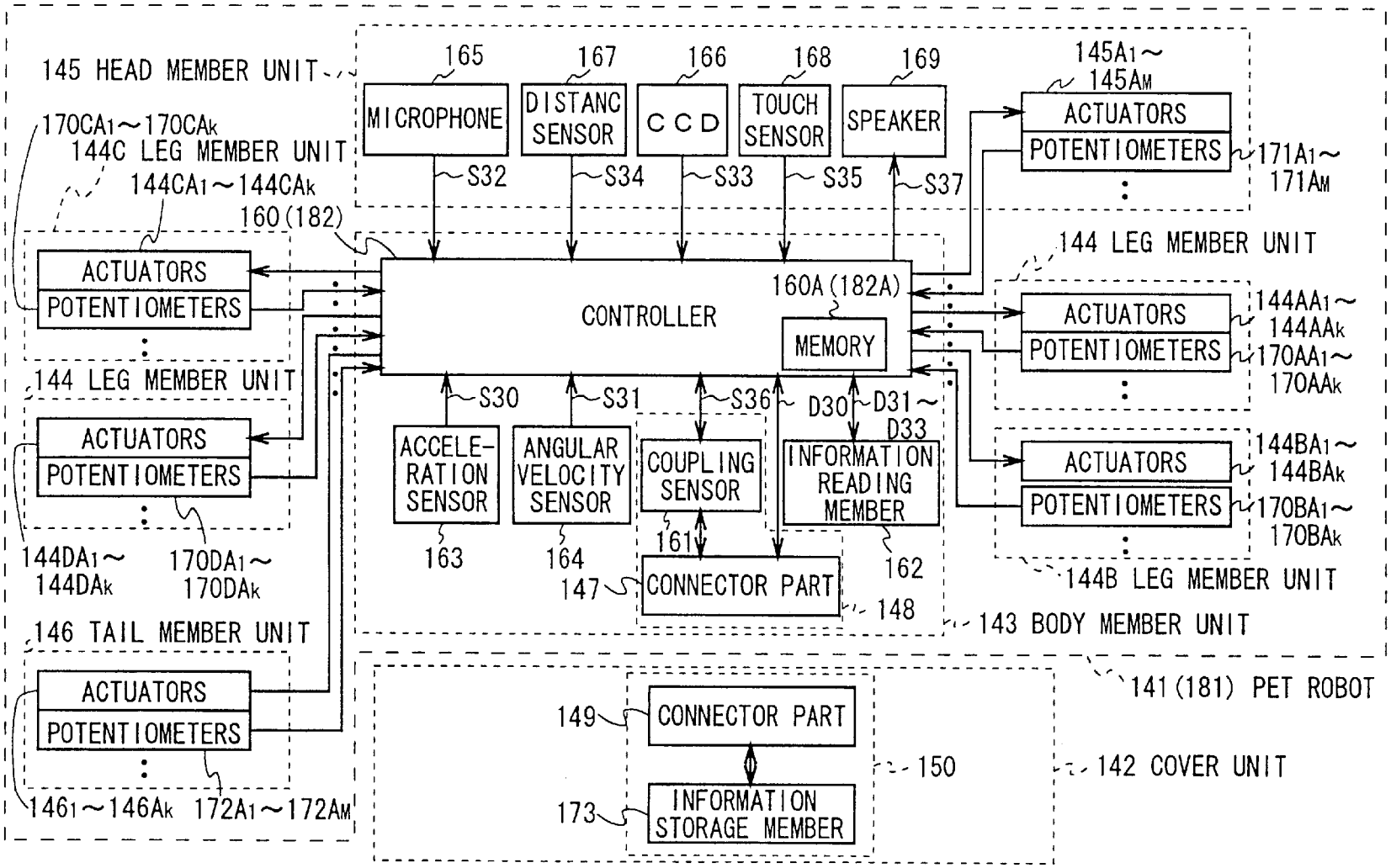
FIG. 29 is a block diagram showing an internal configuration of the pet robot.

In a robot system 1 shown in FIG. 29, accommodated in a body member unit 143 of a pet robot 1141 are a controller 160 which controls motions of the pet robot 141, the main body side interface member 148 which consists of a coupling sensor 161 and a connector part 147, an information reading member 162 which reads out control programs stored in a recording medium (not shown) which is to be inserted from outside, an acceleration sensor 163, an angular velocity sensor 164 and a battery (not shown) which functions as a power source for the pet robot 161.

The acceleration sensor 163 of the body member unit 143 detects accelerations in directions of three axes (X-axis, Y-axis and Z-axis) in a unit of several dozens of milliseconds and sends out the detection result as an acceleration-detection signal S30 to the controller 160. Furthermore, the angular velocity sensor 164 detects rotating angular velocity in directions of three angles (angle R, angle P and angle Y) in a unit of several dozens of milliseconds and sends out the detection result as an angular velocity detection signal S31 to the controller 160.

Disposed at predetermined locations in the head member unit 145 are a microphone 165 which is used as "ears", a CCD (charge coupled device) camera 166 which is used as "eye", a distance sensor 167, a touch sensor 168, a speaker 169 which is used as a "mouth" and so on.

The microphone 165 in the head member unit 145 gathers order sounds such as "walk," "lie down" or "chase a ball" which are given in form of musical scales from a user with a sound commander (a commander which gives sounds in form of musical scales different dependently on contents of operations) (not shown), and sends out the obtained audio signal S32 to the controller 160.

Further, the CCD camera 166 picks up an image of a front situation and sends out the obtained image signal S33 to the controller 160, and the distance sensor 167 composed of an infrared distance sensor or the like measures a distance to a front object and sends out a measurement result as a distance measurement signal S34 to the controller 160.

Furthermore, the touch sensor 168 is disposed on the head member unit 145 as apparent from FIG. 27, and detects pressures applied from the user by physical spurring such as "patting" and "striking," and sends out the detection result as a pressure detection signal S35 to the controller 160.

Furthermore, actuators 144$AA_1$ through 144$AA_K$, 144$BA_1$ through 144$BA_K$, 144$CA_1$ through 144$CA_K$, 144$DA_1$ through 144$DA_K$, 145$A_1$ through 145$A_L$ and 146$A_1$ through 146$A_M$ as well as potentiometers 170$AA_1$ through 170$AA_K$, 170$BA_1$ through 170$BA_K$, 170$CA_1$ through 170$CA_K$, 170$DA_1$ through 170$DA_K$, 171$A_1$ through 171$_L$, $172A_1$ through $172A_M$ are disposed in joint parts of leg member unit 144A through 144D, coupled parts of the leg member unit 144A through 144D and the body member unit 143, a coupled part of the head member unit 145 and the body member unit 143, and a coupled part of a tail member unit 146 and the body member unit 143, etc.

The potentiometers $170AA_1$ through $170AA_K$, $170BA_1$ through $170BA_K$, $170CA_1$ through $170CA_K$, $170DA_1$ through $170DA_K$, $171A_1$ through $171_L$ and $172A_1$ through $172A_M$ detect rotating angles of output shafts of corresponding actuators $144AA_1$ through $^{144AA}{}_K$, $144BA_1$ through $1^{44BA}{}_K$, $144CA_1$ through $144CA_K$, $144DA_1$ through $144DA_K$, $145A_1$ through $145A_L$ and $146A_1$ through $146A_M$, and send out the detection results as angle detection signals to the controller 160.

Furthermore, the main body side interface member 148 of the body member unit 143 is composed of the coupling sensor 161 and the above described connector part 147 comprising the connector half 147A and the engaging mechanism part 147B. The coupling sensor 161 detects a coupling state of the main body side interface member 148 with the cover side interface member 150 of the cover unit 142 and sends out the detection result as a cover detection signal S36 to the controller 160.

The controller 160 judges surrounding conditions and whether or not user's order or spurring exists, on the basis of the audio signal S32, the image signal S33, the distance measurement signal S34, a pressure detection signal S35, the acceleration detection signal S30, the angular velocity detection signal S31, a cover detection signal S36 and so on which are given from the microphone 165, the CCD camera 166, the distance sensor 167, a touch sensor 168, the acceleration sensor 163, the angular velocity sensor 164 and the coupling sensor 161.

On the basis of the judgment result and the control program which is input in advance, the controller 160 determines next actions, and allows the pet robot to take actions such as swinging the head member unit 145 up, down, left and right, moving the tail member unit 146, walking with the leg member units 144A through 144D by driving the actuators $144AA_1$ to $144AA_K$, $144BA_1$ to $144BA_K$, $144CA_1$ to $144CA_K$, $144DA_1$ to $144DA_K$, $145A_1$ to $145A_L$ and $146A_1$ to $146_M$ which are required for actions from the determination result.

At this time, the controller 160 gives a predetermined audio signal S37 to the speaker 169 as occasion demands, thereby allowing the speaker to output sounds based on the audio signal S37 to outside, and turns on or off or flickers LEDs (light emitting diode) (not shown) which are disposed at locations of "eyes" of the pet robot 141.

In this way, the pet robot 141 is capable of acting autonomously on the basis of surrounding conditions, the control programs and the like.

In the cover unit 142, on the other hand, the cover side interface member 150 which is built in a cover main body 142A is composed of an information storage member 173 and the above described connector part 149, and the above mentioned connector part 149 is composed of the connector half 149A and the engaging mechanism part 149B. The engaging mechanism part 149B in the cover side interface member 150 is configured so as to detachably engage with the engaging mechanism part 147B in the main body side interface member 148.

The information storage member 173 in the cover side interface member 150 is composed, for example, of a non-volatile memory such as a ROM (random access memory) in which information representing a manufacturer's ID, information representing a manufacturing license such as a product ID and a lot number determined by a manufacturer, setting information such as enciphered information for authenticating the cover unit (hereinafter referred to as cover setting information) D1 are stored preliminarily for each cover number allocated to each kind of the cover unit 142.

Furthermore, program information for determining performance of the pet robot 141 (hereinafter referred to as performance information) D31 and information representing a mass distribution of each cover (hereinafter referred to as mass distribution information) D32 which are set for each cover number described above according to contents of the cover setting information D30 are stored preliminarily in a recording medium to be inserted into the information reading member 162 disposed in the body member unit 143.

Furthermore, information related to a barycenter location of the pet robot in a standard posture of standing with all four legs stretched with no cover fitted (hereinafter referred to as initial barycenter location information) D33 is preliminarily stored in the information reading member 162.

When the cover side interface member 150 is coupled with the main body side interface member 148, the connector half 149A and the engaging mechanism part 149B disposed on the connector part 149 of the above described cover side interface member 150 are connected electrically and mechanically to the connector half 147A and engaging mechanism part 147B respectively, which are disposed on the connector part 147 of the main body side interface member 148.

Figure 30:
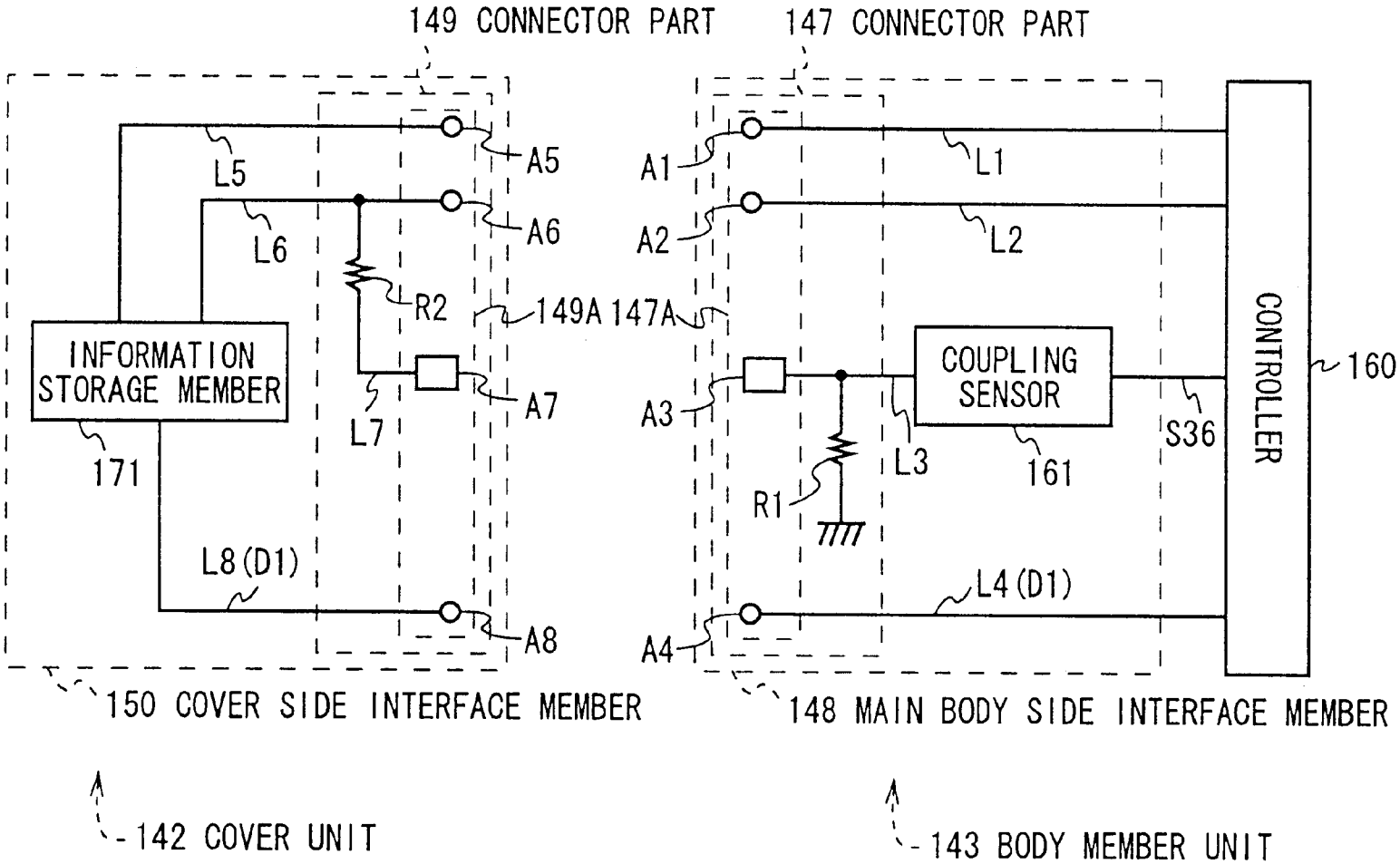
FIG. 30 is a block diagram showing internal configurations of a main body side interface member and a cover side interface member.

Concretely speaking, the main body side interface member 148 and the cover side interface member 150 are configured as shown in FIG. 30.

In the main body side interface member 148, connecting terminals A1 to A4 for a grounding line L1, a power source line L2, a measurement line L3 and a signal line L4 are exposed on the connector half 147A of the connector part 147, and an end of a load resistor R1 which has the other end connected to ground is connected between the connecting terminal A3 and the coupling sensor 161 on the measurement line L3.

In the cover side interface member 150, connecting terminals A5 to A8 for a ground line L5, a power source line L6, a measurement line L7 and a signal line L8 are exposed on the connector part 149, a load resistor R2 is disposed on the measurement line L7 which is drawn from the power source line L6, and ends of the above described load resistor R2 are connected to the information storage member 171 and the connecting terminal A7.

When the connector half 149A disposed on the connector part 149 of the cover side interface member 150 is actually connected to the connector half 147A disposed on the connector part 147 of the main body side interface member 148, the connecting terminals A1 to A4 for the ground line L1, the power source line L2, the measurement line L3 and the signal line L4 on the connector half 147A are brought into contact with and conductive to the connecting terminals A5 to A8 for the corresponding lines L5 to L8 on the connector half 149A.

At this time, the coupling sensor 161 in the main body side interface member 148 detects a voltage value of the load resistor R2 on the measurement line L7 connected to the power source line L6 by way of the connector halves 149A and 147A conductive to each other, between the cover side interface member 150 and the main body side interface member 148, thereby judging a coupling condition of the main body side interface member 148 with the cover side interface member 150 (an "H" level in a coupling condition or an "L" level in a separated condition).

As a result, the controller 160 reads out the cover setting information D30 stored in the information storage member 173 in the cover side interface member 150 only when the detection result of the coupling sensor 161 is affirmative, reads out the performance information D31 from the recording medium inserted into the information reading member 162 in the body member unit 143 on the basis of the above described cover setting information D30, determines an action of the pet robot 141 on the above described performance information D31, and drives the actuators 144$AA_1$ to 146$A_M$ which are required for the determined action, thereby allowing the speaker 169 to output sounds as occasion demands.

As described above, when the cover unit 142 is fitted, the pet robot 141 is capable of autonomously changing actions with the individuality according to the cover setting information D30 stored in the information storage member 173 in the cover side interface member 150 of the above described cover unit 142 and the performance information D31 stored in the recording medium which is read out with the information reading member 162 in the body member unit 143 on the basis of the above described cover setting information D30.

In addition to the configuration described above, the controller 160 corrects, at a stage to allow the pet robot 141 to act, an error of a location of the barycenter of the pet robot 141 (that is, modifies standard values of control parameters under influence due to the barycenter) before and after fitting the cover unit 142, on the basis of the acceleration detection signal S30, the angular velocity detection signal S31, the image signal S33, the distance measurement signal S34 and the like which are supplied from the acceleration sensor 163, the angular velocity sensor 164, the CCD camera 166 and the distance sensor 167.

Description will be made below of processing performed by the controller 160. First, various kinds of parameters for walking control of the pet robot 141 will be described. In case of the pet robot 141, the walking control is carried out on the basis of a control program described with 22 parameters which are stored in the information reading member 22 of the body member unit 143 as shown in FIG. 31.

These parameters consist of parameters for determining a standard walking posture, parameters for determining movements of the leg member units 144A through 144D and parameters for determining entire movements of a body. These parameters will be described below.

Figure 32:
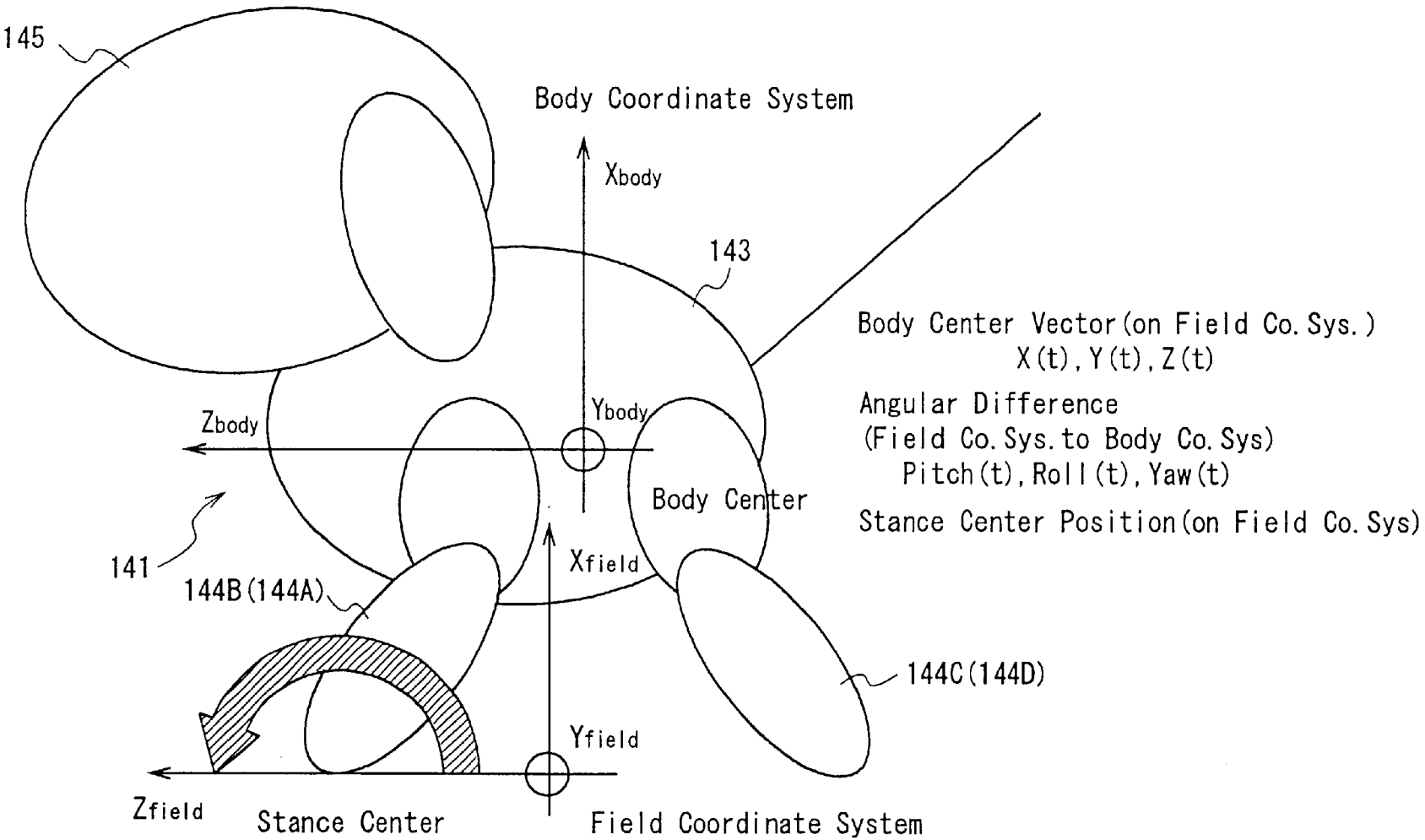
FIG. 32 is a schematic diagram showing standard walking postures.

First, a center coordinate is set in the body member unit 143 of the pet robot 141 in a standard posture of standing with all the four legs stretched, as shown in FIG. 32. When the center coordinate is set relative to an absolute coordinate system, the pet robot stoops with the leg member units 144A through 144D bent in a standard walking posture, whereby the above described center coordinate moves in an up-down direction and a back-forth direction in the absolute coordinate system. Values of movements are controlled with parameters of "body center x" and "body center z."

In this standard walking posture, the body member unit 143 is not only translated but also inclined forward or backward and this inclination is controlled with a parameter of "body pitch."Furthermore, grounding locations for the leg member unit 144A through 144D also influence walking in the standard walking posture. In order to reduce the number of parameters, an offset in an astride direction is set at an identical value for the front and rear leg member units 144A through 144D and controlled with a parameter of "all legs y."

Furthermore, offsets in the back-forth direction of the front leg member units 144A, 144B and the rear leg member units 144C, 144D are controlled with parameters of "front legs z" and "rear legs z" respectively. These are the parameters for the standard walking posture.

Figure 33:
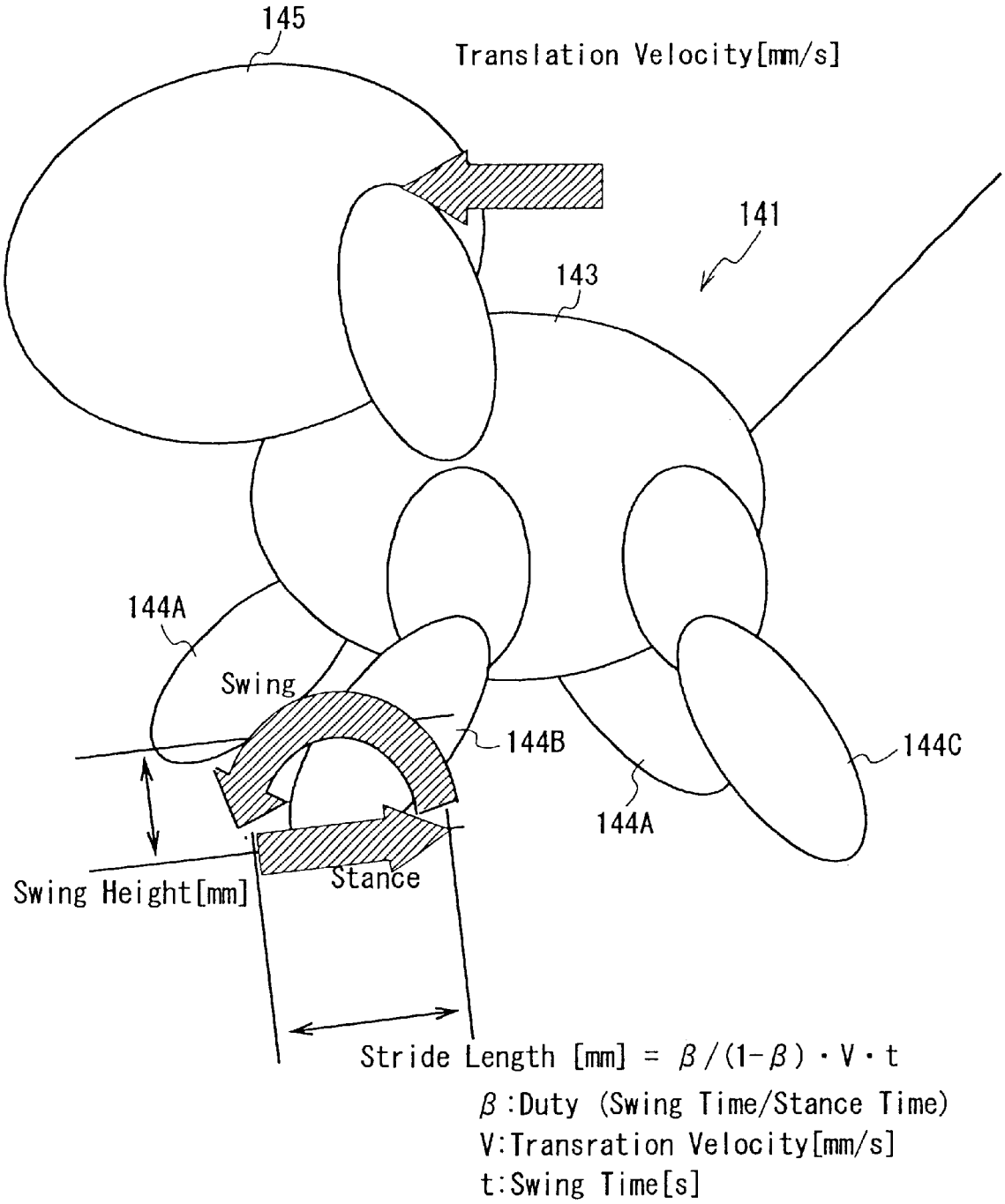
FIG. 33 is a schematic diagram descriptive of movements of one leg member unit.

On the other hand, control parameters used to control movements of the leg member units 144A through 144D are as described below. FIG. 33 shows simplified movements of one leg member unit 144A to 144D.

First, a parameter for determining a length of a walking step is determined as "step length." Furthermore, a height and a time of raising the leg member units 144A through 144D at a swinging-leg time are controlled with parameters of "swing height" and "swing time" respectively.

"swing multi" is a parameter which represents a ratio of a grounding time to a swinging-leg time at one cycle of a leg, and this parameter controls the grounding time and the swinging-leg time of each of the leg member units 144A through 144D. This parameter can be used also as a parameter for controlling a rising manner of the leg member units 144A through 144D when transition processing from a crawl walking style (static walking) to a trot walking style (dynamic walking) or to a pace walking style (dynamic walking), for example, is performed with a different algorithm.

Walking safety and speed can be improved by adding relatively backward, forward, leftward and rightward translations or rotating movements such as rolling, pitching and yawing to movements of the body member unit 143 of the pet robot 141 at a walking time. These movements are controlled with parameters of "ample body x," "ample body y" "ample body z," "ample roll," "ample pitch" and "ample yaw".

"min. gain," "shift" and "length" are parameters for determining control related to PID control gains of the actuators (servo motors) 144$AA_1$ through 146$A_M$ which are used for walking motions of the pet robot 141. A possibility to walk smoothly is obtained by giving such soft PID gains so as to absorb shocks at a grounding time with these parameters. Only a P gain out of the PID gains is actually controlled with the following equation:

$$\text{gain}=\text{gmin}+(\text{gmax}-\text{gmin})\times(1-\sin(\text{leg phase}-\text{shift})) \quad (1)$$

"leg phase" has a [shift,+length] as a range of values. That is, the P gain has a value which changes from "g min" to "g max" while tracing a sine curve and a phase which is maximum at a location given by a parameter of "shift." However, "g max" is preliminarily given and the phase is configured so that the leg member rises forward at 0[°], scratches the ground backward at 180[°] and returns to an initial position at 360[°].

Figure 34:
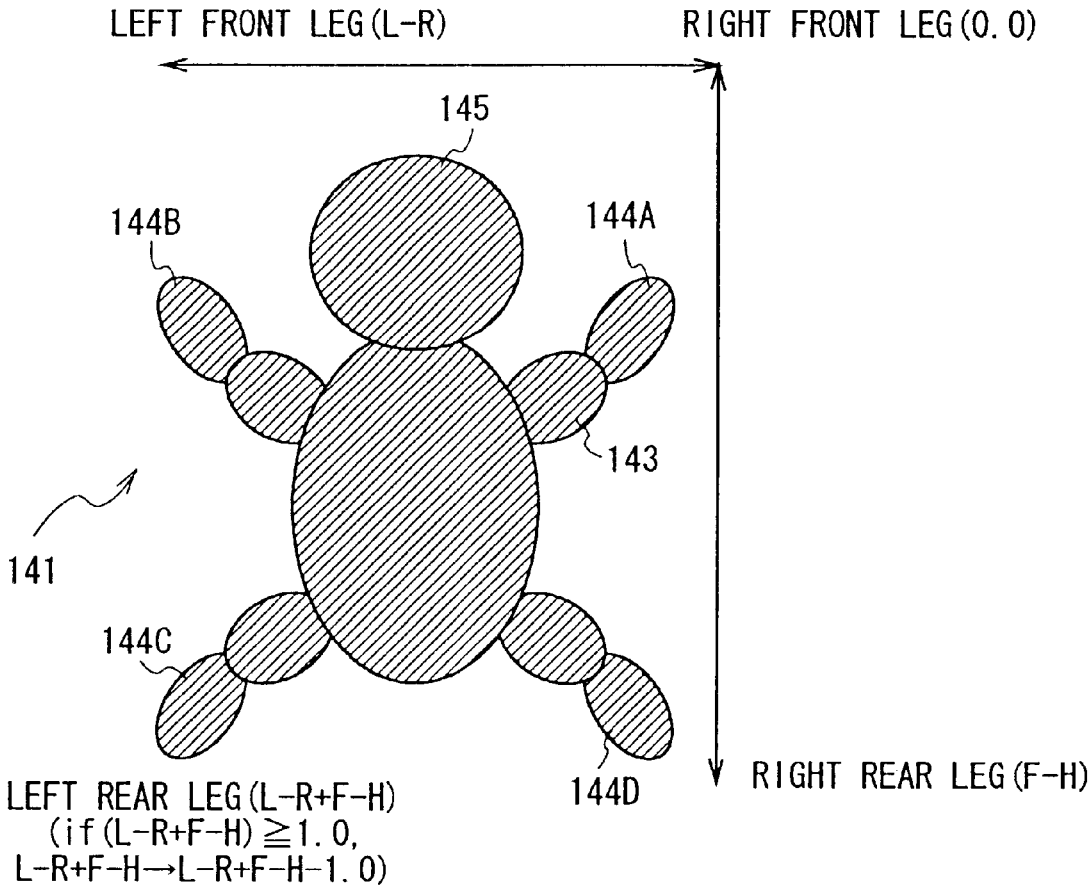
FIG. 34 is a schematic diagram descriptive of parameters.
Figure 35:
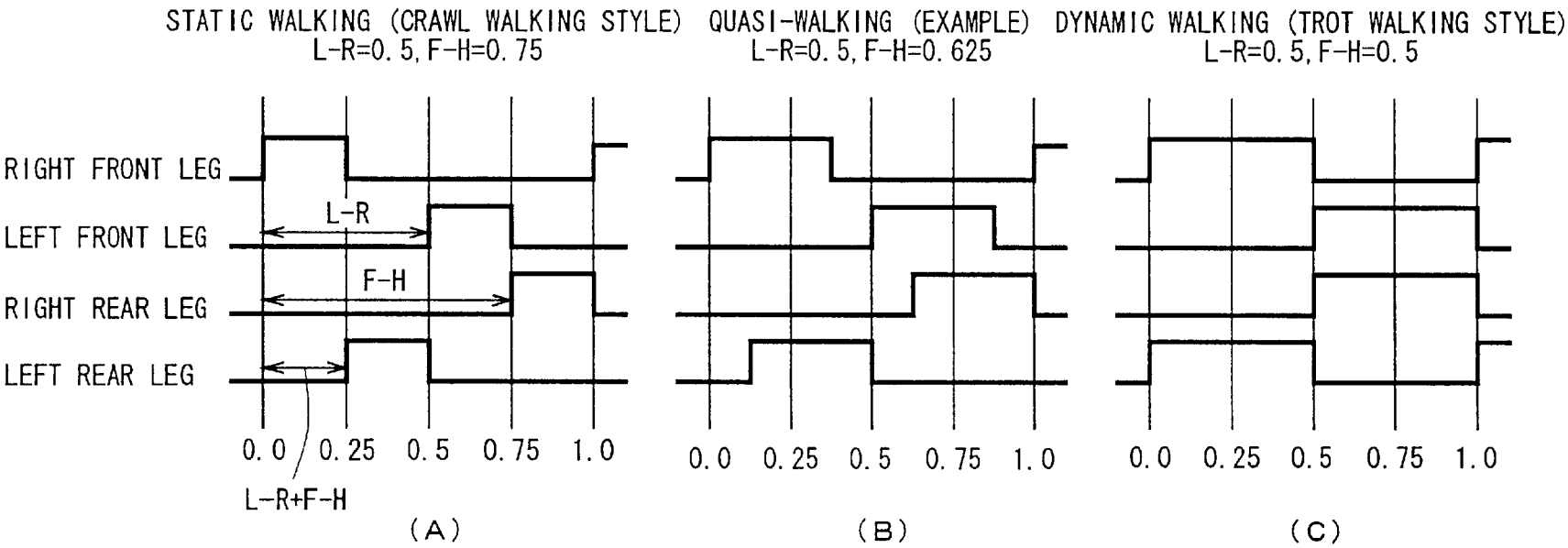
FIG. 35 is a timing chart showing phase relationship of the parameters in various kinds of walking styles.

"L-R" and "F-H" are parameters which represent a ratio for one cycle of walking motion of a time from starting to swing each leg member unit 144A to 144D till starting swinging the left-front leg member unit 144B or the right rear leg member unit 144D, taking the right front leg member unit 144A as a standard, as shown in FIGS. 34 and 35, and the ratios in case of the static walking (crawl walking style), a quasi-walking and the dynamic walking (trot walking style) are shown in FIGS. 35(A), 35(B) and 35(C) respectively.

Figure 36:
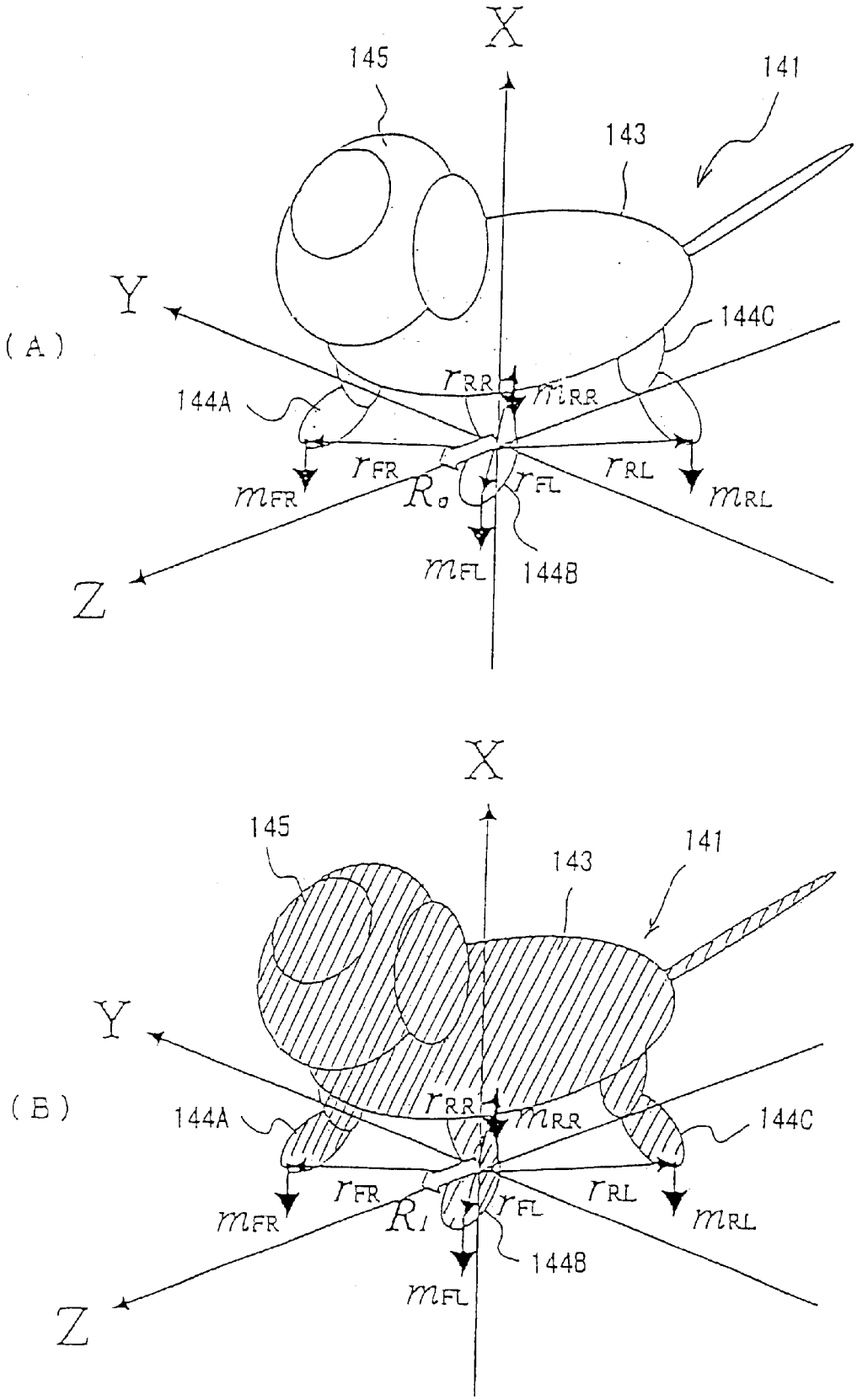
FIG. 36 is a schematic diagram descriptive of barycenter locations before and after fitting a cover.
Figure 37:
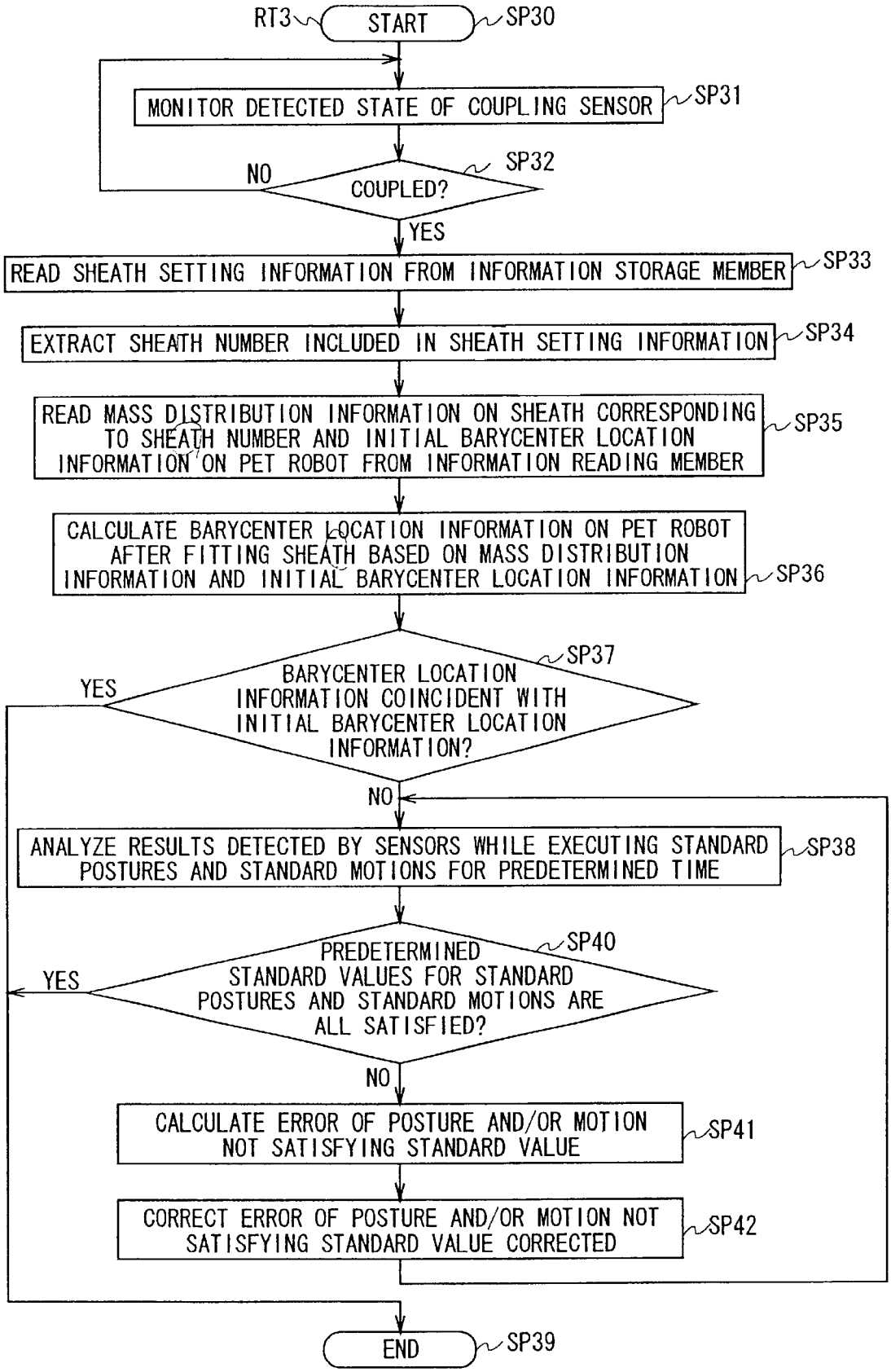
FIG. 37 is a flow chart descriptive of a calibration processing procedure in the fourth embodiment.

When loads imposed on grounding locations of the left, right front leg member units and the left, right rear leg member units 144A through 144D and direction vectors around the above described center coordinate of the pet robot 141 in the standard posture of standing with all the four legs stretched and with the cover unit 142 not fitted are represented by $m_{FL}$, $m_{FR}$, $m_{RL}$, $m_{RR}$ and $r_{FL}$, $r_{FR}$, $r_{RL}$, $r_{RR}$ respectively as shown in FIG. 36(A), a vector $R_0$ representing a barycenter of the pet robot 141 is expressed by the following equation:

$$R_0 = \frac{m_{FR} * r_{FR} + m_{FL} * r_{FL} + m_{RR} * r_{RR} + m_{RL} * r_{RL}}{m_{FR} + m_{FL} + m_{RR} + m_{RL}} \quad (2)$$

When a mass of the cover unit 142 is represented by M as shown in FIG. 36(B), loads $m_{FL}'$, $m_{FR}'$, $m_{RL}'$, and $m_{RR}'$ imposed on the grounding locations of the left front, right front, left rear, right rear leg member units 144A through 144D with the cover unit 142 fitted over the pet robot 141 are in relationship expressed by the following equation:

$$(m_{FL}'+m_{FR}'+m_{RL}'+m_{RR}')=M+(m_{FL}+m_{FR}+m_{RL}+m_{RR}) \quad (3)$$

Accordingly, a vector $R_1$ representing the barycenter location of the pet robot 141 with the cover unit 142 fitted is expressed by the following equation:

$$R_1 = \frac{m_{FR} * r_{FR} + m_{FL} * r_{FL} + m_{RR} * r_{RR} + m_{RL} * r_{RL}}{m_{FR} + m_{FL} + m_{RR} + m_{RL}} \quad (4)$$

Accordingly, an error vector E of the barycenter location of the pet robot 141 before and after fitting the cover unit 142 is expressed by the following equation:

$$E=R_1-R_0 \quad (5)$$

By modifying the above described parameters related to walking so as to zero a value of the error vector E, the pet robot 141 can walk with good balance after the cover unit 142 is fitted, like the pet robot 141 before the cover unit 142 is fitted.

For example, in case of the error vector E=(0, 0, 5), that is, when the barycenter location of the pet robot 141 is shifted by 5 millimeters in a direction of the Z-axis after fitting the cover unit 142, walking can be controlled so as to be stable by modifying the parameters ("body center z," "front legs z" and "rear legs z") related to walking.

(4-2) Calibration Processing Procedure RT3 at Cover Fitting Time

When the cover unit 142 is actually fitted, the controller 160 in the pet robot 141 actually enters a calibration processing sequence RT3 shown in FIG. 11 from step SP30, and while monitoring a state detected by the coupling sensor 161 in the main body side interface member 148 of the body member unit 143 at successive step SP31, proceeds to step SP32 and judges whether or not the cover side interface member 150 in the cover unit 142 has been connected electrically and structurally, on the basis of a result detected by the above described coupling sensor 161.

At this step SP32, the controller 160 waits until an affirmative result is obtained, proceeds to step SP33, reads out the cover setting information D30 from the information storage member 173 in the cover side interface member 150 of the cover unit 142, proceeds to successive step SP34 and extracts a cover number included in the above described cover setting information D30.

Successively, the controller 160 reads out the mass distribution information D32 corresponding to the above described cover number from the information reading member 162 in the body member unit 143 and reads out the initial barycenter location information D33 set in the pet robot 141 at step SP35, and then proceeds to step SP36.

At this step SP36, the controller 160 calculates information related to the barycenter location of the pet robot 141 in the standard posture of standing with the cover unit 142 fitted and with all the four legs stretched (hereinafter referred to simply as barycenter location information) on the basis of the mass distribution information D32 and the initial barycenter location information D33 and proceeds to step SP37.

At this step SP37, the controller 160 judges whether or not the barycenter location information calculated after fitting the cover unit 142 is identical to the initial barycenter location information D33, proceeds to step SP38 when a negative result is obtained, and while allowing the pet robot 141 to execute the standard postures (posture with all the four legs stretched, a sitting posture at a charging time or the like) and standard motions (walking motion, sitting motion or the like) on the basis of the performance information D31 for a fixed period of time, analyzes the acceleration detection signal S30, the angular velocity detection signal S31, the image signal S33 and the distance measurement signal S34 supplied from the acceleration sensor 163, the angular velocity sensor 164, the CCD camera 166 and the distance sensor 167 respectively.

On the contrary, when an affirmative result is obtained at the step S36 which indicates that the barycenter location of the pet robot 141 is not changed in the standard posture of standing with all the four legs stretched even before and after fitting the cover unit 142, the controller 160 proceeds directly to step SP39 to terminate the calibration processing procedure RT3.

Then, the controller 160 proceeds to step SP40 and judges whether or not a balance state in the standard postures and the standard motions based on the performance information D31 satisfies predetermined standard values on the basis of a analysis result of the detection signals S30, S31, S33 and S34 obtained from the sensors 163, 164, 166 and 167. In this case, each standard value is calculated by the controller 160 for each of the standard postures and the standard motions on the basis of the above described initial barycenter location information D33.

When a negative result is obtained at this step SP40 which indicates that a posture or motion which does not meet the standard value exists among the standard postures and the standard motions based on the performance information D31, the controller 160 proceeds to step SP41, calculates an error of the posture and/or motion which does not meet the standard value and proceeds to step SP42.

At this step SP42, the controller 160 calculates the error of the posture and/or the motion which does not meet the above described standard value and returns once again to the step SP38 to repeat processing similar to those described above (such correction will hereinafter be referred to as correction by calibration)

When an affirmative result is obtained at the step SP40 which indicates that all the standard postures and the standard motions on the basis of the performance information D31 satisfy the standard values, on the other hand, the controller 160 proceeds directly to the step SP39 to terminate the above described calibration processing procedure RT3.

Thereafter, the controller 160 is capable of allowing the pet robot 141 with the cover unit 142 fitted to execute autonomous actions and motions on the basis of the performance information D31 while balancing the pet robot 141 in a state similar to that before fitting the above described cover unit 142.

(4-3) Operations and Effects of Fourth Embodiment

When a cover unit 142 desired by the user is fitted over the pet robot 141 in the robot system 140 having the above described configuration, the pet robot 141 calculates the mass distribution information D32 stored in the information reading member 162 in the body member unit 143 and the barycenter location information of the pet robot 141 in the standard posture after fitting the cover unit 142, on the basis of the cover setting information D30 obtained from the cover unit 142.

When the barycenter location of the pet robot 141 before fitting the cover unit 142 is different from that after fitting the cover unit 142, the controller 160 compares the postures and/or the motions of the pet robot 141 with those before fitting the cover unit 142 while allowing the pet robot 141 to take the standard postures and the standard motions based on the performance information D31, and when an error is made, the controller 160 corrects the error, whereby the controller 160 is capable of allowing the pet robot 141 to act and move autonomously with good balance after the cover unit 142 is fitted as in a state before fitting the cover unit 142, even when the barycenter location of the pet robot 141 changes after fitting the cover unit 142. As a result, the robot system 140 easily allows the cover units 142 having various mass distributions to be fitted over the pet robot 141.

The robot system having the above described configuration is configured to calculate an error of a barycenter location of the pet robot 141 from that before fitting the cover unit 142 while allowing the pet robot 141 to take the standard postures and the standard motions and to correct the error (that is, perform the correction by calibration) after fitting the cover unit 142, thereby being capable of preventing actions and motions of the pet robot 141 from being unbalanced even when cover units 142 having various mass distributions are fitted and making it possible to easily attach various kinds of cover units 142 to the pet robot 141 and realize the robot system which can remarkably improve an amusement property.

Figure 38:
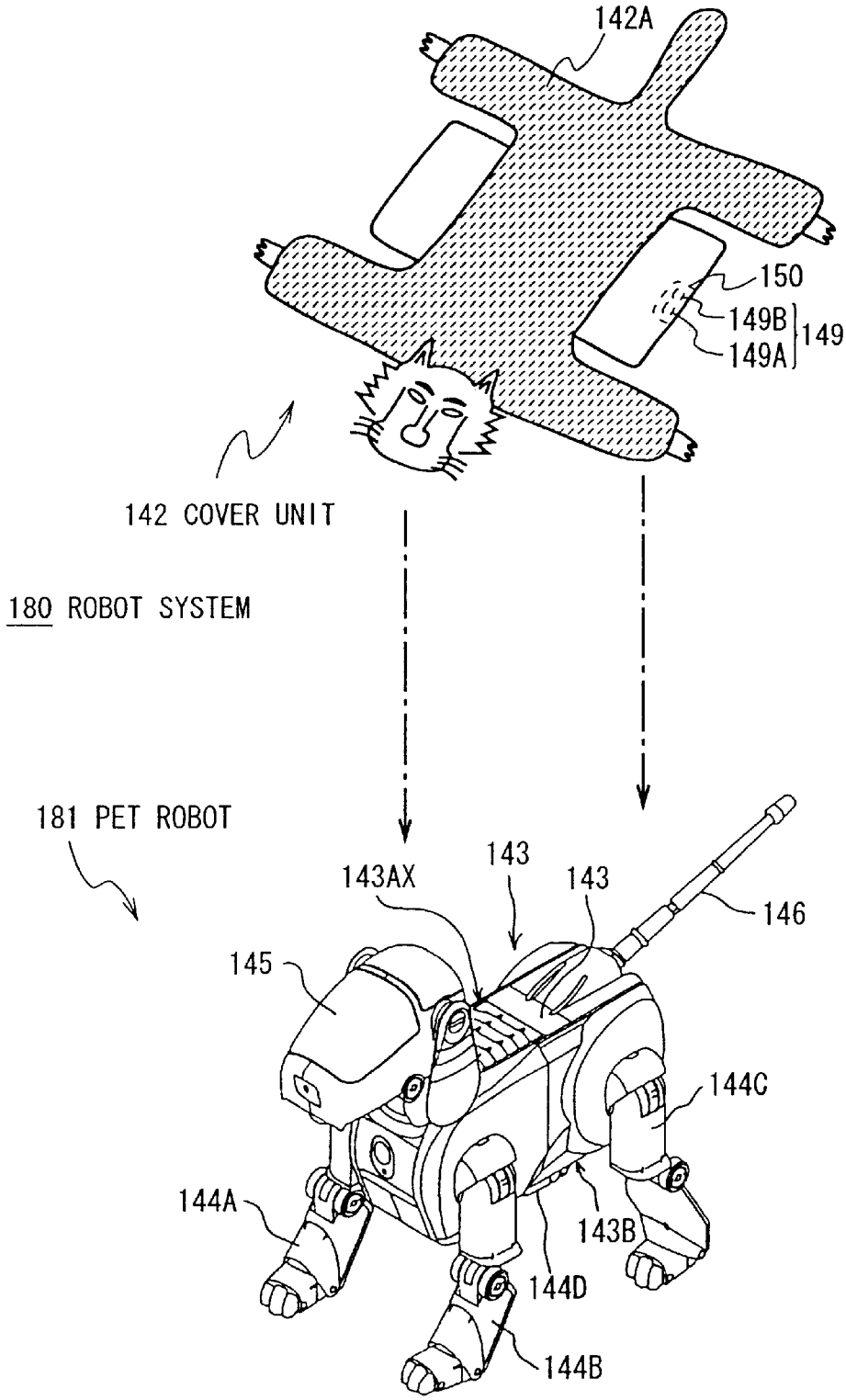
FIG. 38 is a schematic diagram showing a configuration of a pet robot system in a fifth embodiment.

(5) Fifth Embodiment (5-1) Configuration of Robot System 180 in Fifth Embodiment FIG. 38 in which the same reference numerals are applied to parts corresponding to those in FIG. 27 shows a robot system 180 in the fifth embodiment. A pet robot 181 is configured as in the fourth embodiment described above, except that the mass distribution information D32 of cover units 142 is not stored for each cover number of the cover units 142 in a recording medium which is to be inserted into an information reading member 162 (FIG. 28) disposed in a body member unit 143 of the pet robot 181 and the aforementioned calibration processing is performed without the mass distribution information D32 of the pet robot 141.

(5-2) Calibration Processing Procedure RT2 at Cover Fitting Time

Figure 39:
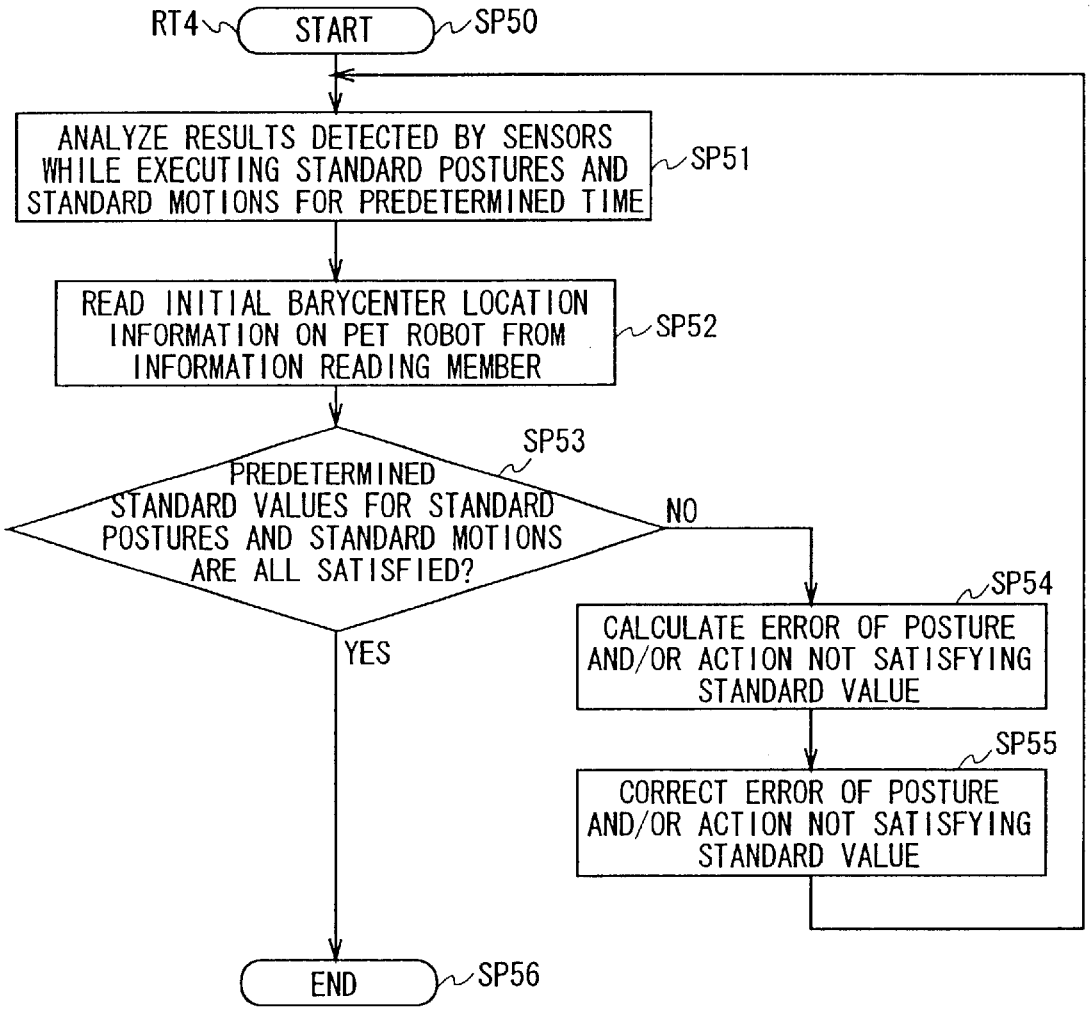
FIG. 39 is a flow chart descriptive of a calibration processing procedure in the fifth embodiment.

When the cover unit 142 is actually fitted, a controller 182 (FIG. 29) in the pet robot 181 enters the calibration processing procedure RT4 shown FIG. 39 from step SP50, and at successive step SP51, the controller 182 analyzes an acceleration detection signal S30, an angular velocity detection signal S31, an image signal S33 and a distance measurement signal S34 which are supplied from an acceleration sensor 163, an angular velocity sensor 164, a CCD camera 166 and a distance sensor 167 respectively while allowing the pet robot 181 to execute standard postures and standard motions based on the performance information D31 for a fixed period of time.

Successively, the controller 182 proceeds to step SP52, reads initial barycenter location information D33 set in the pet robot 181 from the information reading member 162 in the body member unit 143 and proceeds to step SP53.

At this step SP53, the controller 182 judges whether or not balance states in the standard postures and the standard motions based on the performance information D31 satisfy predetermined standard values, on the basis of analysis results of the detection signals S30, S31, S33 and S34 obtained from the sensors 163, 164, 166 and 167. In this case, each standard value is calculated by the controller 182 for each of the standard postures and the standard motions on the basis of the above described initial barycenter location information D33.

When a negative result is obtained at this step SP53 which indicates that a posture and/or a motion which does not satisfy the standard value exists among the standard postures and the standard motions based on the performance information D31, the controller 182 proceeds to step SP54, calculates an error of the posture and/or the action which does not satisfy the above described standard values and proceeds to step SP55.

At this step SP55, the controller 182 corrects the error of the posture and/or the motion which does not satisfy the standard values, returns once again to the step SP51 and repeats correction processing by calibration similar to that described above.

When an affirmative result is obtained at the step SP53, on the other hand, which indicates that the standard values are satisfied by all the standard postures and the standard motions based on the performance information D31, the controller 182 proceeds directly to step SP56 to terminate the above described calibration processing procedure RT4.

Thereafter, the controller 182 is capable of allowing the pet robot 181 with the cover unit 142 fitted to execute autonomous actions and motions on the basis of the performance information D31 while balancing in a state which is the same as those before fitting the above described cover unit 142.

(5-3) Operations and Effects of Fifth Embodiment

The pet robot system 180 having the above described configuration is configured to, when a user fits a desired cover unit 142 over the pet robot 181, compare postures and motions of the pet robot 181 with those before fitting the cover unit 142 while allowing the pet robot 181 to take the standard postures and the standard motions based on the performance information D31 and to correct an error if there is the error, thereby being capable of allowing the pet robot 181 to act and move autonomously with good balance after the cover unit 2 is fitted as before fitting the cover unit 142 even when the barycenter location of the pet robot 181 is changed after fitting the cover unit 142.

As a result, the pet robot system 180 makes it possible to easily apply a cover unit 142 having various mass distributions to the pet robot 181.

Furthermore, even a cover unit which is newly manufactured can easily be adapted to the pet robot 181 since it is unnecessary to preliminarily store information related to a mass distribution for each cover unit in the information reading member 162 in the body member unit 143.

The pet robot system 180 having the above described configuration is configured to calculate an error of a barycenter location of the pet robot 181 from that before fitting the cover unit 142 while allowing the pet robot 181 to take the standard postures and the standard motions, and correct the error (that is, perform the correction by calibration) after the cover unit 142 is fitted, thereby being capable of preventing actions and motions of the pet robot 181 from being unbalanced even when the cover units 3 having various mass distributions are fitted and making it possible to easily apply various kinds of cover units 142 to the pet robot 181 and to realize the pet robot system which can remarkably improve an amusement property.

(5-4) Other Embodiments

Note that, though the present invention is applied to the quadruped walking type pet robot 141, 181 as shown in FIG. 27 in the above described embodiment, the present invention is not limited by the embodiments and is widely applicable to robot apparatuses having other various configurations so far as the robot apparatuses have movable members which manifests predetermined actions.

Further, though the cover unit 142 which is composed of the cover main body 142A made of synthetic fibers having a form like a surface skin of a real dog is used as the cover detachably fitted over the pet robot 141, 181 as shown in FIG. 27 in the above described embodiments, the present invention is not limited by the embodiments and a cover of which the shape looks like a surface skin of another animal (cat, raccoon dog, horse, monkey, man or the like) may be made of other various kinds of materials (fur, textile, ceramic, synthetic resin, metal and so on).

Further, though a cover main body member 142A composed of a one-piece molding of synthetic fibers which has a shape like a surface skin of an animal is applied as the cover main body member 142A composing the cover unit 142, the present invention is not limited by this cover main body member 142A and cover parts made of metal (not shown) corresponding to portions of the pet robot 141 may be disposed separately. In this case, a plurality of cover parts consist of a head member, a body member, leg members and shank members, and the above described cover side interface member 150 is disposed in the body member. Various kinds of material in addition to metal (synthetic fibers, furs, textures, ceramics, synthetic resin or the like) may be widely used as materials for the cover parts.

Further, though the controller 160, 182 disposed in the body member unit 143 of the pet robot 141, 181 as control means determines the performance information D31 corresponding to the cover number included in the above described cover setting information D30 on the basis the cover setting information D30 allocated to the above described cover unit 142 when the cover unit 142 is fitted over the pet robot 141, 181 in the fourth and fifth embodiments described above, the present invention is not limited by the embodiments and contents of the performance information D31 may be changed on the basis of the cover setting information D30.

Further, though description has been made of a case in which information representing the cover number and the manufacturing license is applied as the cover setting information D30, the cover setting information may include information related to a kind, a form, a material, a mass distribution, hardness and a heat conductivity as well as information related to an individuality, motions and actions of the above described cover unit 142. In this case, the controller 160, 182 as the control means for the pet robot 141, 181 may be configured to determine actions of the pet robot 141, 181 on the basis of only the cover setting information D31 read out with the information reading member 165, to drive the actuators 144$AA_1$ through 146$A_M$ which are required for the determined actions and to allow the speaker 169 to give sounds as occasion demands.

Further, though the cover side interface member 150 and the main body side interface member 148 are configured as a means for connecting the cover unit 142 to the pet robot 141, 181 electrically and structurally when the cover unit 142 is fitted over the pet robot 141, 181 in the fourth and fifth embodiments described above, the present invention is not limited by the embodiments and other various configurations may be widely applied means so far as a cover unit can be detachably connected.

Though the information storage member 173 is disposed in the cover unit 142 and inherent information allocated to the cover unit 142 is stored in the above described information storage member 173 in the above described embodiments, the present invention is not limited by the embodiments and a characteristic item (mark, bar code, predetermined concavo-convex pattern or protruding end having a special form) corresponding to the inherent information is formed at locations for connection to the pet robot 141, 181, without disposing the information storage member 173 in the cover unit 142, so that the inherent information is recognized by reading the characteristic item at the locations for connection to the pet robot 141, 181. Furthermore, usable as the storage means is not only a non-volatile memory which stores the inherent information but also a passive element such as a resistor or an element which magnetically stores the inherent information and a light emitting pattern of a light emitting diode (LED) may be used as the inherent information.

Further, as to the controller 160, 182 of the pet robot 141, 181 in the aforementioned fourth and fifth embodiments, the information reading member 162 reads out the performance information D31 from a recording medium (not shown) inserted from the outside, and sends it to the controller 160, 182, however, the present invention is not limited thereto and a receiving device may be used as an information reading means to receive and download the performance information D31 which is given from the outside.

Further, in the aforementioned fourth and fifth embodiments, though the controller 182 which is disposed as the control means in the pet robot 141, 181 judges, on the basis of the analysis results of the detection signals S30, S31, S33 and S34 obtained from the acceleration sensor 163, the angular velocity sensor 164, the CCD camera 166 and the distance sensor 167 which are disposed as an error detection means, whether or not the standard values determined on the basis of the initial barycenter location information D33 are satisfied by the standard postures and the standard motions, while allowing the pet robot 141, 181 to execute the standard postures and the standard motions based on the performance information D31, on the basis of cover setting information D30 given from the cover unit 142, the present invention is not limited by the embodiments and control means having other various configurations may be used so far as the controller 160, 182 is capable of detecting amounts of influences on actions of the component units (movable members) 143 through 146 due to the cover unit 142.

In this case, though the amounts of influences on actions of the component units (movable members) 143 to 146 due to the cover unit 142 are calculated as the control error between before and after fitting the cover unit 142 using the above described sensors 163, 164, 166 and 167 and then the above described errors are corrected, the present invention is not limited by the embodiments and amounts of influences on motions of the component units (movable members) 143 through 146 after fitting the cover unit 142 may be detected using various kinds of sensors, for example, the potentiometers 170$AA_1$ through 172$A_M$ and the touch sensor 168.

Further, in the aforementioned fourth and fifth embodiments, though the standard values for the standard postures and the standard motions based on the performance information D31 are set by the controller 160, 182 disposed as control means, on the basis of the initial barycenter location information D33 set in the pet robot 141, 181, the present invention is not limited by the embodiments and standard values for the standard postures and the standard motions based on the performance information D31 may be preliminarily set for each cover unit 142.

Further, in the aforementioned fourth and fifth embodiments, though the mass distribution information D32 included in the cover setting information D30 is judged on the basis of the initial barycenter location information D33 to move the pet robot 141, 182 with good balance, the present invention is not limited thereto and each unit of the pet robot 141, 181 may be moved without influence due to the cover unit 142 by judging information about the forms of the entire pet robot 141, 181 and each unit, the movable range of each actuator 144$AA_1$ to 146$A_M$, the link length, and the restricted degree of freedom, as long as when the cover unit 142 is fitted over the pet robot 141, 181, the controller 160, 182 as control means drives each component unit (movable members) 143 to 146 to detect the amount of influence on motions after fitting the cover unit 142 and the motion manifesting pattern can be changed based on the detection result when occasion demands.

In this case, after the cover unit 142 is fitted, the controller 160, 182 may calculate the movable range of each actuator 144$AA_1$ to 146$A_M$ on the basis of the detection result of degrees of the corresponding potentiometers 170$AA_1$ to 172$A_M$ while allowing the pet robot 141, 181 to execute the standard postures and the standard motions and each actuator 144$AA_1$ to 146$A_M$ may be moved within the movable range.

Further, the pet robot 141, 181 may be moved with good balance and each cover unit of the pet robot 141, 181 may be moved without influence due to a cover unit 142 by judging information about moment of inertia of each leg member unit 144A to 144D, focus characteristics and field degree of vision of the CDD camera 166, listening characteristics of the microphone 165, and touching characteristics of the touch sensor 168.

Further, in the aforementioned fourth and fifth embodiments, though the controller 160, 182 in the body member unit 143 is used as a control means for driving the actuators (movable members) 144$AA_1$ to 146$A_M$ so that the pet robot 141, 181 is in a predetermined posture and motion (motion pattern and walking pattern) when the cover unit 142 is fitter over the pet robot 141, 181, the present invention is not limited thereto and the control means having other various configuration may be used as far as it can make the pet robot 141, 181 execute the predetermined postures and/or motions.

(6) Sixth Embodiment (6-1) Configuration of Robot System in this Embodiment

Figure 40:
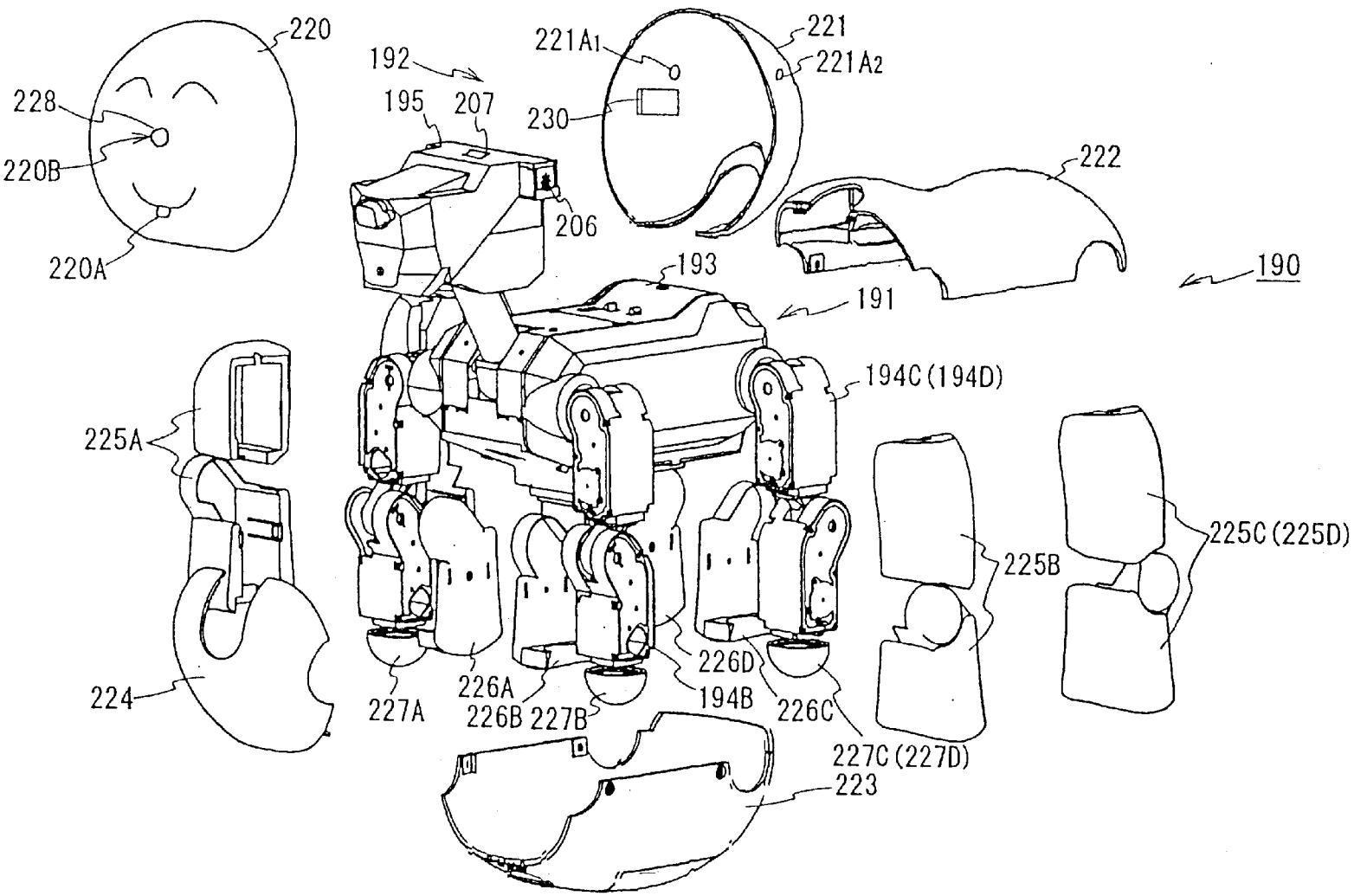
FIG. 40 is a schematic embodiment showing a pet robot system according to a sixth embodiment.

In FIG. 40, a reference numeral 190 shows a robot system as a whole in this embodiment and this system is composed of a robot body 191 and a cover unit 192 which is to be attached to the robot body 191.

In the robot body 191, leg member units 194A to 194D are connected to the front right, front left, rear right, and rear left of a body member unit 193 and a head member unit 195 is connected to the front end of the body member unit 193.

In this case, the body member unit 193 contains a controller 200 which controls the entire motions of the robot body 191, a battery 201 which is a power supply to the robot body 191, and an internal sensor member 204 which is composed of a battery sensor 202 and a heat sensor 203.

In addition, disposed at the head member unit 195 are a CDD camera 205 which is used as actual "eyes" of the robot body 191, a microphone 206 which is used as "ears", an external sensor member 209 which is composed of a touch sensor 207 and a distance sensor 208, a speaker which is used as a "mouth" and so on.

Further, actuators 211$_1$ to 211$_n$ having the degrees of freedom are disposed in joint parts of the leg member units 194A to 194D, the coupled parts of the leg member unit 194A to 194D with the body member unit 193, and a coupled part of the head member unit 195 with the body member unit 193.

The CDD camera 205 of the head member unit 195 photographs a surrounding situation and sends it out to the controller 200. The microphone 206 gathers order sounds such as "walk", "lie down", and "chase a ball" which are given from a user in the form of sound scales with a sound commander (not shown), and sends out the obtained audio signal S40B to the controller 200.

The touch sensor 207 is disposed on the top of the head member unit 195 as can be seen from FIG. 40, to detect pressures which is received from a user by physical spurring such as "patting" and "striking", and sends out the detection result as a pressure detection signal S40C to the controller 200. The distance sensor 208 measures a distance to a front object, and sends out the measurement result as a distance measurement signal S40D to the controller 200.

Further, the battery sensor 201 detects/the residual amount of the battery 201 and sends out the detection result as a battery residual amount detection signal S41A to the controller 200. The heat sensor 203 detects the heat inside the robot body 191 and sends out the detection result as the heat detection signal S41B to the controller 200.

The controller 200 judges the surrounding situation and the internal situation of the robot body 193, the order from the user, and the spurring from the user, on the basis of the image signal S40A, the audio signal S40B, the pressure detection signal S40C, and the distance measurement signal S40D (hereinafter, these signals are simply referred to as an external sensor signal S40) which are supplied from the CDD camera 205, the microphone 206, the touch sensor 207, and the distance sensor 208 in the external sensor member 209, and the battery residual amount detection signal S41A and the heat detection signal S41B (hereinafter, these signals are simply referred to as an internal sensor signal S41) which are given from the battery sensor 202 and the temperature sensor 203 in the internal sensor member 204.

Then, the controller 200 determines next actions on the basis of the judgement result and control programs previously stored in a memory 200A and drives actuators 211$_1$ to 211$_n$ required for the next actions to allow the robot body to take actions such as swinging of the head member unit 195 up, down, left and right, and walking by driving the leg member units 211$_1$ to 211$_n$.

Further, in this time, the controller 200 supplies a predetermined audio signal S42 to the speaker 210 as occasion demands to give sounds based on the audio signal S42 to outside.

As described above, the robot body 191 autonomously act on the basis of surroundings, internal situations, and order and spurring from a user.

On the other hand, the cover unit 191 is composed of a face cover member 200A, a head cover member 200B, a loins cover member 221A, a flank cover member 221B, a chest cover member 222, and four pair of outside leg cover members 225A to 225D, inside leg cover members 226A to 226D and sole cover member 227A to 227D.

In this case, the face cover member 220 and the head cover member 221 can be fitted to the front and back of the head member unit 195 of the robot body 191. The loins cover member 222 and the flank cover member 223 can be fitted to the top and bottom of the body member unit 193 of the robot body 191. The chest cover member 222 can be fitted to the chest part of the body member unit 193 of the robot body 191, and the outside leg cover member 225A to 225D, the inside leg cover member 226A to 226D, and the sole cover member 227A to 227D can be fit to the outside, inside, and bottom of the leg member unit 194A to 194D of the robot body 191.

Therefore, holes 220A, 220B, 221$A_1$, 221$A_2$ of predetermined sizes are disposed at predetermined positions of the face cover member 220 and the head cover member 221 to fit the CCD camera 205, the distance sensor 207, the microphone 206 of the robot body 191. Thereby, the face cover member 220 and the head cover member 221 does not obstruct the robot body 191 at the time of photographing surrounding situations, gathering sounds from outside and measuring a distance to a front object with the CDD camera 205, the microphone 206, and the distance sensor 208 through the holes 220A, 220B, 221$A_1$, 221$A_2$.

Note that, in this embodiment, the hole 220B of the face cover member 220 corresponding to the distance sensor 208 is covered with a translucent member (hereinafter, referred to as a canopy) 228, which prevents the user from emotion strange due to the exposure of the distance measuring section of the distance sensor 208.

In addition to this configuration, a non-volatile memory 230 such as an EEPROM (Electric Erasable Programmable ROM) is disposed in the head cover member 220 of the cover unit 192 in the robot system 190. And this memory 230 stores information about a type of a cover for identifying the type of the cover unit 192, information about an object bone type which represent a type of the robot body 191 to which the cover unit 192 can be attached, port information which represent which device is connected to each external terminal in the connector member 231 of the head cover member 220 which is described later, characteristic information which is predetermined correction information corresponding to characteristic which is previously set for each cover unit 192, canopy information which consists of correction information for executing predetermined correction processing in accordance with optical characteristics of the canopy 228 of the cover unit 192, and various information (hereinafter, referred to as cover information) about the cover unit 192 such as cover physical information including various correction information which is used for correcting parameters related to motions of the robot body 191 when the cover unit 192 is fitted.

Further, in the robot system 190, the connector member (hereinafter, referred to as cover side connector member) 231 having a plurality of external connector terminals is disposed at predetermined position inside the head cover member 220, and disposed at predetermined corresponding position of the robot body 191 is a connector member (hereinafter, referred to as a robot side connector member) 232 having a plurality of external terminals. When the head cover member 220 is attached to the robot body 192 in a predetermined condition, the cover side connector member 231 and the robot side connector member 23 are electrically connected so that the controller 200 in the robot body 191 can read out the cover information from the memory 230 of the head cover member 221 via the cover side connector member 231 and the robot side connector member 232.

When the power is turned on, the controller 220 in the robot body 191 firstly accesses to the memory 230 in the cover unit 192 via the robot side connector member 232. In the case where the controller 220 can not read out the cover information (for example, in the case where a cover unit is not fitted), it does not do anything, and on the contrary, in the case where the cover information can be read out, the controller 220 checks the type of the attached cover unit 192, whether or not the cover unit 192 corresponds to the type of the robot body 191, and what type of device is connected to each port of the cover side connector member 231, on the basis of the read cover information, and also changes corresponding parameters on the basis of the canopy information and the cover physical information.

Then, the controller 220 of the robot body 191 controls actions of the robot body 191 in accordance with the parameters changed as described above. In this way, in the robot system 190, the robot body 191 changes actions dependently on a type of the cover unit 192 attached to the robot body 191.

(6-2) Processing by Controller 220

Next, the concrete processing by the controller 220 in the robot body 191 in this robot system 190 will be described.

The controller 220 executes aforementioned various processing in accordance with control programs stored in the memory 200A. Processing by the controller 220 is functionally classified into a condition recognizing section 240, a emotion and instinct model section 241 which determines emotions and instinct on the basis of the recognition result by the condition recognizing section 240, an action determining section 242 which determines a next action on the basis of the recognition result by the condition recognizing section 240 and an output from the emotion and instinct model section 241, and an action generating section 243 which makes the robot body 191 execute (manifest) the action based on the result determined by the action determining section 242.

Hereinafter, the condition recognizing section 240, the emotion and instinct model section 241, the action determining section 242 and the action generating section 243 will be described in detail.

(6-2-1) Configuration of Condition Recognizing Section 240

The condition recognizing section 240 recognizes specific conditions on the basis of an external sensor signal S40 from the external sensor member 209 (FIG. 41), an internal sensor signal S41 from the internal sensor member 204 (FIG. 41), and informs the emotion and instinct model section 241 and the action determining section 242 of the recognition result as condition recognition information S50.

Actually, the condition recognizing section 240 always checks image signals S40A which are supplied from the CCD camera 205 (FIG. 41) of the external sensor member 209, and when detecting, for example, "something round and red" or "an object" in an image based on the image signal S40A, recognizes that "there is a ball" or "there is an obstacle", and informs the emotion and instinct model section 241 and the action determining section 242 of the recognition result.

Further, at this time, the condition recognizing section 240 obtains a distance to the object on the basis of a distance detection signal S40D which is given from the distance sensor 208 of the external sensor member 209, and informs the emotion and instinct model section 241 and the action determining section 242 of the detection result.

In addition, the condition recognizing section 240 always checks audio signals S40B which are given from the microphone 206 (FIG. 41); and when recognizing the input of order such as "walk", "lie down", and "chase a ball" on the basis of the audio signal S40B, informs the emotion and instinct model section 241 and the action determining section 242 of the recognition result.

Further, the condition recognizing section 240 always checks pressure detection signals S40C which are given from the touch sensor 207 (FIG. 41) and when detecting on the basis of the pressure detection signal S40C pressure which has exceeded a predetermined threshold value and is applied for a short time (for example, less than two seconds), recognizes that "being struck (scolded)" and on the other hand, when detecting pressure of a large area which does not exceed the predetermined threshold value and is applied for a long time (for example, longer than two seconds), recognizes that "being patted (praised)" and informs the emotion and instinct model section 241 and the action determining section 242 of the recognition result.

Furthermore, the condition recognizing section 240 always checks heat detection signals S41B which are given from the heat sensor 203 (FIG. 41) of the internal sensor 204, and when detecting heat which exceeds a predetermined temperature on the basis of the heat detection signal S41B, recognizes that "internal temperature has raised" and inform the emotion and instinct model section 241 and the action determining section 242 of the recognition result.

(6-2-2) Configuration of Emotion and Instinct Model Section 241

The emotion and instinct model section 241 has parameters which represent intensities of 6 kinds of emotions: "joy", "sadness", "surprised", "horror", "hatred" and "anger". The emotion and instinct model section 241 successively updates the parameter for each emotion on the basis of the specific recognition result such as "being struck" and "being patted" which is given from the condition recognizing section 240 as the condition recognition information S50, the action determination information S51 representing determined output actions which are given from the action determining section 242 which will be described later, passage time and so on.

Concretely, by taking the amount of change in the emotion which is calculated by a predetermined equation on the basis of a degree (previously set) of the output action based on the recognition result which is obtained based on the condition recognition information S50, and the action determination information S51 with respect to the emotion, a degree of pressure and stimulation which are given from other emotions, and passage time, as ΔE[t], the parameter for the current emotion as E[t], and the coefficient which represents a rate of changing the emotion, on the basis of the recognition result and so on., as $k_e$, the emotion and instinct model section 241 calculates the parameter E[t+1] for the emotions of a next cycle from the following equation.

$$E[t+1]=E[t]+k_e\times\Delta E[t] \tag{6}$$

Then, the emotion and instinct model section 241 updates the parameter of the emotion by replacing the parameter for the current emotion E[t] with the calculated result. Note that, it is previously fixed that parameters for which emotions have to be updated for each recognition result and each output action. When the recognition result of "being struck" is made, for example, the parameter for the emotion "anger" is increased and the parameter for the emotion "joy" is decreased. In addition, when the recognition result of "being patted" is made, the parameter for the emotion "joy" is increased and the parameters of emotions "sadness" and "anger" are decreased.

Similarly to this configuration, the emotion and instinct model section 41 has parameters which represent intensities of five kinds of desires: "desire for movement", "attachment", "curiosity", "appetite" and "sleep". And the emotion and instinct model section 41 sequentially updates these parameters on the basis of recognition result from the condition recognizing section 240, passage time, and the notify from the action determining section 242.

Concretely, as to "desire for movement", "attachment" and "curiosity", by taking the amount of change in desire which is calculated by a predetermined equation on the basis of the output action of the robot body 191, passage time, the a recognition result and so on., as ΔI[k], a parameter for the current desire as I[k], and a coefficient representing the intensity of the desire as $k_i$, the emotion and instinct model section 241 calculates the parameter I[k+1] for the desire of a next cycle by the following equation.

$$I[k+1]=I[k]+k_i\times\Delta I[k] \tag{7}$$

Then, the emotion and instinct model section 241 updates the parameter for the desire by replacing the parameter I[k] of the desire with the calculated result. In this case, it is fixed that parameters of which desires have to be changed for the output action and the recognition result. For example, when the action deciding section 242 makes a notice of "did something", the parameter for the desire "desire for movement" is decreased.

In addition, as to the desire "appetite", by taking the residual amount of battery as $B_L$, the emotion and instinct model section 241 calculates the parameter I[k+1] for the desire "appetite" on the basis of the battery residual amount detection signal S42A (FIG. 41), which is given via the condition recognizing section 240, by a following equation.

$$I[k]=100-B_L \tag{8}$$

Then, the emotion and instinct model section 241 updates the parameter for the desire "appetite" by replacing the parameter I[k] for the current appetite with the calculated result.

Furthermore, as to the desire "sleep", the emotion and instinct model section 241 increases or decreases the parameter every fixed time with one day as one cycle.

Note that, the parameter for each emotion and each desire range from 0 to 100 and the coefficient $k_e$, $k_i$ are also individually set for each emotion and each desire.

(6-2-3) Configuration of Action Determining Section 242

The action determining section 242 decides a next action on the basis of the condition recognition information 50 which is given from the condition recognizing section 240, the parameters for emotions and desires in the emotion and instinct model section 241, the action model previously stored in the memory 200A, passage time and so on., and outputs the decided result as action determination information S51 to the emotion and instinct model section 241 and the action generating section 243.

Figure 44:
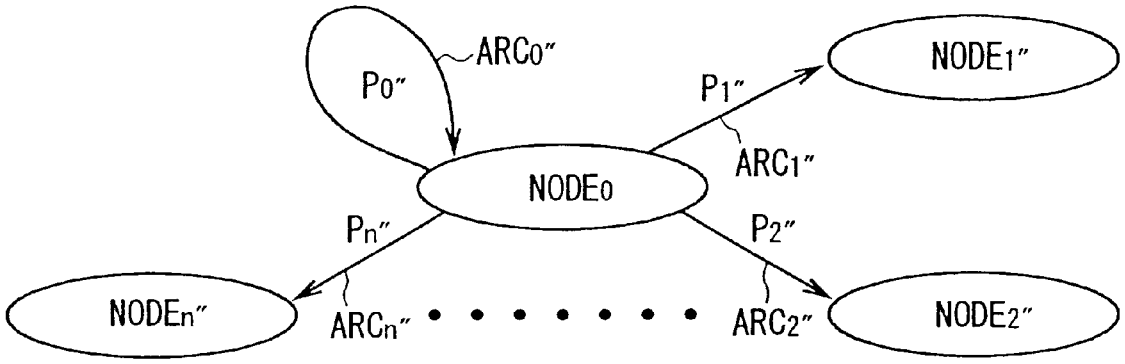
FIG. 44 is a conceptional diagram showing a probability automaton.

In this case, the action determining section 242, as a means of determining a next action, uses an algorithm referred to as a probability automaton which probably decides, on the basis of transition probability $P_0$" to $P_n$" respectively set for arc $ARC_0$" to $ARC_n$" which connect between nodes (conditions) $NODE_0$" to $NODE_n$", which node $NODE_0$" to $NODE_n$", the same or another, one node $NODE_0$" to $NODE_n$" is shifted to, as shown in FIG. 44.

More concretely, the memory 200A stores, as action models, a state transition table 244 shown in FIG. 45 for each node $NODE_0$" to $NODE_n$" so that the action determining section 242 determines a next action on the basis of the state transition table 244.

Here, in the state transition table 244, input events (the recognition result from the condition recognizing section 240) which are used as transition conditions in the nodes $NODE_0$" to $NODE_n$" are written on the "input event" line in the order of priority, and more specific conditions are written on corresponding rows of "data name" and "data limit" lines.

As described above, the node $NODE_{100}$ defined by the state transition table 244 in FIG. 45 has condition for transition to the same or another node $NODE_0$" to $NODE_n$". For example, when the recognition result of "detected a ball" is given, the condition is that "size" of the ball given together with the recognition result has to be between 0 and 100 (0,1000)", or for another example, when the recognition result of "detected an obstacle" is given, the condition is that "distance" to the obstacle given together with the recognition result has to be between 0 and 1000 (0,1000).

Further, even when the recognition result is not input in the node $_{100}$, the node can be shifted to the same or another node $NODE_0$" to $NODE_n$" when the parameter for any emotion "joy", "surprised", or "sadness" out of emotions and desires in the emotion and instinct model section 241, which are referred periodically by the action determining section 242, is between 50 and 100 (50, 100).

In addition, in the state transition table 244, some nodes $NODE_0$" to $NODE_n$" to which the node $NODE_0$" to $NODE_n$" can be shifted are written on a "transition destination node" line in a space for "transition probability to another node", and the transition probabilities to the nodes $NODE_0$" to $NODE_n$" in the case where the conditions written in the "input event", "data name" and "data limit" lines are all satisfied is written on the node $NODE_0$" to $NODE_n$" lines in the space for "transition probability to another node", an action and motion which are output at this time are written on an "output action" row. Note that, the sum of the transition probability on each line in the space for "transition probability" is 100 [%].

Therefore, the node $NODE_{100}$" in this example can be shifted to "node $NODE_{120}$" (node120)" at "probability of 30[%]" in the case where the following recognition results are given: "detected a ball" and the "size" of the ball is "between 0 and 1000 (0,1000)", and at this time, the action and motion of "ACTION 1" are output.

The action model is formed so that each node $NODE_0$" to $NODE_n$" written in the state transition table 244 has many nodes to be shifted to.

Thus, when the condition recognition information S50 is given from the condition recognizing section 240 or when the current actions have been performed for a fixed period of time, the action determining section 242 probably decides a next action and motion (action or motion written on the "output action" row) by using the state transition table 244 of the corresponding node $NODE_0$" to $NODE_n$" out of the action models stored in the memory 200A, and outputs the determination result as action determination information S51 to the emotion and instinct model section 242 and the action generating section 243.

(6-2-4) Configuration of Action Generating Section 243

The action generating section 243 has a data file (hereinafter, referred to as motion file) for each action which is used to determine how much each actuator $\mathbf{211}_1$ to $\mathbf{211}_n$ is moved at the time of making the robot body 191 manifest various actions, and a data file for plural sounds (hereinafter, referred to sound file), in the memory 200A.

Figure 41:
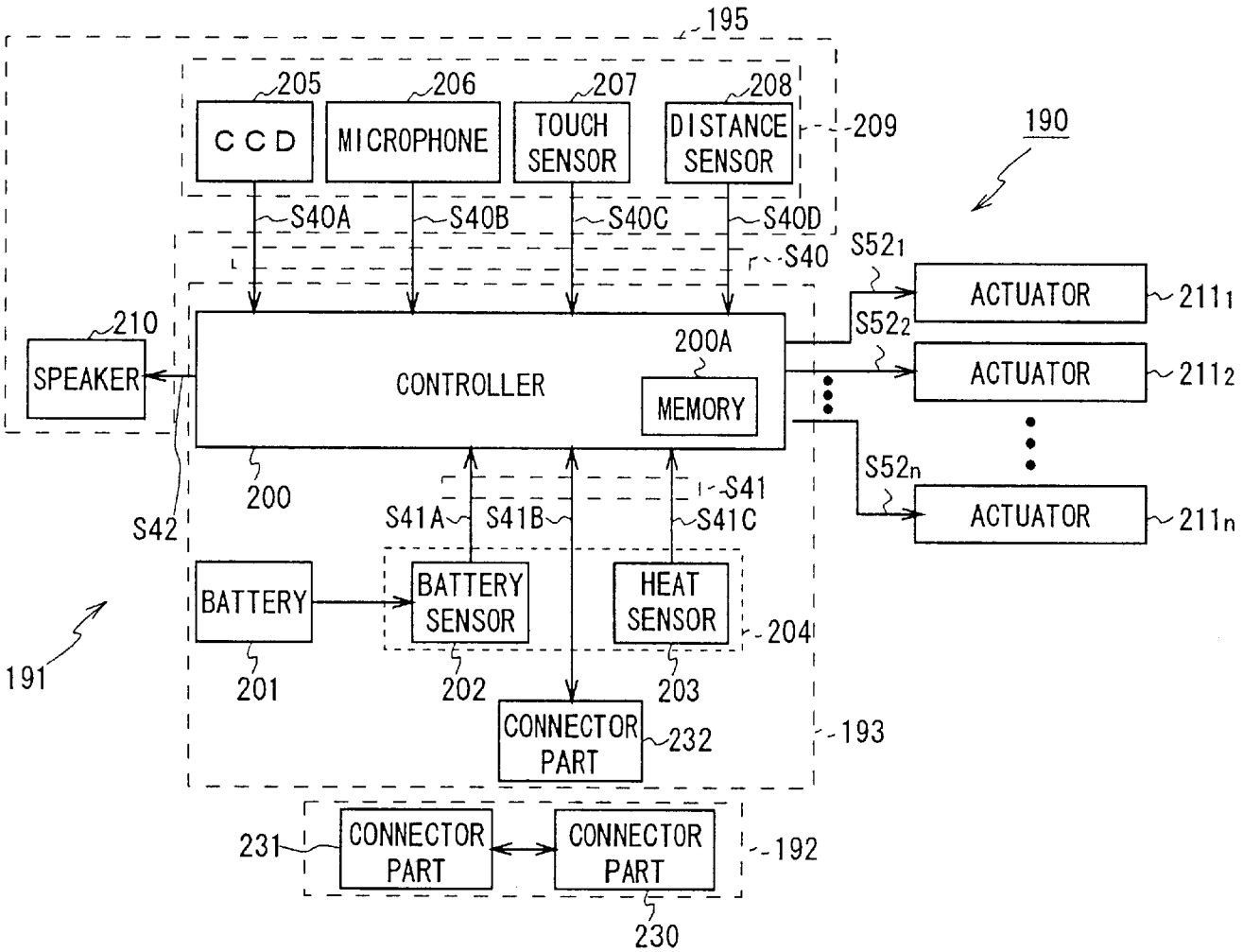
FIG. 41 is a block diagram showing an internal configuration of the robot system shown in FIG. 40.
Figure 43:
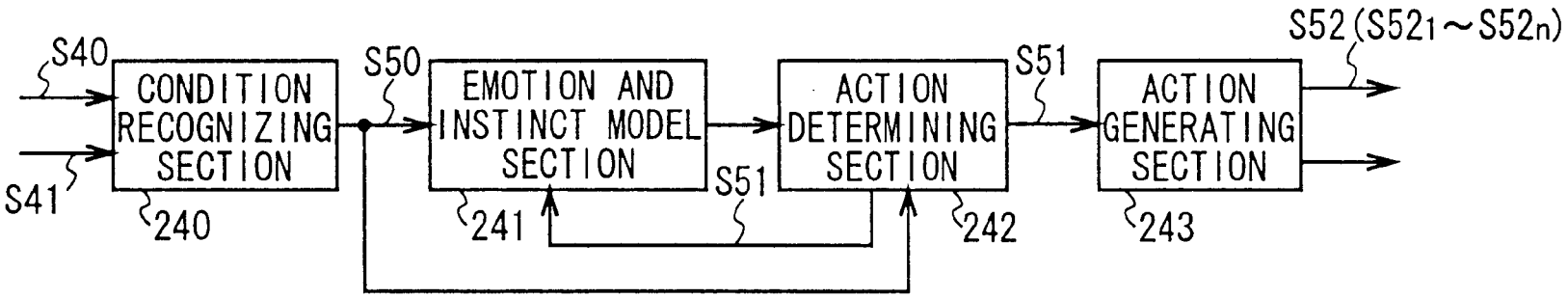
FIG. 43 is a block diagram descriptive of processing by a controller in the sixth embodiment.

The action generating section 243 reads out the corresponding motion file as occasion demands, from the memory 200A on the basis of the action determination information S51 which is given from the action determining section 242, sends the driving signal $\mathbf{S52}_1$ to $\mathbf{S52}_2$ to the actuators $\mathbf{211}_1$ to $\mathbf{211}_n$ on the basis of the motion file and play the corresponding sound file, thus outputting the obtained audio signal S42 to the speaker 210 (FIG. 41).

As a result, the required actuators 211, to 211, based on the driving signal $\mathbf{S52}_1$ to $\mathbf{S52}_n$ are driven and sounds based on the audio signal S42 are output from the speaker 210, thereby the robot body 191 manifests the actions and motions determined by the action determining section 242 as described above.

As described above, in the robot system 190, the robot body 191 can autonomously act on the basis of surrounding and internal conditions, orders and spurring from a user, under the control of the controller 200.

(6-3) Initial Setting Processing in Robot Body 190

Next, initial setting processing by the controller 200 of the robot body 191 in the robot system 190 will be described.

In this robot system 190, after the power is turned on as described above, the controller 200 of the robot body 191 firstly read out cover information by accessing to the memory 230 of the cover unit 192, and performs initial setting processing such as changing necessary parameters on the basis of the cover information.

In actual, in the case of the robot system 190, the memory 230 of the face cover member 221 of the cover unit 192 stores, as the aforementioned characteristic information, the changing value for corresponding transition probabilities $P_0$" to $P_n$" (FIG. 44) in the corresponding state transition table 244 (FIG. 45) out of the state transition table 244 which is used for generating an action model, and the state transition table 244 for the nodes $NODE_0$" to $NODE_n$" of the action models.

The controller 200 of the robot body 191 changes corresponding transition probabilities $P_0$" to $P_n$" in a corresponding state transition table 244 on the basis of the characteristic information included in the cover information read out from the memory 230 of the cover unit 192, and replaces the state transition table 244 for a corresponding node $NODE_0$" to $NODE_n$" with a new state transition table 244.

In addition, the memory 230 of the cover unit stores an offset value to perform the offset correction on an output voltage of the distance sensor 208 (FIG. 41) as canopy information.

Figure 47:
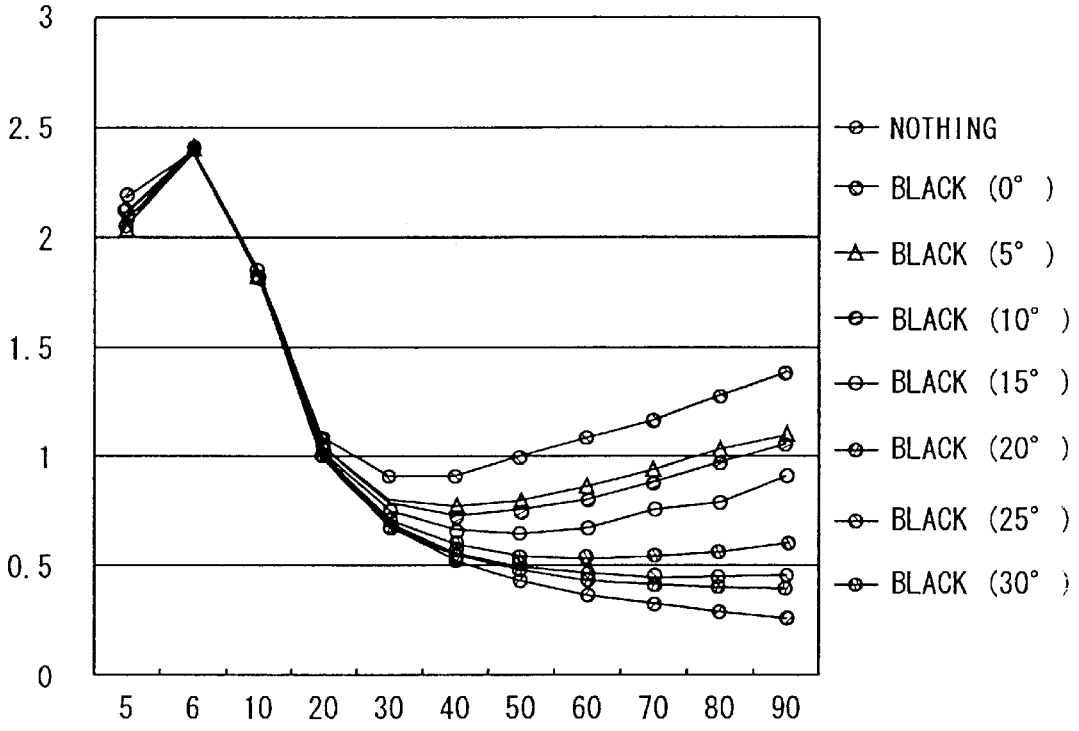
FIG. 47 is a characteristic curvilinear graph showing the relation between an angle of incline of the canopy with respect to an optical axis of the distance sensor and the output characteristic of the distance sensor.
Figure 49:
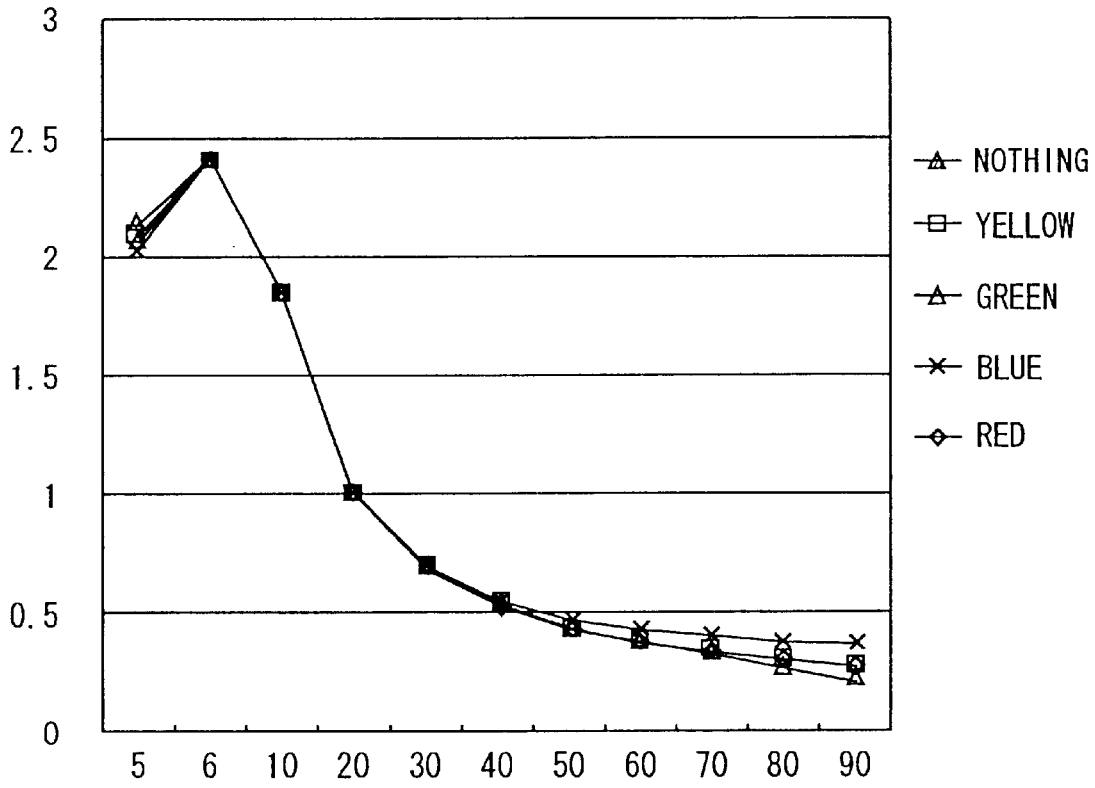
FIG. 49 is a characteristic curvilinear graph showing the relation between the colors of the canopy and the output characteristics of the distance sensor.

That is, in the case of measuring a distance to an object which is in front of the distance sensor 208, via the canopy 228 (FIG. 40), a measurement error occurs due to an angle of incline of the canopy 228 with respect to the angle of incidence toward the distance sensor 208 as shown in FIG. 46 and FIG. 47, and the color of canopy as shown in FIG. 48 and FIG. 49. Note that, in FIG. 46 and FIG. 48, the numbers on the most left line represent distances to an object to be measured, the numbers on the other lines represent output voltages of the distance sensor 208 for the angle of incline of the canopy 228 by taking the vertical condition to the optical axis of the distance sensor 208 as 0 degree. In addition, in FIG. 47 and FIG. 49, the ordinate represents output voltages from the distance sensor 208 and the abscissa represents distances to an object to be measured.

Therefore, in the robot system 190, the memory 230 of the cover unit 192 stores offset values to perform the offset correction on an output voltage from the distance sensor 208 (FIG. 41) in correspondence with the angle of incline and the color of the canopy 208 of the cover unit 192.

The controller 200 of the robot body 191 changes, on the basis of the canopy characteristic information included in the cover information which is read out from the memory 200A of the cover unit 192, the offset values for the distance measurement signal S40D of the time when the condition recognizing section 240 recognizes the distance to the front objet on the basis of the distance measurement signal S40D.

Further, the memory 230 of the cover unit 192 stores barycenter location information which represent the position of barycenter of the entire robot system 190 with the cover unit 192 fitted over the robot body 192, motion information which represent moment of inertia of each movable unit at the time of fitting the cover unit 192, and movable range information which represent the movable range of each movable unit at the time of fitting the cover unit 192.

Then, the controller 200 of the robot body 192 changes parameters for walking-control described in FIG. 31 and other corresponding parameters, which are stored in the memory 200A, on the basis of the barycenter location information out of the cover physical information included in the cover information read out from the memory 230 of the cover unit 192.

As described above, in the robot system 190, the parameters in the robot body 191 can be changed on the basis of the cover information stored in the memory 230 of the cover unit 192, thereby the robot body 191 can manifest actions dependently on the cover unit 192 attached to the robot body 191.

(6-4) Operations and Effects in the Embodiment

In the robot system 190 having the aforementioned configuration, the controller 200 reads out the cover information from the memory 230 of the cover unit 192 at the time of turning the power of the robot body 191 on, and changes required parameters on the basis of the cover information.

Therefore, the robot body 191 can manifest actions based on the cover unit 192 by storing the information corresponding to the shape, color and forms of the cover unit 192 as the cover information.

According to the aforementioned configuration, the memory 230 storing cover information corresponding to the forms of the cover unit 192 is disposed in the cover unit 192, the controller 200 of the robot body 191 reads out the cover information at the time of turning the power on, and changes parameters to control actions an motions of the robot body 191 on the basis of the cover information, thereby the robot body 191 can manifest actions and motions according to the type of the cover unit 192, which can remarkably improve the amusement property in the robot system.

INDUSTRIAL APPLICABILITY

The robot system, the robot apparatus and the cover for the robot apparatus can be applied to a robot system composed of a pet robot and a cover for a robot apparatus.

What is claimed is:

1. A robot system, comprising:

a robot apparatus;

a cover to be detachably fitted over said robot apparatus;

a predetermined authenticating pattern disposed on said cover;

authenticating means disposed on said robot apparatus for authenticating said cover on the basis of said authenticating pattern on said cover fitted; and action model determining means for changing a model for determining an action to be taken by said robot apparatus in accordance with information of the cover of the robot.

2. The robot system according to claim 1, wherein:

said authenticating pattern is a first concavo-convex pattern having a predetermined form; and said authenticating means is a second concavo-convex pattern having a predetermined form which fits said first concavo-convex pattern in a predetermined condition only when said first concavo-convex pattern is a regular pattern.

3. The robot system according to claim 2, wherein said first concavo-convex pattern has a concavo-convex form of a registered design.

4. The robot system according to claim 1, wherein:

said authenticating pattern is a concavo-convex pattern having a predetermined form; and said authenticating means electrically detects a concavo-convex form of said concavo-convex pattern on said cover and authenticates said cover on the basis of the detection result.

5. A cover for a robot apparatus, comprising:

a predetermined authenticating pattern, wherein said cover is detachably fitted over said robot apparatus with authenticating means for authentication on the basis of said authenticating pattern, and wherein an action model determining means of said robot changes a model for determining an action to be taken by said robot apparatus in accordance with information of the cover of the robot.

6. The cover for a robot apparatus according to claim 5, wherein said authenticating pattern is a concavo-convex pattern having a predetermined form.

7. The cover for a robot apparatus according to claim 6, wherein said concavo-convex pattern has a concavo-convex form of a registered design.

8. A robot apparatus manifesting predetermined motions, comprising:

information detecting means for detecting inherent information corresponding to a cover when said cover is detachably fitted;

control means for changing manifesting patterns of said motions as occasion demands on the basis of said inherent information detected; and action model determining means for changing a model for determining an action to be taken by said robot apparatus in accordance with information of the cover of the robot.

9. The robot apparatus according to claim 8, comprising a memory for storing said inherent information as data, and wherein said robot apparatus has data reading means for reading out said data from said memory.

10. A mobile robot comprising:

a cover which has information of the robot, mounted detachably on the robot; and means for holding an emotion model of the robot, wherein the emotion model is changed when the cover is replaced in accordance with information of the robot which a replaced cover has.

11. A cover for a mobile robot comprising:

means for holding information of the robot which the cover is mounted on, wherein an emotion model of the robot is changed when the cover is mounted on the robot in accordance with the information of the robot of the cover.

12. A mobile robot comprising:

a cover which has information of the robot, mounted detachably on the robot; and means for holding an instinct model of the robot, wherein the instinct model is changed when the cover is replaced in accordance with information of the robot which a replaced cover has.

13. A cover for a mobile robot comprising:

means for holding information of the robot which the cover is mounted on, wherein an instinct model of the robot is changed when the cover is mounted on the robot in accordance with the information of the robot of the cover.

14. A mobile robot comprising:

a cover which has type information of the robot, mounted detachably on the robot; and means for holding motion information of the robot, wherein the motion information is changed when the cover is replaced in accordance with the type of information of the robot which a replaced cover has.

15. The mobile robot according to claim 14, wherein the motion information is a gait pattern of the robot.

16. The mobile robot according to claim 14, wherein the mobile information is a behavior pattern of the robot.

* * * * *